US007348113B2

(12) United States Patent
Shoshi et al.

(10) Patent No.: US 7,348,113 B2
(45) Date of Patent: Mar. 25, 2008

(54) ELECTROPHOTOGRAPHIC PHOTOCONDUCTOR COMPRISING A POLYCARBONATE RESIN HAVING A DIHYDROXY DIPHENYL ETHER UNIT

(75) Inventors: Masayuki Shoshi, Kanagawa (JP); Yuko Komai, Shizuoka (JP); Hiroshi Tamura, Shizuoka (JP); Masaomi Sasaki, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 317 days.

(21) Appl. No.: 10/937,687

(22) Filed: Sep. 10, 2004

(65) Prior Publication Data

US 2005/0106483 A1 May 19, 2005

(30) Foreign Application Priority Data

Sep. 10, 2003 (JP) ..... 2003-317773
Sep. 19, 2003 (JP) ..... 2003-328982
Sep. 22, 2003 (JP) ..... 2003-329250

(51) Int. Cl.
*G03G 9/087* (2006.01)

(52) U.S. Cl. ..... 430/58.7; 430/96; 430/59.6

(58) Field of Classification Search ..... 430/58.7, 430/96, 59.6, 69; 528/196
See application file for complete search history.

(56) References Cited

U.S. PATENT DOCUMENTS 5,059,708 A 10/1991 Aruga et al.
5,158,850 A 10/1992 Sasaki et al.
5,159,084 A 10/1992 Shoshi
5,227,512 A 7/1993 Shoshi
5,234,623 A 8/1993 Shoshi et al.
5,248,826 A 9/1993 Sasaki et al.
5,268,246 A 12/1993 Aruga et al.
5,310,503 A 5/1994 Shoshi
5,312,707 A 5/1994 Ota et al.
5,314,997 A 5/1994 Shoshi et al.
5,319,069 A 6/1994 Sasaki et al.
5,322,753 A 6/1994 Tamura et al.
5,334,470 A 8/1994 Shimada et al.
5,344,985 A 9/1994 Tanaka et al.
5,350,653 A 9/1994 Shoshi et al.
5,356,742 A 10/1994 Shimada et al.
5,370,954 A 12/1994 Ohta et al.
5,387,487 A 2/1995 Shoshi et al.
5,403,950 A 4/1995 Shimada et al.
5,411,827 A 5/1995 Tamura et al.
5,420,332 A 5/1995 Shimada et al.
5,427,880 A 6/1995 Tamura et al.
5,434,028 A 7/1995 Shimada et al.
5,436,100 A 7/1995 Shimada et al.
5,457,232 A 10/1995 Tanaka et al.
5,459,275 A 10/1995 Tanaka et al.
5,460,909 A 10/1995 Shoshi et al.
5,474,868 A 12/1995 Adachi et al.
5,475,137 A 12/1995 Shimada et al.
5,480,753 A 1/1996 Shimada et al.
5,486,438 A 1/1996 Shoshi et al.
5,488,137 A 1/1996 Tamura et al.
5,489,495 A 2/1996 Anzai et al.
5,492,784 A 2/1996 Yoshikawa et al.
5,496,671 A 3/1996 Tamura et al.
5,547,792 A 8/1996 Shimada et al.
5,569,800 A 10/1996 Aruga et al.
5,576,132 A 11/1996 Tanaka et al.
5,578,405 A 11/1996 Ikegami et al.
5,587,516 A 12/1996 Tanaka et al.
5,599,995 A 2/1997 Tanaka et al.
5,604,065 A 2/1997 Shimada et al.
5,608,010 A 3/1997 Tamura et al.
5,616,805 A 4/1997 Tanaka et al.
5,618,935 A 4/1997 Shoshi et al.
5,631,404 A 5/1997 Anzai et al.
5,641,598 A 6/1997 Tanaka et al.
5,663,407 A 9/1997 Shimada et al.
5,672,728 A 9/1997 Tanaka et al.
5,672,756 A 9/1997 Shimada et al.
5,700,614 A 12/1997 Kawahara et al.

(Continued)

OTHER PUBLICATIONS

U.S. Appl. No. 11/033,802, filed Jan. 13, 2005, Yanagawa, et al.

(Continued)

*Primary Examiner*—John L Goodrow
(74) *Attorney, Agent, or Firm*—Oblon, Spivak, McClelland, Maier & Neustadt, P.C.

(57) ABSTRACT

A polycarbonate resin has a constitutional unit expressed by the following general formula (I):

General formula (I)

$A_1$ represents an alkyl group which is substitutional or nonsubstitutional, and an aryl group which is substitutional or nonsubstitutional. $A_2$, $A_3$, $A_4$, $A_5$, $A_6$ and $A_7$ each represent one of a hydrogen atom, a halogen atom, an alkyl group which has 1 to 6 carbon atoms and is substitutional or nonsubstitutional.

17 Claims, 6 Drawing Sheets

U.S. PATENT DOCUMENTS 5,723,243 A 3/1998 Sasaki et al.
5,747,204 A 5/1998 Anzai et al.
5,750,762 A 5/1998 Kawahara et al.
5,783,653 A * 7/1998 Okamoto ..... 528/196
5,789,128 A 8/1998 Adachi et al.
5,807,964 A * 9/1998 Sivaram et al. ..... 528/196
5,808,155 A 9/1998 Shimada et al.
5,830,980 A 11/1998 Anzai et al.
5,840,454 A 11/1998 Nagai et al.
5,846,680 A 12/1998 Adachi et al.
5,863,683 A 1/1999 Ohta et al.
5,871,876 A 2/1999 Ikuno et al.
5,880,248 A * 3/1999 Sakashita et al. ..... 528/196
5,910,561 A 6/1999 Adachi et al.
5,942,362 A 8/1999 Tadokoro et al.
5,942,363 A 8/1999 Tanaka et al.
5,976,746 A 11/1999 Tanaka et al.
5,981,124 A 11/1999 Shimada et al.
6,018,014 A 1/2000 Nagai et al.
6,027,846 A 2/2000 Shimada et al.
6,030,733 A 2/2000 Kami et al.
6,045,959 A 4/2000 Katayama et al.
6,066,428 A 5/2000 Katayama et al.
6,066,757 A 5/2000 Tanaka et al.
6,068,956 A 5/2000 Namba et al.
6,069,224 A 5/2000 Adachi et al.
6,074,792 A 6/2000 Namba et al.
6,093,784 A 7/2000 Tamura et al.
6,103,435 A 8/2000 Shimada et al.
6,130,310 A 10/2000 Katayama et al.
6,151,468 A 11/2000 Kami et al.
6,172,176 B1 1/2001 Tanaka et al.
6,184,362 B1 2/2001 Shimada et al.
6,187,492 B1 2/2001 Ri et al.
6,187,494 B1 * 2/2001 Kawamura et al. ..... 430/96
6,191,249 B1 2/2001 Tanaka et al.
6,194,535 B1 2/2001 Katayama et al.
6,210,848 B1 4/2001 Nagai et al.
6,271,356 B1 8/2001 Shimada et al.
6,303,736 B1 10/2001 Kawamura et al.
6,313,288 B1 11/2001 Shimada et al.
6,316,577 B1 11/2001 Shimada et al.
6,326,112 B1 12/2001 Tamura et al.
6,444,387 B2 9/2002 Ri et al.
6,465,648 B1 10/2002 Tadokoro et al.
6,486,293 B1 11/2002 Ri et al.
6,524,761 B2 2/2003 Shimada et al.
6,544,701 B2 4/2003 Tadokoro et al.
6,576,386 B1 6/2003 Ri et al.
6,641,964 B2 11/2003 Ikuno et al.
6,664,361 B2 12/2003 Sasaki et al.
2002/0098430 A1 * 7/2002 Kawamura et al. ..... 430/96

OTHER PUBLICATIONS

U.S. Appl. No. 10/242,485, filed Sep. 13, 2002, Shoshi, et al.
U.S. Appl. No. 10/175,799, filed Jun. 21, 2002, Li, et al.
U.S. Appl. No. 10/625,570, filed Jul. 24, 2003, Tamoto, et al.
U.S. Appl. No. 09/985,347, filed Nov. 2, 2001, Tamoto, et al.
U.S. Appl. No. 10/638,637, filed Aug. 12, 2003, Ikuno, et al.
U.S. Appl. No. 10/347,743, filed Jan. 22, 2003, Kawamura, et al.
U.S. Appl. No. 10/051,230, filed Jan. 22, 2002, Kawamura, et al.
U.S. Appl. No. 09/610,427, filed Jul. 5, 2000, Kawamura, et al.
U.S. Appl. No. 08/862,260, filed May 23, 1997, Kishida, et al.
U.S. Appl. No. 08/562,154, filed Nov. 22, 1995, Anzai, et al.
U.S. Appl. No. 08/823,694, filed Mar. 25, 1997, Sasaki, et al.
U.S. Appl. No. 08/494,051, filed Jun. 23, 1995, Sasaki, et al.
U.S. Appl. No. 08/453,827, filed May 30, 1995, unknown.
U.S. Appl. No. 08/165,857, filed Dec. 14, 1993, unknown.
U.S. Appl. No. 08/205,376, filed Mar. 4, 1994, Adachi, et al.
U.S. Appl. No. 08/077,444, filed Jun. 17, 1993, Adachi, et al.
U.S. Appl. No. 08/399,830, filed Mar. 7, 1995, Adachi, et al.
U.S. Appl. No. 08/361,032, filed Dec. 21, 1994, Adachi, et al.
U.S. Appl. No. 08/397,729, filed Mar. 2, 1995, Adachi, et al.
U.S. Appl. No. 08/094,898, filed Jul. 22, 1993, Unknown.
U.S. Appl. No. 11/082,833, filed Mar. 18, 2005, Suzuki, et al.
U.S. Appl. No. 11/136,488, filed May 25, 2005, Yanagawa, et al.
U.S. Appl. No. 11/157,060, filed Jun. 21, 2005, Ikuno, et al.
U.S. Appl. No. 11/157,998, filed Jun. 22, 2005, Tamura, et al.
U.S. Appl. No. 11/190,972, filed Jul. 28, 2005, Shoshi, et al.
U.S. Appl. No. 11/209,755, filed Aug. 24, 2005, Shoshi.
U.S. Appl. No. 11/245,135, filed Oct. 7, 2005, Nagai, et al.
U.S. Appl. No. 11/563,710, filed Nov. 28, 2006, Inaba, et al.
U.S. Appl. No. 11/616,523, filed Dec. 27, 2006, Fujiwara, et al.

* cited by examiner

ELECTROPHOTOGRAPHIC PHOTOCONDUCTOR COMPRISING A POLYCARBONATE RESIN HAVING A DIHYDROXY DIPHENYL ETHER UNIT

BACKGROUND OF THE INVENTION

1. Field of the Invention

The present invention relates to a new aromatic polycarbonate resin, an electrophotographic photoconductor containing the aromatic polycarbonate resin, a dihydroxy diphenyl ether compound useful as a raw material monomer of the aromatic polycarbonate resin, and a process of manufacturing the dihydroxy diphenyl ether compound. More specifically, the present invention relates to the aromatic polycarbonate resin having a specific diphenyl ether structure that is useful as a material of the electrophotographic photoconductor; the electrophotographic photoconductor containing the aromatic polycarbonate resin and having high sensitivity and high durability; the dihydroxy diphenyl ether compound useful as the raw material monomer of a high polymer material such as the aromatic polycarbonate resin and the like that is excellent in wear resistance, heat resistance, and the like; and the process of selectively and easily manufacturing the dihydroxy diphenyl ether compound.

2. Description of the Related Art

A typical and known aromatic polycarbonate resin is the one that is obtained by reacting phosgene or diphenyl carbonate with 2,2-bis(4-hydroxy phenyl)propane (for short, hereinafter referred to as "bisphenol A"). The polycarbonate resin obtained from the bisphenol A is excellent in such properties as transparency, heat resistance, dimensional accuracy/precision, mechanical strength, and the like, and thereby is used in many fields. For example, many studies have been done on the bisphenol A as a binder resin for organic photoconductor that is used for electrophotography. A typical constitutional example of the organic photoconductor includes a laminated photoconductor formed by sequentially laminating on a conductive substrate a charge generating layer and a charge transporting layer. The charge transporting layer is formed with a low molecular charge transporting material and a binder resin. As the binder resin, many aromatic polycarbonate resins are named. The above containing of the low molecular charge transporting material, however, may lower the intrinsic mechanical strength of the binder resin, thereby causing such failures of the photoconductor as deteriorated wear resistance, scratches, cracks and the like. With this, the durability of the photoconductor may be lost.

Proposed in the past as a photoconductive high polymer material include vinyl polymers such as polyvinyl anthracene, polyvinyl pyrene, poly-N-vinyl carbazole and the like, although they are not sufficient in terms of photosensitivity. On the other hand, the study is done on a high polymer material having charge transportability, so as to overcome shortcomings of the laminated photoconductor. Examples of the above high polymer material include an acrylic resin having a triphenyl amine structure (M. Stolka et al, J. Polym. Sci., vol 21, 969 (1983)) and a vinyl polymer having a hydrazone structure (Japan Hard Copy '89 P. 67). Moreover the above examples include polycarbonate resin having triaryl amine structure (U.S. Pat. No. 4,801,517, U.S. Pat. No. 4,806,443, U.S. Pat. No. 4,806,444, U.S. Pat. No. 4,937,165, U.S. Pat. No. 4,959,288, U.S. Pat. No. 5,030,532, U.S. Pat. No. 5,034,296 U.S. Pat. No. 5,080,989, Japanese Patent Application Laid-Open No. 64-9964, JP-A No. 3-221522, JP-A No. 2-304456, JP-A No. 4-11627, JP-A No. 4-175337, JP-A No. 4-18371, JP-A No. 4-31404, JP-A No. 4-133065, and the like). Any of the above listed are not practical. Moreover, an aromatic polycarbonate resin having α-phenyl stilbene structure (JP-A No. 11-29634), an aromatic polycarbonate resin having carbazole (Japanese Patent No. 2958100) are studied, but they are not practical.

By using a tetraaryl benzidine derivative as a model compound, M. A. Abkowitz and others made a comparison between a polycarbonate of low dispersion type with a polycarbonate of high polymer, to find that the high polymer polycarbonate has one-digit lower drift mobility (for example, Physical Review B46 6705 (1992)). The cause for the above is yet to be clarified. Making of the high polymer can improve the mechanical strength, although leaving problems in electrical properties including sensitivity, residual potential and the like.

The cause therefor is yet to be clarified. A polymer with its main chain having a skeleton featuring charge transportability (represented by tetraaryl benzidine), especially, a polycarbonate resin may bring about a localized electron, which may be caused by an effect of an electron donation property of electron-attractive carbonyl dioxy group and tertiary amine (substituted with an aryl group on a tetraaryl benzidine skeleton). As a result, a molecular design is supposed to be disadvantageous for hole mobility. The above is supposed to be responsible that the making of the high polymer leaves the problems (i.e., insufficiency) in electrical properties including the sensitivity, the residual potential and the like.

On the other hand, a new trial is being studied, using polyallylene vinylene as disclosed in JP-A No. 10-310635.

On the other hand, examples of diol as a raw material of the high polymer compound include aromatic diols such as bisphenol A, bisphenol S, bisphenol Z, hydroquinone, resorcinol, 4,4'-dihydroxy diphenyl, 2,6-dihydroxy naphthalene, 2,5-dihydroxy naphthalene, and the like; and aliphatic diols and alicyclic diols such as ethylene glycol, propylene glycol, cyclohexane dimethanol, and the like. The above diols are used as constitutional component of resins such as polycarbonate, polyester, polyurethane, polyether, and the like.

Especially, examples of typical known aromatic polycarbonate resin include a polycarbonate resin that is obtained by reacting phosgene or diphenyl carbonate with bisphenol A. The above polycarbonate resin from the bisphenol A is excellent in properties such as transparency, heat resistance, dimensional accuracy/precision, mechanical strength, and the like, and thereby is used in many fields.

For the purpose of improving the heat resistance, chemical resistance, mechanical property of the resins including the polycarbonate, polyester, polyurethane, polyether and the like, introduction of a constitutional component having an ether bond in molecule is known. Examples of the above include 4,4'-dihydroxy diphenyl ether, 4,4'-dihydroxy-3,3'-dimethyl diphenyl ether, and the like.

Processes of manufacturing the dihydroxy diphenyl ether compound generally include a first process of directly manufacturing 4,4'-dihydroxy diphenyl ether by heating hydrogen fluoride together (refer to U.S. Pat. No. 2,739,171); a second process of manufacturing 4,4'-dihydroxy diphenyl ether by subjecting a diphenyl ether as a raw material to acylation, Baeyer-Villiger oxidation, and subsequent hydrolysis (refer to JP-A No. 2002-167348); and the like. Moreover, a third process is reported in which a hydroquinone is reacted in an inactive solvent in the presence of a natural aluminum silicate or a synthesized aluminum silicate, to thereby obtain i) from 2-methyl hydroquinone, a 3-isomer mixture of dimethyl hydroxy diphenyl ether and ii) from 2,6-dimethyl hydroquinone, a 3-isomer mixture of tetramethyl dihydroxy diphenyl ether (refer to JP-A No. 49-55635). Moreover, a fourth process is known in which alkoxy phenol is reacted with halide in the presence of i) alkali metal hydride or carbonate and ii) copper or copper compound, to thereby generate dialkoxy diphenyl ether compound, followed by a dealkylation thereof to thereby manufacture 4,4'-dihydroxy-3,3'-dimethyl diphenyl ether compound (refer to JP-A No. 2002-161062).

As described above, the dihydroxy diphenyl ether compound is synthesized. For obtaining the dihydroxy diphenyl ether compound having a substituent in a specific position of molecule, the above process of manufacturing the dihydroxy diphenyl ether compound from the hydroquinone is problematical, since this process needs refining of the isomer mixtures of several types. The above process of reacting the alkoxy phenol with the halide, followed by the dealkylation may cause high temperature, thus elongating man hour for the dealkylation and the like, which is problematical.

SUMMARY OF THE INVENTION

With the above status quo of the related arts described above, it is an object of the present invention to provide i) a new aromatic polycarbonate resin that is useful as a binder resin of an organic photoconductor or as a charge transportability high polymer material; ii) an electrophotographic photoconductor containing the above aromatic polycarbonate resin and having high sensitivity and high durability; iii) the dihydroxy diphenyl ether compound useful as a raw material monomer of a high polymer material such as the aromatic polycarbonate resin and the like that is excellent in wear resistance, heat resistance and the like; and iv) a process of manufacturing the dihydroxy diphenyl ether compound.

After studying hard, the inventors and others have found that a new aromatic polycarbonate resin containing a specific constitutional unit can solve the above problems.

A first aspect of the present invention provides a polycarbonate resin, comprising: a constitutional unit expressed by the following general formula (I):

General formula (I)

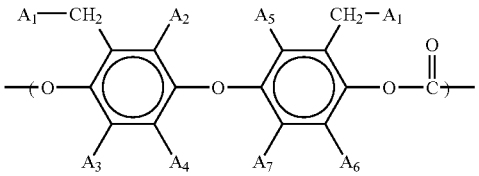

wherein $A_1$ represents an alkyl group which is substitutional or nonsubstitutional, and an aryl group which is substitutional or nonsubstitutional, and wherein $A_2$,$A_3$,$A_4$,$A_5$,$A_6$ and $A_7$ each represent a hydrogen atom, a halogen atom, an alkyl group which has 1 to 6 carbon atoms and is substitutional or nonsubstitutional.

A second aspect of the present invention according to the first aspect provides that the constitutional unit expressed by the general formula (I) is a constitutional unit expressed by the following general formula (II):

General formula (II)

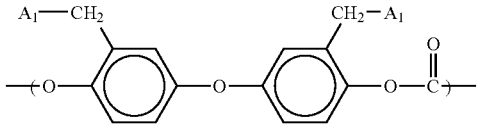

wherein $A_1$ represents an alkyl group which is substitutional or nonsubstitutional, and an aryl group which is substitutional or nonsubstitutional.

A third aspect of the present invention according to the first aspect provides that the polycarbonate resin further comprises a constitutional unit expressed by the following general formula (III):

General formula (III)

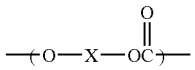

wherein a composition ratio k of the constitutional unit expressed by the general formula (I) and a composition ratio j of the constitutional unit expressed by the general formula (III) satisfy the following expression: $0<k/(k+j)\leqq 1$, wherein X represents one of an aliphatic divalent group, an alicyclic divalent group, an aromatic divalent group, and a divalent group which is made by bonding the divalent groups selected from the aliphatic divalent group, the alicyclic divalent group and the aromatic divalent group, wherein X otherwise represents at least one of the following:

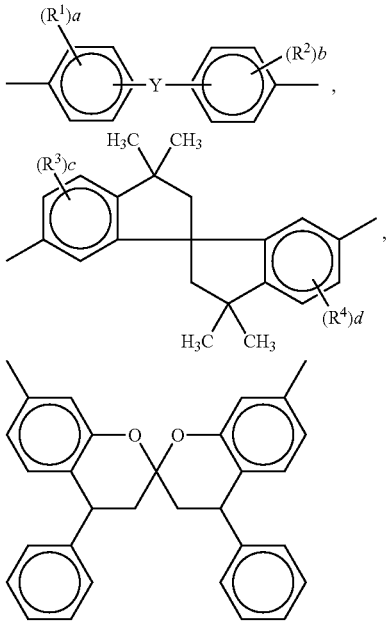

wherein $R^1$, $R^2$, $R^3$ and $R^4$ each represent one of an alkyl group which is substitutional or nonsubstitutional, an aryl group which is substitutional or nonsubstitutional, and a halogen atom, wherein a and b each represent an integer of 0 to 4, wherein c and d each represent an integer of 0 to 3, wherein Y is selected from: a single bond, a straight chain alkylene group having 2 to 12 carbon atoms, a branched alkylene group having 3 to 12 carbon atoms, a polyoxy alkylene group having 3 to 12 carbon atoms, —O—, —S—, —SO—, —$SO_2$, —CO—,

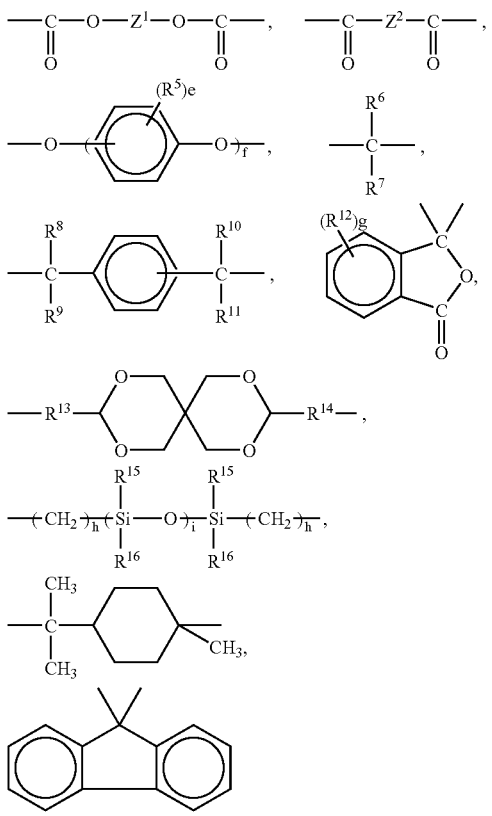

wherein $Z^1$ and $Z^2$ represent one of an aliphatic divalent group which is substitutional or nonsubstitutional, and an allylene group which is substitutional or nonsubstitutional, wherein $R^6$, $R^7$, $R^8$, $R^9$, $R^{10}$, $R^{11}$ and $R_{12}$ each represent one of a hydrogen atom, a halogen atom, an alkyl group which has 1 to 5 carbon atoms and is substitutional or nonsubstitutional, an alkoxy group which has 1 to 5 carbon atoms and is substitutional or nonsubstitutional, and a phenyl group which is substitutional or nonsubstitutional, wherein $R^6$ and $R^7$ may be bonded with each other to form one of a carbon ring having 5 to 12 carbon atoms, and a heterocyclic ring having 5 to 12 carbon atoms, wherein $R^6$ and $R^7$ may form one of a carbon ring and a heterocyclic ring in cooperation with $R_2$ and $R_3$, wherein $R^{13}$ and $R^{14}$ represent one of a single bond, an alkylene group having 1 to 4 carbon atoms, and a polyoxy alkylene group having 1 to 4 carbon atoms, wherein each of $R^{15}$ and $R^{16}$ is one of an alkyl group which has 1 to 5 carbon atoms and is substitutional or nonsubstitutional, and an aryl group which is substitutional or nonsubstitutional, wherein e represents an integer of 0 to 4, wherein f represents an integer of 0 to 20, and wherein g represents an integer of 0 to 4.

A fourth aspect of the present invention according to the third aspect provides that the polycarbonate resin comprises a repeating unit expressed by the following general formula (IV):

General formula (IV)

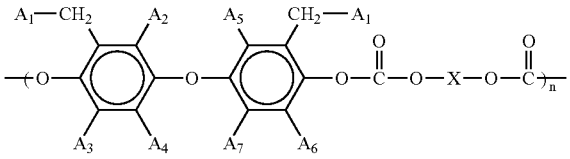

wherein $A_1$,$A_2$,$A_3$,$A_4$,$A_5$,$A_6$ and $A_7$ are defined in the first aspect, wherein X is defined in the third aspect, wherein n represents a repeating number which is an integer of 2 to 5000.

A fifth aspect of the present invention according to the first aspect provide that the polycarbonate resin further comprises a constitutional unit expressed by the following general formula (V):

General formula (V)

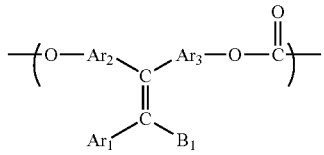

wherein a composition ratio k of the constitutional unit expressed by the general formula (I) and a composition ratio j of the constitutional unit expressed by the general formula (V) satisfy the following expression: $0<k/(k+j)\leqq 1$, wherein $B_1$ represents one of a hydrogen atom, an alkyl group which is substitutional or nonsubstitutional, and an aryl group which is substitutional or nonsubstitutional, wherein $Ar_1$ represents an aryl group which is substitutional or nonsubstitutional, and wherein $Ar_2$ and $Ar_3$ represent an allylene group which is substitutional or nonsubstitutional.

A sixth aspect of the present invention according to the fifth aspect provides that the polycarbonate resin comprises a repeating unit expressed by the following general formula (VI):

General formula (VI)

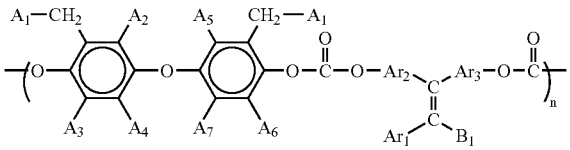

wherein $A_1$,$A_2$,$A_3$,$A_4$,$A_5$,$A_6$ and $A_7$ are defined in the first aspect, wherein $Ar_1$, $Ar_2$, $Ar_3$ and $B_1$ are defined in the fifth aspect, wherein n represents a repeating number which is an integer of 2 to 5000.

A seventh aspect of the present invention according to the first aspect provides that the polycarbonate resin further comprises a constitutional unit expressed by the following general formula (VII):

General formula (VII)

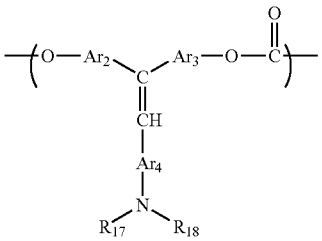

wherein a composition ratio k of the constitutional unit expressed by the general formula (I) and a composition ratio j of the constitutional unit expressed by the general formula (VII) satisfy the following expression: $0<k/(k+j)\leqq 1$, wherein $Ar_2$ and $Ar_3$ represent an allylene group which is substitutional or nonsubstitutional, wherein $Ar_4$ represents an allylene group which is substitutional or nonsubstitutional, wherein $R_{17}$ and $R_{18}$ represent independently one of: an acyl group, an alkyl group which is substitutional or nonsubstitutional, and an aryl group which is substitutional or nonsubstitutional, $R_{17}$ and $R_{18}$ being identical with each other or different from each other.

An eighth aspect of the present invention according to the seventh aspect provides that the polycarbonate resin comprises a repeating unit expressed by the following general formula (VIII):

General formula (VIII)

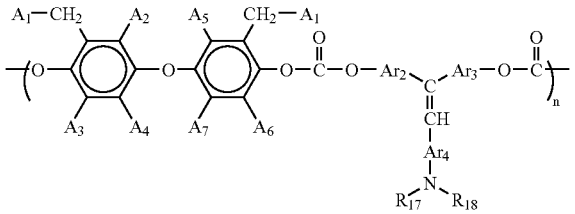

wherein $A_1$,$A_2$,$A_3$,$A_4$,$A_5$,$A_6$ and $A_7$ are defined in the first aspect, wherein $Ar_2$ and $Ar_3$ are defined in the fifth aspect and the seventh aspect, wherein $Ar_4$ is defined in the seventh aspect, wherein $R_{17}$ and $R_{18}$ are defined in the seventh aspect, and wherein n represents a repeating number which is an integer of 2 to 5000.

A ninth aspect of the present invention according to the first aspect provides that the polycarbonate resin further comprises a constitutional unit expressed by the following general formula (IX):

General formula (IX)

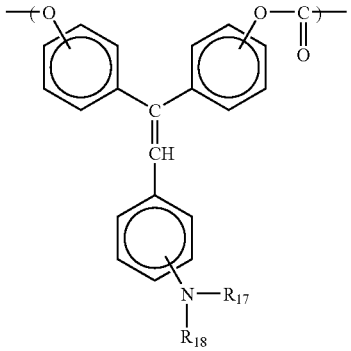

wherein a composition ratio k of the constitutional unit expressed by the general formula (I) and a composition ratio j of the constitutional unit expressed by the general formula (IX) satisfy the following expression: $0<k/(k+j)\leqq 1$, wherein $R_{17}$ and $R_{18}$ represent independently one of: an acyl group, an alkyl group which is substitutional or nonsubstitutional, and an aryl group which is substitutional or nonsubstitutional, $R_{17}$ and $R_{18}$ being identical with each other or different from each other.

A tenth aspect of the present invention according to the ninth aspect provides that the polycarbonate resin further comprises a repeating unit expressed by the following general formula (X):

General formula (X)

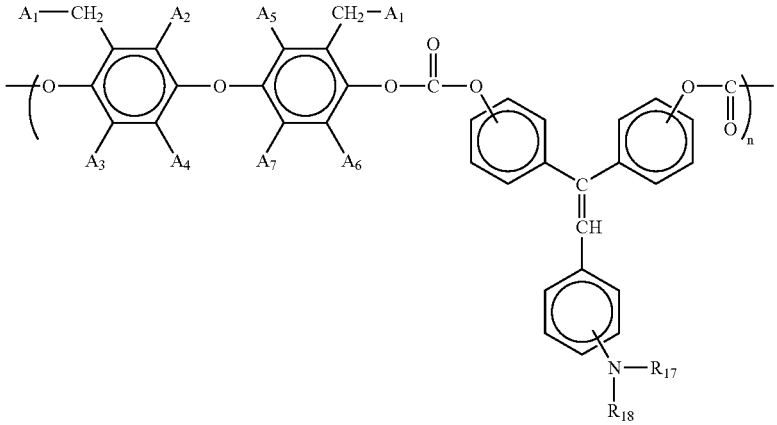

wherein $A_1$,$A_2$,$A_3$,$A_4$,$A_5$,$A_6$ and $A_7$ are defined in the first aspect, wherein $R_{17}$ and $R_{18}$ are defined in the ninth aspect, and wherein n represents a repeating number which is an integer of 2 to 5000.

An eleventh aspect of the present invention according to the first aspect provides that the polycarbonate resin is obtained by polymerizing a bisphenol compound expressed by the following general formula (XI):

General formula (XI)

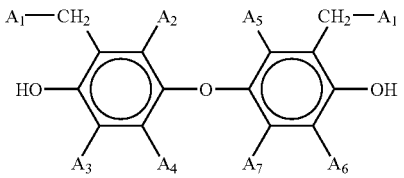

wherein $A_1$ represents an alkyl group which is substitutional or nonsubstitutional, and an aryl group which is substitutional or nonsubstitutional, and wherein $A_2$,$A_3$,$A_4$,$A_5$,$A_6$ and $A_7$ each represent one of a hydrogen atom, a halogen atom, an alkyl group which has 1 to 6 carbon atoms and is substitutional or nonsubstitutional.

A twelfth aspect of the present invention provides an electrophotographic photoconductor, comprising: a conductive substrate; and a photoconductive layer which is formed on the conductive substrate and comprises a polycarbonate resin, wherein the polycarbonate resin comprises a constitutional unit expressed by the following general formula (I):

General formula (I)

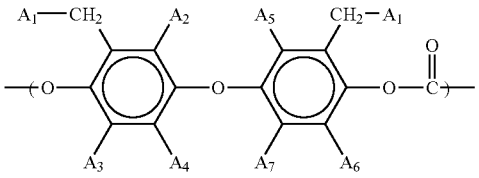

wherein $A_1$ represents an alkyl group which is substitutional or nonsubstitutional, and an aryl group which is substitutional or nonsubstitutional, and wherein $A_2$,$A_3$,$A_4$,$A_5$,$A_6$ and $A_7$ each represent one of a hydrogen atom, a halogen atom, an alkyl group which has 1 to 6 carbon atoms and is substitutional or nonsubstitutional.

A thirteenth aspect of the present invention according to the twelfth aspect provides that the constitutional unit expressed by the general formula (I) is a constitutional unit expressed by the following general formula (II):

General formula (II)

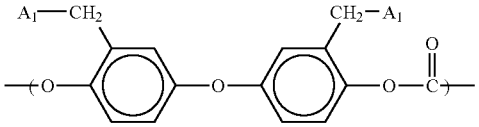

wherein $A_1$ represents an alkyl group which is substitutional or nonsubstitutional, and an aryl group which is substitutional or nonsubstitutional.

A fourteenth aspect of the present invention according to the twelfth aspect provides that the polycarbonate resin having the constitutional unit expressed by the general formula (I) further comprises a constitutional unit expressed by the following general formula (III):

General formula (III)

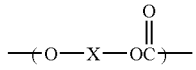

wherein a composition ratio k of the constitutional unit expressed by the general formula (I) and a composition ratio j of the constitutional unit expressed by the general formula (III) satisfy the following expression: $0<k/(k+j)\leqq 1$, wherein X represents one of an aliphatic divalent group, an alicyclic divalent group, an aromatic divalent group, and a divalent group which is made by bonding the divalent groups selected from the aliphatic divalent group, the alicyclic divalent group and the aromatic divalent group, wherein X otherwise represents at least one of the following:

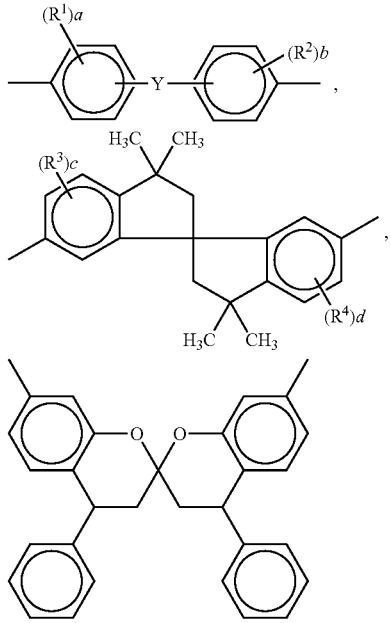

wherein $R^1$, $R^2$, $R^3$ and $R^4$ each represent one of an alkyl group which is substitutional or nonsubstitutional, an aryl group which is substitutional or nonsubstitutional, and a halogen atom, wherein a and b each represent an integer of 0 to 4, wherein c and d each represent an integer of 0 to 3, wherein Y is selected from: a single bond, a straight chain alkylene group having 2 to 12 carbon atoms, a branched alkylene group having 3 to 12 carbon atoms, a polyoxy alkylene group having 3 to 12 carbon atoms, —O—, —S—, —SO—, —$SO_2$, —CO—,

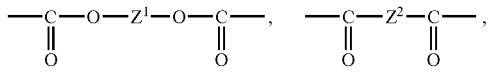

-continued

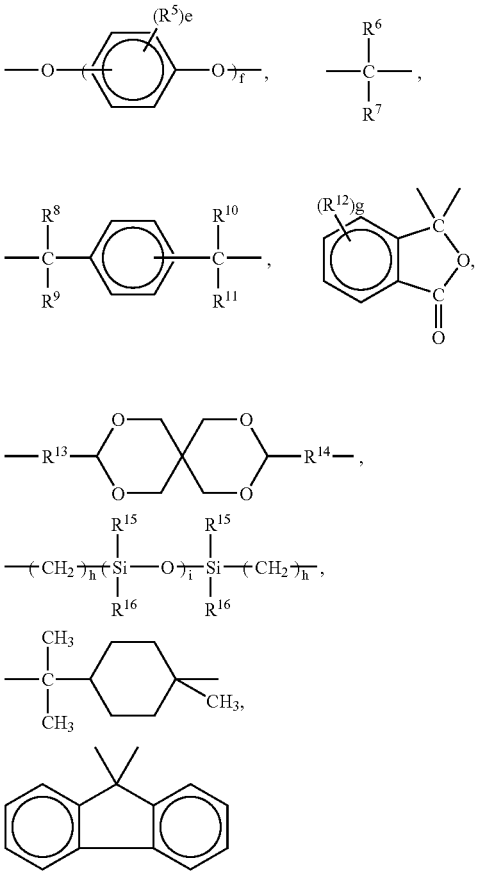

wherein $Z^1$ and $Z^2$ represent one of an aliphatic divalent group which is substitutional or nonsubstitutional, and an allylene group which is substitutional or nonsubstitutional, wherein $R^6$, $R^7$, $R^8$, $R^9$, $R^{10}$, $R^{11}$ and $R^{12}$ each represent one of a hydrogen atom, a halogen atom, an alkyl group which has 1 to 5 carbon atoms and is substitutional or nonsubstitutional, an alkoxy group which has 1 to 5 carbon atoms and is substitutional or nonsubstitutional, and a phenyl group which is substitutional or nonsubstitutional, wherein $R^6$ and $R^7$ may be bonded with each other to form one of a carbon ring having 5 to 12 carbon atoms, and a heterocyclic ring having 5 to 12 carbon atoms, wherein $R^6$ and $R^7$ may form one of a carbon ring and a heterocyclic ring in cooperation with $R_2$ and $R_3$, wherein $R^{13}$ and $R^{14}$ represent one of a single bond, an alkylene group having 1 to 4 carbon atoms, and a polyoxy alkylene group having 1 to 4 carbon atoms, wherein each of $R^{15}$ and $R^{16}$ is one of an alkyl group which has 1 to 5 carbon atoms and is substitutional or nonsubstitutional, and an aryl group which is substitutional or nonsubstitutional, wherein e represents an integer of 0 to 4, wherein f represents an integer of 0 to 20, and wherein g represents an integer of 0 to 4.

A fifteenth aspect of the present invention according to the fourteenth aspect provides that the polycarbonate resin having the constitutional unit expressed by the general formula (I) further comprises a repeating unit expressed by the following general formula (IV):

General formula (IV)

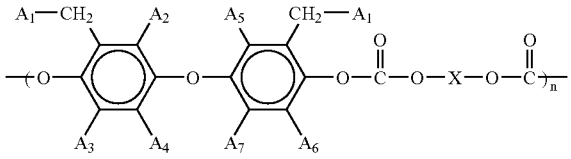

wherein $A_1$,$A_2$,$A_5$,$A_4$,$A_5$,$A_6$ and $A_7$ are defined in the twelfth aspect, wherein X is defined in the fourteenth aspect, and wherein n represents a repeating number which is an integer of 2 to 5000.

A sixteenth aspect of the present invention according to the thirteenth aspect provides that the polycarbonate resin having the constitutional unit expressed by the general formula (I) further comprises a constitutional unit expressed by the following general formula (V):

General formula (V)

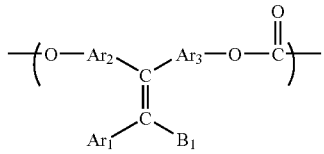

wherein a composition ratio k of the constitutional unit expressed by the general formula (I) and a composition ratio j of the constitutional unit expressed by the general formula (V) satisfy the following expression: $0<k/(k+j)\leqq 1$, wherein $B_1$ represents one of a hydrogen atom, an alkyl group which is substitutional or nonsubstitutional, and an aryl group which is substitutional or nonsubstitutional, wherein $Ar_1$ represents an aryl group which is substitutional or nonsubstitutional, and wherein $Ar_2$ and $Ar_3$ represent an allylene group which is substitutional or nonsubstitutional.

A seventeenth aspect of the present invention according to the sixteenth aspect provides that the polycarbonate resin having the constitutional unit expressed by the general formula (I) further comprises a repeating unit expressed by the following general formula (VI):

General formula (VI)

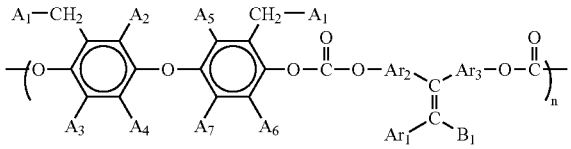

wherein $A_1$,$A_2$,$A_3$,$A_4$,$A_5$,$A_6$ and $A_7$ are defined in the twelfth aspect, wherein $Ar_1$,$Ar_2$,$Ar_3$ and $B_1$ are defined in the sixteenth aspect, and wherein n represents a repeating number which is an integer of 2 to 5000.

An eighteenth aspect of the present invention according to the twelfth aspect provides that the polycarbonate resin having the constitutional unit expressed by the general formula (I) further comprises a constitutional unit expressed by the following general formula (VII):

General formula (VII)

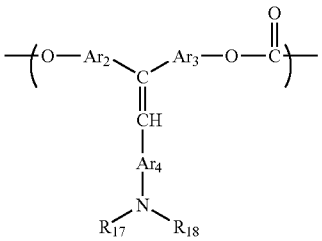

wherein a composition ratio k of the constitutional unit expressed by the general formula (I) and a composition ratio j of the constitutional unit expressed by the general formula (VII) satisfy the following expression: $0<k/(k+j)\leqq 1$, wherein $Ar_2$ and $Ar_3$ represent an allylene group which is substitutional or nonsubstitutional, wherein $Ar_4$ represents an allylene group which is substitutional or nonsubstitutional, wherein $R_{17}$ and $R_{18}$ represent independently one of: an acyl group, an alkyl group which is substitutional or nonsubstitutional, and an aryl group which is substitutional or nonsubstitutional, $R_{17}$ and $R_{18}$ being identical with each other or different from each other.

A nineteenth aspect of the present invention according to the eighteenth aspect provides that the polycarbonate resin having the constitutional unit expressed by the general formula (I) comprises a repeating unit expressed by the following general formula (VIII):

General formula (VIII)

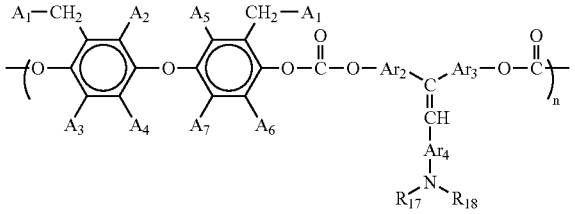

wherein $A_1$,$A_2$,$A_3$,$A_4$,$A_5$,$A_6$ and $A_7$ are defined in the twelfth aspect, wherein $Ar_2$ and $Ar_3$ are defined in the sixteenth aspect and the eighteenth aspect, wherein $Ar_4$ is defined in the eighteenth aspect, wherein $R_{17}$ and $R_{18}$ are defined in the eighteenth aspect, and wherein n represents a repeating number which is an integer of 2 to 5000.

A twentieth aspect of the present invention according to the twelfth aspect provides that the polycarbonate resin having the constitutional unit expressed by the general formula (I) further comprises a constitutional unit expressed by the following general formula (IX):

General formula (IX)

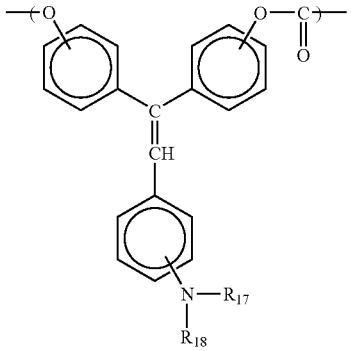

wherein a composition ratio k of the constitutional unit expressed by the general formula (I) and a composition ratio j of the constitutional unit expressed by the general formula (IX) satisfy the following expression: $0<k/(k+j)\leqq 1$, wherein $R_{17}$ and $R_{18}$ represent independently one of: an acyl group, an alkyl group which is substitutional or nonsubstitutional, and an aryl group which is substitutional or nonsubstitutional, $R_{17}$ and $R_{18}$ being identical with each other or different from each other.

A twenty first aspect of the present invention according to the twentieth aspect provides that the polycarbonate resin having the constitutional unit expressed by the general formula (I) further comprises a repeating unit expressed by the following general formula (X):

General formula (X)

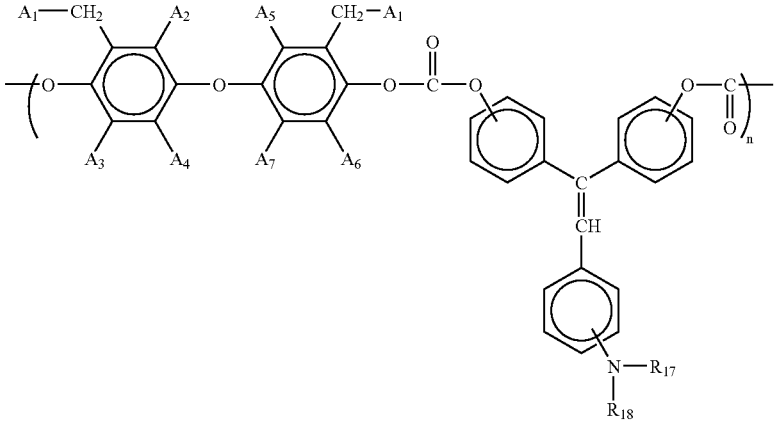

wherein $A_1$,$A_2$,$A_3$,$A_4$,$A_5$,Ar and $A_7$ are defined in the twelfth aspect, wherein $R_{17}$ and $R_{18}$ are defined in the twentieth aspect, and wherein n represents a repeating number which is an integer of 2 to 5000.

A twenty second aspect of the present invention according to the twelfth aspect provides that the electrophotographic photoconductive layer comprises: at least a charge generating layer and a charge transporting layer, and that the charge transporting layer comprises, as an effective component, the polycarbonate resin having the constitutional unit expressed by the general formula (I).

A twenty third aspect of the present invention according to the sixteenth aspect provides that the electrophotographic photoconductive layer comprises: at least a charge generating material and a charge transporting material, and that the polycarbonate resin having the constitutional unit expressed by the general formula (I) is contained as the charge transporting material and as an effective component.

A twenty fourth aspect of the present invention according to the eighteenth aspect provides that the electrophotographic photoconductive layer comprises: at least a charge generating material and a charge transporting material, and that the polycarbonate resin having the constitutional unit expressed by the general formula (I) is contained as the charge transporting material and as an effective component.

A twenty fifth aspect of the present invention according to the twentieth aspect provides that the electrophotographic photoconductive layer comprises: at least a charge generating material and a charge transporting material, and that the polycarbonate resin having the constitutional unit expressed by the general formula (I) is contained as the charge transporting material and as an effective component.

A twenty sixth aspect of the present invention according to the twelfth aspect provides that the electrophotographic photoconductive layer comprises: at least a charge generating material and a charge transporting material, and that a top surface layer of the electrophotographic photoconductor comprises, as an effective component, the polycarbonate resin having the constitutional unit expressed by the general formula (I).

A twenty seventh aspect of the present invention according to the twelfth aspect provides that the photoconductive layer is a single photoconductive layer, and that the single photoconductive layer comprises therein, as an effective component, the polycarbonate resin having the constitutional unit expressed by the general formula (I).

A twenty eighth aspect of the present invention according to the twelfth aspect provides that the photoconductive layer is a single photoconductive layer having a top surface layer of the electrophotographic photoconductor, and that the top surface layer of the electrophotographic photoconductor comprises, as an effective component, the polycarbonate resin having the constitutional unit expressed by the general formula (I).

A twenty ninth aspect of the present invention according to the twelfth aspect provides that the polycarbonate resin having the constitutional unit expressed by the general formula (I) has a polystyrene conversion weight average molecular weight of 7000 to 1000000 through a gel permeation chromatography.

A thirtieth aspect of the present invention provides a dihydroxy diphenyl ether compound expressed by the following general formula (XI):

General formula (XI)

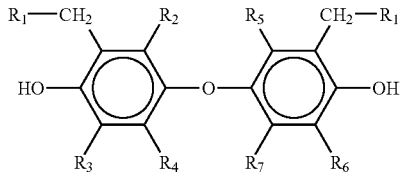

wherein $R_1$ represents an alkyl group which is substitutional or nonsubstitutional, and an aryl group which is substitutional or nonsubstitutional, and wherein $R_2$, $R_3$, $R_4$, $R_5$, $R_6$ and $R_7$ each represent one of a hydrogen atom, a halogen atom, an alkyl group which has 1 to 6 carbon atoms and is substitutional or nonsubstitutional.

A thirty first aspect of the present invention according to the thirtieth aspect provides that the dihydroxy diphenyl ether compound is expressed by the following general formula (XII):

General formula (XII)

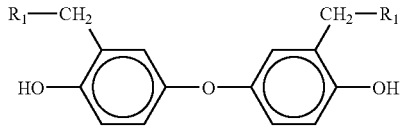

wherein $R_1$ represents an alkyl group which is substitutional or nonsubstitutional, and an aryl group which is substitutional or nonsubstitutional.

A thirty second aspect of the present invention provides a process of manufacturing a dihydroxy diphenyl ether compound, comprising: conducting, under an acid catalyst, a Fries reaction of a diacyloxy diphenyl ether compound expressed by the following general formula (XVIII), to thereby obtain a dihydroxy diacyl compound expressed by the following formula (XIX); and General formula (XVIII)

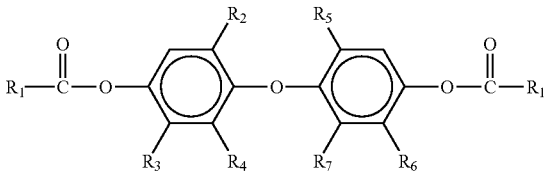

General formula (XIX)

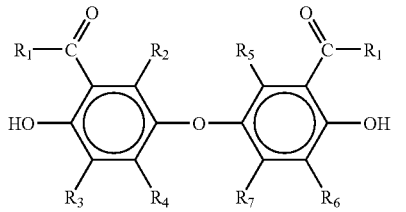

reducing the thus obtained dihydroxy diacyl compound, to thereby obtain the dihydroxy diphenyl ether compound expressed by the following general formula (XI):

General formula (XI)

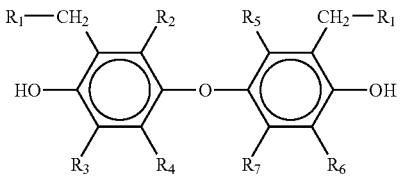

wherein, in the general formula XVIII, the general formula XIX, and the general formula XI: $R_1$ represents an alkyl group which is substitutional or nonsubstitutional, and an aryl group which is substitutional or nonsubstitutional, and $R_2$, $R_3$, $R_4$, $R_5$, $R_6$ and $R_7$ each represent one of a hydrogen atom, a halogen atom, an alkyl group which has 1 to 6 carbon atoms and is substitutional or nonsubstitutional.

A thirty third aspect of the present invention according to the thirty second aspect provides that the dihydroxy diacyl compound expressed by the general formula (XIX) is reduced with a trialkyl silane in a trifluoro acetic acid.

The new aromatic polycarbonate resin under the present invention, as described above, present an effective function as a photoconductive material, and can be increased in its optical sensitivity and chemical sensitivity by means of intensifier such as dye, Lewis acid, and the like. Moreover, the new aromatic polycarbonate resin under the present invention can be preferably used as a charge transporting medium, a charge transporting material, and the like of a photoconductive layer of the electrophotographic photoconductor. Especially, the aromatic polycarbonate resin under the present invention is useful as a charge transporting medium and a charge transporting material on so-called a functional separation type-photoconductive layer having two separate layers (i.e., a charge generating layer separated from a charge transporting layer).

The electrophotographic photoconductor under the present invention contains, in the photoconductive layer, at least a polycarbonate resin as an effective component which has a constitutional unit having a specific diphenyl ether structure expressed by the general formula (I). The aromatic polycarbonate resin having the specific diphenyl ether structure for an organic photoconductor and/or the aromatic polycarbonate resin having charge transportability have high sensitivity and high durability.

The dihydroxy diphenyl ether compound obtained under the present invention is a new compound. The dihydroxy diphenyl ether compound having a substituent in a specific substitutional position in molecule can be used as a raw material monomer of a high polymer material such as polycarbonate, polyester, polyurethane and the like that are new and excellent in wear resistance and heat resistance. A polymer using the above dihydroxy diphenyl ether compound can be applied to extensive industrial fields, including an optical disk substrate, a binder resin for organic photoconductor in electrophotography, and the like. Moreover, with the dihydroxy diphenyl ether compound under the present invention,sa target compound can be selectively and easily manufactured by using dihydroxy diphenyl ether compound (used for starter material), an available acid anhydride, acid chloride and the like, showing an excellent manufacturing process.

DESCRIPTION OF THE PREFERRED EMBODIMENTS

Figure 1:
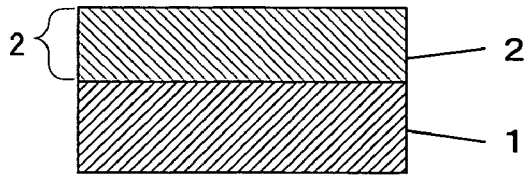
FIG. 1 is a cross sectional view of an example of a layer constitution of an electrophotographic photoconductor under the present invention.

An aromatic polycarbonate resin under the present invention contains at least the following:

i) as a binder resin for organic photoconductor, the constitutional units expressed by the general formula (I) to the general formula (IV), and ii) as a charge transportability high polymer material, the constitutional units expressed by the general formula (V) to the general formula (X).

The above polycarbonate resins have a combination of electrical property, optical property and mechanical property which are required for a photoconductive layer of an electrophotographic photoconductor.

It is known that the polycarbonate resin having 4,4'-dihydroxy diphenyl ether as a raw material is excellent in heat resistance, chemical resistance, and mechanical property. The above resin is, however, not good at solubility in solvent, and therefore may find it difficult to make a high polymer compound by an interfacial polymerization (like the one in the manufacture example). Even a polycarbonate resin having an improved 4,4'-dihydroxy-3,3'-dimethyl diphenyl ether still had a problem in solubility, although some improvements were shown. Therefore, the polycarbonate resin having the above conventional diphenyl ether as the raw material is to be used principally as copolymer species, showing excellent heat resistance, chemical resistance and mechanical property. Using, as an electrophotographic photoconductor, the polycarbonate resin of the constitutional units having the conventional diphenyl ether structure deteriorates photoreceptivity, thus causing cracks and the like. The polycarbonate resin having, as an effective component, the diphenyl ether structure of a specific structure expressed by the general formula (I) under the present invention can solve the above problem, i.e., improving electrophotographic property and preventing the cracks, and has properties of the conventional polycarbonate resin including heat resistance, chemical resistance and mechanical property. In other words, the conventional polycarbonate resin has a strong interaction (crystal property) between diphenyl ether skeletons, thereby worsening solubility. Moreover, the conventional polycarbonate resin has a large inner strain at a process of making photoconductor, which strain cannot be relieved due to high crystal property. Summarizing the above, the conventional polycarbonate resin deteriorates electrophotographic property and causes cracks. Contrary to the above, the polycarbonate resin expressed by the general formula (I) and having, as the effective component, the diphenyl ether structure of a specific structure under the present invention seems to have solved the above problem, by obtaining (controlling) more flexibility than the polycarbonate resin having the conventional diphenyl ether structure.

Described below is a process of manufacturing the aromatic polycarbonate resin under the present invention.

The polycarbonate resin under the present invention can be manufactured substantially the same process as that of the conventional technology having polymerization of bisphenol with carbonic acid derivative. Specifically, the aromatic polycarbonate resin under the present invention uses at least one bisphenol compound expressed by the following general formula (XI) or general formula (XII):

General formula (XI)

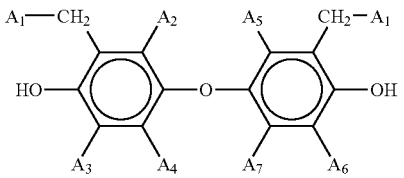

($A_1$ to $A_7$ are defined as above.)

General formula (XII)

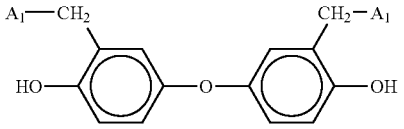

($A_1$ is defined as above.)

The aromatic polycarbonate resin under the present invention can be manufactured by i) a transesterification with bisaryl carbonate, ii) a solution polymerization or an interfacial polymerization with carbonyl compound halide such as phosgene, iii) a process of using chloroformate such as bischloroformate and the like derived from diol, and the like. As the carbonyl compound halide, trichloromethyl chloroformate (which is a dimer of phosgene) and bis(trichloromethyl)carbonate (which is a trimer of phosgene) may replace the phosgene. Other useful examples include carbonyl compound halide derived from halogen other than chlorine, specifically, the other useful examples including carbonyl bromide, carbonyl iodide, carbonyl fluoride. The above known manufacturing processes are described for example in the Polycarbonate Resin Handbook (edited by Seiichi Honma, published by THE NIKKAN KOGYO SHIMBUN, LTD.) and the like.

A combination of i) one or more bisphenol compounds expressed by the general formula (XI) or the general formula (XII), and ii) a dioxy compound expressed by the following general formula (XIII) can bring about a copolymer with its mechanical property and the like improved.

HO—X—OH General formula (XIII)

In this case, the dioxy compound expressed by the general formula (XIII) can be used alone or in combination of two or more. The ratio of the bisphenol compound expressed by the general formula (XI) or the general formula (XII) to the dioxy compound expressed by the general formula (XIII) can be selected from an extensive range depending on a required property. Moreover, selecting a proper polymerization can bring about, among copolymers, a random copolymer, an alternate copolymer, a block copolymer, a random alternate copolymer, a random block copolymer, and the like. For example, mixing uniformly from an initial step the bisphenol compound expressed by the general formula (XI) or the general formula (XII) with the dioxy compound expressed by the general formula (XIII) for condensation with the phosgene can bring about a random copolymer having a constitutional unit expressed by the general formula (I) or the general formula (II) and a constitutional unit expressed by the general formula (III). Moreover, adding various kinds of dioxy compounds from a point in time during the reaction can bring about a random block copolymer. Moreover, condensing the bischloroformate derived from the dioxy compound expressed by the general formula (XIII) with the bisphenol compound expressed by the general formula (XI) or the general formula (XII) can bring about an alternate copolymer which is made of a repeating unit expressed by the general formula (IV). On the contrary, condensing the bischloroformate derived from the bisphenol compound expressed by the general formula (XI) or the general formula (XII) with the dioxy compound expressed by the general formula (XIII) can, likewise, bring about an alternate copolymer which is made of a repeating unit expressed by the general formula (IV). Moreover, using a plurality of the bischloroformates and a plurality of the diols in the condensation thereof can bring about a random alternate copolymer.

Likewise, a combination of i) one or more of the bisphenol compounds expressed by the general formula (XI) or the general formula (XII), and ii) a diol compound which is expressed by the following general formula (XIV), general formula (XV), and general formula (XVI) and has a charge transportability can bring about a copolymer with its mechanical property and the like improved.

General formula (XIV)

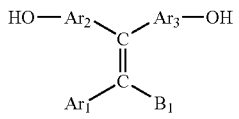

-continued

General formula (XV)

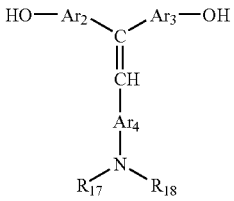

General formula (XVI)

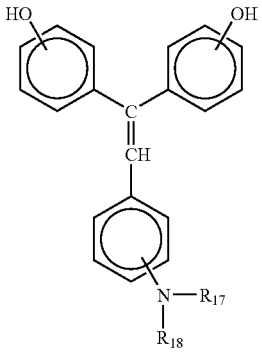

In this case, the diol compound expressed by the general formula (XIV), the general formula (XV), and the general formula (XVI) can be used alone or in combination of two or more. The ratio of the bisphenol compound expressed by the general formula (XI) or the general formula (XII) to the diol compound expressed by the general formula (XIV), the general formula (XV) and the general formula (XVI) can be selected from an extensive range depending on a required property. Moreover, selecting a proper polymerizing operation can bring about, among copolymers, a random copolymer, an alternate copolymer, a block copolymer, a random alternate copolymer, a random block copolymer, and the like. For example, mixing uniformly from an initial step the bisphenol compound expressed by the general formula (XI) or the general formula (XII) with the diol compound expressed by the general formula (XIV), the general formula (XV) and the general formula (XVI) for condensation with the phosgene can bring about a random copolymer having a constitutional unit expressed by the general formula (I) or the general formula (II) and a constitutional unit expressed by the general formula (V), the general formula (VII) or the general formula (IX). Moreover, adding various kinds of dioxy compounds from a point in time during the reaction can bring about a random block copolymer. Moreover, condensing the bischloroformate derived from the diol compound expressed by the general formula (XIV), the general formula (XV) or the general formula (XVI) with the bisphenol compound expressed by the general formula (XI) or the general formula (XII) can bring about an alternate copolymer which is made of a repeating unit expressed by the general formula (VI), the general formula (VIII) or the general formula (X). On the contrary, condensing the bischloroformate derived from the bisphenol compound expressed by the general formula (XI) or the general formula (XII) with the diol compound expressed by the general formula (XIV), the general formula (XV) or the general formula (XVI) can, likewise, bring about an alternate copolymer which is made of a repeating unit expressed by the general formula (VI), the general formula (VIII) or the general formula (X). Moreover, using a plurality of the bischloroformates and a plurality of the diols in the condensation can bring about a random alternate copolymer.

In the interfacial polymerization, the bisphenol compound or the diol compound is substantially insoluble in alkali solution and water, and the reaction is to be carried out in the presence of carbonic acid derivative and catalyst between two phases (namely, the organic solvent and the alkali solution) dissolving the polycarbonate. In this case, an emulsification of the reaction medium by high-speed stirring and adding emulsification material can bring about in a short time a polycarbonate having a narrow molecular weight distribution. A base for the alkali solution is alkali metal or alkali earth metal, examples thereof including hydrides such as sodium hydroxide, potassium hydroxide, calcium hydroxide, and the like; carbonates such as sodium carbonate, potassium carbonate, calcium carbonate, sodium bicarbonate, and the like; and the like. The above bases are used alone or in combination of two or more. Preferable bases are sodium hydroxide or potassium hydroxide. Water used is preferably distilled water or ion exchange water. Examples of the organic solvent include aliphatic hydrocarbon halide such as dichloromethane, 1,2-dichloroethane, 1,2-dichloroethylene, trichloroethane, tetrachloroethane, dichloropropane, and the like; aromatic hydrocarbon halide such as chlorobenzene, dichlorobenzene, and the like; and a mixture of each. An organic solvent is allowed which is a mixture of the above with an aromatic hydrocarbon such as toluene, xylene, ethyl benzene, and the like; and with an aliphatic hydrocarbon such as hexane, cyclohexane, and the like. The organic solvent is preferably the aliphatic hydrocarbon halide and the aromatic hydrocarbon halide, and more preferably the dichloromethane or the chlorobenzene.

Examples of the polycarbonate generating catalyst used for manufacturing the polycarbonate include tertiary amine, quaternary ammonium salt, tertiary phosphine, quaternary phosphonium salt, nitrogen-contained heterocyclic compound and salt thereof, imino ether and salt thereof, compounds having amide group, and the like. Specific examples of the polycarbonate generating catalyst include trimethyl amine, triethyl amine, tri-n-propyl amine, tri-n-hexyl amine, N,N,N',N'-tetramethyl-1,4-tetramethylene diamine, 4-pyrrolidino pyridine, N,N'-dimethyl piperazine, N-ethyl piperazine, benzil trimethyl ammonium chloride, benzil triethyl ammonium chloride, tetramethyl ammonium chloride, tetraethyl ammonium bromide, phenyl triethyl ammonium chloride, triethyl phosphine, triphenyl phosphine, diphenyl butyl phosphine, tetra(hydroxy methyl) phosphonium chloride, benzil triethyl phosphonium chloride, benzil triphenyl phosphonium chloride, 4-methyl pyridine, 1-methyl imidazole, 1,2-dimethyl imidazole, 3-methyl pyridazine, 4,6-dimethyl pyrimidine, 1-cyclohexyl-3,5-dimethyl pyrazole, 2,3,5,6-tetramethyl pyrazine, and the like. The above polycarbonate generating catalysts can be used alone or in combination of two or more. The polycarbonate generating catalyst is preferably the tertiary amine, more preferably the tertiary amine having 3 to 30 carbons in total, and especially preferably the triethyl amine.

The above polycarbonate generating catalysts can be added before or after adding to a reaction system the carbonic acid derivative such as the phosgene and bischloroformate.

For all polymerizing operations, it is preferable to use a terminal stopper as a molecular weight regulator. The polycarbonate resin under the present invention may have its terminal to be bonded with a substituent based on the terminal stopper. Examples of the terminal stopper to be used include monovalent aromatic hydroxy compound, haloformate derivative of monovalent aromatic hydroxy compound, monovalent carboxylic acid, halide derivative of monovalent carboxylic acid, and the like. Specific examples of the monovalent aromatic hydroxy compound include phenols such as phenol, p-cresol, o-ethyl phenol, p-ethyl phenol, p-isopropyl phenol, p-tert-butyl phenol, p-cumyl phenol, p-cyclohexyl phenol, p-octyl phenol, p-nonyl phenol, 2,4-xylenol, p-methoxy phenol, p-hexyl oxy phenol, p-decyl oxy phenol, o-chloro phenol, m-chloro phenol, p-chloro phenol, p-bromo phenol, penta bromo phenol, penta chloro phenol, p-phenyl phenol, p-isopropenyl phenol, 2,4-bis(1-methyl-1-phenyl ethyl)phenol, β-naphthol, α-naphthol, p-(2,4,4-trimethyl chromanyl)phenol, 2-(4-methoxy phenyl)-2-(4-hydroxy phenyl)propane, alkaline metal salts thereof, alkaline earth metal salts thereof, and the like. The haloformate derivative of monovalent aromatic hydroxy compound are those described above and the like.

Examples of the monovalent carboxylic acid include fatty acids such as acetic acid, propionic acid, butyric acid, valerianic acid, caproic acid, heptanoic acid, capric acid, 2,2-dimethyl propionic acid, 3-methyl butyric acid, 3,3-dimethyl butyric acid, 4-methyl valerianic acid, 3,3-dimethyl valerianic acid, 4-methyl caproic acid, 3,5-dimethyl caproic acid, phenoxy butyric acid, alkaline metal salts thereof, and alkaline earth metal salts thereof; and p-chloro benzoic acids such as benzoic acid, p-methyl benzoic acid, p-tert-butyl benzoic acid, p-butoxy benzoic acid, p-octyloxy benzoic acid, p-phenyl benzoic acid, p-benzil benzoic acid, p-chloro benzoic acid, alkaline metal salts thereof, and alkaline earth metal salts thereof Examples of the halide derivative of monovalent carboxylic acid include the above halide derivative of monovalent carboxylic acid and the like. These terminal stoppers can be used alone or in combination of two or more. The terminal stopper is preferably monovalent aromatic hydroxy compound, and more preferably phenol, p-tert-butyl phenol and p-cumyl phenol. The polycarbonate resin under the present invention preferably has its molecular weight of 1000 to 500000 and more preferably 10000 to 200000 which is a polystyrene conversion number average molecular weight.

For improving the mechanical property, a small amount of branching agent can be added in the polymerizing operation. Examples of the branching agents to be used include three or more reaction groups (homogenous or heterogeneous) selected from the group consisting of aromatic hydroxyl group, haloformate group, carboxylic acid group, carboxylic halide group, active halogen atom, and the like. Specific examples of the branching agents include phloroglucinol, 4,6-dimethyl-2,4,6-tris(4-hydroxy phenyl)-2-heptane, 4,6-dimethyl-2,4,6-tris(4-hydroxy phenol)heptane, 1,3,5-tris(4-hydroxy phenyl) benzene, 1,1,1-tris(4-hydroxy phenyl)ethane, 1,1,2-tris(4-hydroxy phenyl)propane, α,α,α'-tris(4-hydroxy phenyl)-1-ethyl-4-isopropyl benzene, 2,4-bis[α-methyl-α-(4-hydroxy phenyl) ethyl]phenol, 2-(4-hydroxy phenyl)-2-(2,4-dihydroxy phenyl)propane, tris(4-hydroxy phenyl)phosphine, 1,1,4,4-tetrakis(4-hydroxy phenyl)cyclohexane, 2,2-bis[4,4-bis(4-hydroxy phenyl) cyclohexyl]propane, α,α,α,α'-tetrakis(4-hydroxy phenyl)-1,4-diethyl benzene, 2,2,5,5-tetrakis(4-hydroxy phenyl)hexane, 1,1,2,3-tetrakis(4-hydroxy phenyl)propane, 1,4-bis(4,4-dihydroxy triphenyl methyl) benzene, 3,3',5,5'-tetrahydroxy diphenyl ether, 3,5-dihydroxy benzoic acid, 3,5-bis(chloro carbonyl oxy)benzoic acid, 4-hydroxy isophthalic acid, 4-chloro carbonyl oxy isophthalic acid, 5-hydroxy phthalic acid, 5-chloro carbonyl oxy phthalic acid, trimesic acid trichloride, cyanuric acid chloride, and the like. The above branching agents can be used alone or in combination of two or more.

For preventing oxidation of the diol in alkali solution, an oxidation inhibitor such as hydrosulfite and the like can be used.

Preferably, a reaction temperature is ordinarily 0° C. to 40° C., a reaction time is several minutes to 5 hours, and pH in the reaction is ordinarily 10 or more.

On the other hand, in terms of solution polymerization, the polycarbonate resin can be obtained by the following steps: dissolve bisphenol compound or dioxy compound in a solution, add deoxidizer, and add bischloroformate, phosgene, or phosgene polymer. Examples of the deoxidizer used include tertiary amines such as trimethyl amine, triethyl amine, tripropyl amine; and pyridine. Examples of solvent used for the reaction include: hydrogenated hydrocarbons such as dichloro methane, dichloro ethane, trichloro ethane, tetrachloro ethane, trichloro ethylene, chloroform, and the like; solvents of cyclic ethers such as tetrahydro furan and dioxane; and pyridine. The molecular weight regulator or the branching agents like those used for the interfacial polymerization can be used. The reaction temperature is ordinarily 0° C. to 40° C., and the reaction time is several minutes to 5 hours.

Moreover, the polycarbonate resin can be manufactured by the transesterification. In this case, dioxy compound is mixed with bisaryl carbonate in the presence of an inactive gas, then, the mixture is reacted ordinarily at 120° C. to 350° C. under a reduced pressure. The degree of reducing the pressure is to be varied stepwise, and the phenols generated are to be distilled in the end by reducing the pressure to 1 mmHg or less. The reaction time is ordinarily 1 hour to 4 hours. When necessary, the molecular weight regulator or the oxidation inhibitor may be added. Examples of the bisaryl carbonate include diphenyl carbonate, di-p-tolyl carbonate, phenyl-p-tolyl carbonate, di-p-chloro phenyl carbonate, dinaphthyl carbonate, and the like.

The polycarbonate resin thus obtained may be used after removing impurities such as the catalysts and the oxidation inhibitor which are used during the polymerizing operation, the diol or the terminal stopper which are not reacted, and the inorganic salt and the like generated during the polymerizing operation. For refining the above, any known processes like the one disclosed in the above described Polycarbonate Resin Handbook (edited by Seiichi Honma, published by THE NIKKAN KOGYO SHIMBUN, LTD.) and the like may be used. When necessary, the aromatic polycarbonate resin manufactured by the above process may be added by additives such as oxidation inhibitor, light stabilizer, heat stabilizer, lubricant, plasticizer, and the like.

Described below are more details about the general formula (I) which is the main constitutional unit under the present invention.

In the above general formula (I), $A_1$ represents an alkyl group (substitutional or nonsubstitutional), $A_2$ to $A_7$ are dependent of each other, and represent a hydrogen atom, a halogen atom, and an alkyl group (substitutional or nonsubstitutional) having 1 to 6 carbon atoms.

Examples of the substituent used for $A_1$, specifically, examples of alkyl group (substitutional or nonsubstitutional) include: a straight chain alkyl group, a branched alkyl group, and a cyclic alkyl group each having 1 to 18 carbon atoms. The above alkyl groups may further contain fluorine atom, cyano group, alkoxy group having 1 to 18 carbon atoms, phenyl group having 1 to 18 carbon atoms, halogen atom having 1 to 18 carbon atoms, and phenyl group substituted with alkyl group (straight chain alkyl group, branched alkyl group, and cyclic alkyl group each having 1 to 6 carbon atoms). Specific examples include methyl group, ethyl group, n-propyl group, i-propyl group, n-butyl group, i-butyl group, s-butyl group, t-butyl group, n-hexyl group, n-octyl group, n-decyl group, n-dodecyl group, n-octadecyl group, trifluoro methyl group, 2-cyanoethyl group, methoxy methyl group, methoxy ethyl group, benzil group, 4-chlorobenzil group, cyclopentyl group, cyclohexyl group, and the like. Examples of aryl groups (substitutional or nonsubstitutional) include phenyl group, naphthyl group, and the like. The above aryl groups may be further substituted with alkyl group (straight chain alkyl group, branched alkyl group, and cyclic alkyl group each having 1 to 18 carbon atoms), fluorine atom, cyano group, alkoxy group having 1 to 18 carbon atoms. Specific examples include phenyl group, naphthyl group, 4-methylphenyl group, 3-methylphenyl group, 4-butylphenyl group, 4-hexylphenyl group, 4-octylphenyl group, 4-fluorophenyl group, 4-cyanophenyl group, 4-trifluoro methylphenyl group, and the like.

Substituents used for $A_2$ to $A_7$ include halogen atoms such as fluorine atom, chlorine atom, bromine atom, iodine atom, and the like. Examples of the alkyl groups (substitutional or nonsubstitutional) having 1 to 6 carbon atoms include straight chain alkyl group, branched alkyl group, and cyclic alkyl group each having 1 to 6 carbon atoms. The above alkyl groups may further contain fluorine atom, cyano group, alkoxy group having 1 to 6 carbon atoms, phenyl group having 1 to 6 carbon atoms, halogen atom having 1 to 6 carbon atoms, and phenyl group substituted with alkyl group (straight chain alkyl group, branched alkyl group, and cyclic alkyl group each having 1 to 6 carbon atoms). Specific examples include methyl group, ethyl group, n-propyl group, i-propyl group, n-butyl group, i-butyl group, s-butyl group, t-butyl group, trifluoro methyl group, 2-cyanoethyl group, methoxy methyl group, methoxy ethyl group, benzil group, 4-chlorobenzil group, cyclopentyl group, cyclohexyl group, and the like.

In terms of the general formula (I) which is the main constitutional unit under the present invention, the bisphenol compound which is the raw material of the general formula (I) and is expressed by the general formula (XI) is to be described in detail afterward.

For the general formula (III) which is another main constitutional unit under the present invention, a constitutional unit of a conventional known polycarbonate resin can be used as it is. For example, the fundamental unit described in the Polycarbonate Resin Handbook (edited by Seiichi Honma, published by THE NIKKAN KOGYO SHIMBUN, LTD.) and the like may be used. Of the above conventional known units, described in detail below is about the general formula (XIII) which is a raw material of the general formula (II).

When X of the general formula (XIII) is an aliphatic divalent group and a alicyclic divalent group, the examples include: ethylene glycol, diethylene glycol, triethylene glycol, polyethylene glycol, polytetramethylene ether glycol, 1,3-propanediol, 1,4-butanediol, 1,5 pentanediol, 3-methyl-1,5-pentanediol, 1,6-hexanediol, 1,5-hexanediol, 1,7-pentanediol, 1,8-octanediol, 1,9-nonanediol, 1,10-decanediol, 1,11-undecanediol, 1,12-dodecanediol, neopentyl glycol, 2-ethyl-1,6-hexanediol, 2-methyl-1,3-propanediol, 2-ethyl-1,3-propanediol, 2,2-dimethyl-1,3-propanediol, 1,3-cyclohexanediol, 1,4-cyclohexanediol, cyclohexane-1,4-dimethanol, 2,2-bis(4-hydroxy cyclohexyl)propane, xylylenediol, 1,4-bis(2-hydroxy ethyl)benzene, 1,4-bis(3-hydroxy propyl) benzene, 1,4-bis(4-hydroxy butyl)benzene, 1,4-bis(5-hydroxy pentyl)benzene, 1,4-bis(6-hydroxy hexyl)benzene, and the like.

When X of the general formula (XIII) is an aromatic divalent group, the examples of preferable dioxy compounds include: bis(4-hydroxy phenyl)methane, bis(2-methyl-4-hydroxy phenyl)methane, bis(3-methyl-4-hydroxy phenyl) methane, 1,1-bis(4-hydroxy phenyl)ethane, 1,2-bis(4-hydroxy phenyl)ethane, bis(4-hydroxy phenyl)phenyl methane, bis(4-hydroxy phenyl)diphenyl methane, 1,1-bis (4-hydroxy phenyl)-1-phenyl ethane, 1,3-bis(4-hydroxy phenyl)-1,1-dimethyl propane, 2,2-bis(4-hydroxy phenyl) propane, 2-(4-hydroxy phenyl)-2-(3-hydroxy phenyl)propane, 1,1-bis(4-hydroxy phenyl)-2-methyl propane, 2,2-bis (4-hydroxy phenyl)butane, 1,1-bis(4-hydroxy phenyl)-3-methyl butane, 2,2-bis(4-hydroxy phenyl)pentane, 2,2-bis (4-hydroxy phenyl)-4-methyl pentane, 2,2-bis(4-hydroxy phenyl)hexane, 4,4-bis(4-hydroxy phenyl)heptane, 2,2-bis (4-hydroxy phenyl)nonane, bis(3,5-dimethyl-4-hydroxy phenyl)methane, 2,2-bis(3-methyl-4-hydroxy phenyl)propane, 2,2-bis(3-isopropyl-4-hydroxy phenyl)propane, 2,2-bis(3-sec-butyl-4-hydroxy phenyl)propane, 2,2-bis(3-tert-butyl-4-hydroxy phenyl)propane, 2,2-bis(3-cyclohexyl-4-hydroxy phenyl)propane, 2,2-bis(3-allyl-4-hydroxy phenyl) propane, 2,2-bis(3-phenyl-4-hydroxy phenyl)propane, 2,2-bis(3,5-dimethyl-4-hydroxy phenyl)propane, 2,2-bis(3-chloro-4-hydroxy phenyl)propane, 2,2-bis(3,5-dichloro-4-hydroxy phenyl)propane, 2,2-bis(3-bromo-4-hydroxy phenyl)propane, 2,2-bis(3,5-dibromo-4-hydroxy phenyl) propane, 2,2-bis(4-hydroxy phenyl)hexafluoro propane, 1,1-bis(4-hydroxy phenyl)cyclopentane, 1,1-bis(4-hydroxy phenyl)cyclohexane, 1,1-bis(3-methyl-4-hydroxy phenyl) cyclohexane, 1,1-bis(3,5-dimethyl-4-hydroxy phenyl) cyclohexane, 1,1-bis(3,5-dichloro-4-hydroxy phenyl) cyclopentane, 1,1-bis(4-hydroxy phenyl)-3,3,5-trimethyl cyclopentane, 1,1-bis(4-hydroxy phenyl)cycloheptane, 2,2-bis(4-hydroxy phenyl)norbornane, 2,2-bis(4-hydroxy phenyl)adamantane, 4,4'-dihydroxy phenyl ether, 4,4'-dihydroxy-3,3'-dimethyl diphenyl ether, ethylene glycol bis(4-hydroxy phenyl)ether, 4,4'-dihydroxy diphenyl sulfide, 3,3'-dimethyl-4,4'-dihydroxy diphenyl sulfide, 3,3'5,5'-tetramethyl-4,4'-dihydroxy diphenyl sulfide, 4,4'-dihydroxy diphenyl sulfoxide, 3,3'-dimethyl-4,4'-dihydroxy diphenyl sulfoxide, 4,4'-dihydroxy diphenyl sulfone, 3,3'-dimethyl-4,4'-dihydroxy diphenyl sulfone, 3,3'-diphenyl-4,4'-dihydroxy diphenyl sulfone, 3,3'-dichloro-4,4'-dihydroxy diphenyl sulfone, bis(4-hydroxy phenyl)ketone, bis(3-methyl-4-hydroxy phenyl)ketone, 3,3,3',3'-tetramethyl-6,6'-dihydroxy spiro (bis)indane, 3,3',4,4'-tetrahydro-4,4,4',4'-tetramethyl-2,2'-spirobi(2H-1-benzopyran)-7,7'-dio 1, trans-2,3-bis(4-hydroxy phenyl)-2-butane, 9,9-bis(4-hydroxy phenyl)fluorene, 9,9-bis(4-hydroxy phenyl)xanthene, 1,6-bis(4-hydroxy phenyl)-1,6-hexanedione, α,α,α',α'-tetramethyl-α,α'-bis(4-hydroxy phenyl)-p-xylene, α,α,α',α'-tetramethyl-α,α'-bis(4-hydroxy phenyl)-m-xylene, 2,6-dihydroxy benzo-p-dioxin, 2,6-dihydorxy thianthrene, 2,7-dihydroxy phenoxathiin, 9,10-dimethyl-2,7-dihydroxy phenazine, 3,6-dihydroxy benzofuran, 3,6-dihydroxy benzothiophene, 4,4'-dihydroxy biphenyl, 1,4-dihydroxy naphthalene, 2,7-dihydroxy pyrene, hydroquinone, resorcin, ethylene glycol-bis(4-hydroxy benzoate), diethylene glycol-bis(4-hydroxy benzoate), triethylene glycol-bis(4-hydroxy benzoate), 1,3-bis(4-hydroxy phenyl)-tetramethyl disiloxane, phenol-modified silicone oil, and the like. Moreover, an aromatic diol compound containing an ester bond which is manufactured by 2 mol of reacting diol with 1 mol of isophthaloyl chloride or with 1 mol of terephthaloyl chloride.

Hereinafter described (like the description in JP-A No. 9-272735) in detail is about the constitutional unit expressed by the general formula (V) which is a main constitutional unit of the aromatic polycarbonate resin under the present invention.

Under the present invention, the term "aryl" represents a group containing heterocyclic ring group. In the above general formula (V), $B_1$ represents hydrogen atom, alkyl group (substitutional or nonsubstitutional), or aryl group (substitutional or nonsubstitutional). As the alkyl group (substitutional or nonsubstitutional) of $B_1$, the following can be named. Alkyl group of straight chain having 1 to 5 carbon atoms or branched chain having 1 to 5 carbon atoms. The above alkyl groups may further contain fluorine atom, cyano group, phenyl group, halogen atom, and phenyl group substituted with alkyl group (straight chain alkyl group and branched alkyl group each having 1 to 5 carbon atoms). Specific examples include methyl group, ethyl group, n-propyl group, i-propyl group, n-butyl group, i-butyl group, s-butyl group, n-butyl group, i-butyl group, trifluoro methyl group, 2-cyano ethyl group, benzil group, 4-chloro benzil group, 4-methyl benzil group, and the like.

Examples of the aryl group of $B_1$ (substitutional or nonsubstitutional) include phenyl group, naphthyl group, biphenylyl group, terphenylyl, pyrenyl group, fluorenyl group, 9,9-dimethyl-2-fluorenyl group, azulenyl group, anthryl group, triphenylenyl group, chrysenyl group, fluorenylidene phenyl group, 5H-dibenzo[a, d]cycloheptenylidene phenyl group, thienyl group, benzothienyl group, firil group, benzo furanyl group, carbazolyl group, pyridinyl group, pyrrolidyl group, oxazolyl group, and the like. The above can have, as a substituent; the alkyl group (substitutional or nonsubstitutional) described above; the alkoxy group having the alkyl group (substitutional or nonsubstitutional) described above; halogen atoms such as fluorine atom, chlorine atom, bromine atom, iodine atom, and the like; and the amino group expressed by the following general formula.

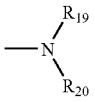

($R_{19}$ and $R_{20}$ represent an alkyl group (substitutional or nonsubstitutional) defined by B1, or an aryl group (substitutional or nonsubstitutional) defined by B1. Otherwise, $R_{19}$ and $R_{20}$ can in combination form a ring. Otherwise, in combination with the carbon atom on the aryl group, $R_{19}$ and $R_{20}$ can form a ring. Specific examples thereof include piperidino group, morpholino group, julolidyl group, and the like.)

In the above general formula (V), $Ar_1$ represents an aryl group (substitutional or nonsubstitutional). Examples of $Ar_1$ as the aryl group (substitutional or nonsubstitutional) include those expressed by the following general formula (XX). Moreover, the examples include monovalent groups derived from heterocyclic ring group having amine structure such as pyrrole, pyrazole, imidazole, triazole, dioxazole, indole, isoindole, benzimidazole, benzotriazole, benzoisoxazine, carbazole, phenoxazine, and the like. As a substituent, these can have the alkyl group (substitutional or nonsubstitutional) defined by $R_1$ and the aryl group (substitutional or nonsubstitutional) defined by $R_1$, moreover, these can have fluorine atom, chlorine atom, bromine atom, and iodine atom.

General formula (XX)

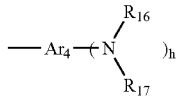

($R_{17}$ and $R_{18}$ represent acyl group, alkyl group (substitutional or nonsubstitutional), and aryl group (substitutional or nonsubstitutional). $Ar_4$ represents allylene group. "h" represents an integer of 1 to 3.

In the above general formula (XX), examples of the acyl group of $R_{17}$ and $R_{18}$ include acetyl group, propionyl group, benzoyl group, and the like. Examples of the alkyl groups (substitutional or nonsubstitutional) of $R_{17}$ and $R_{18}$ are like the alkyl groups (substitutional or nonsubstitutional) defined by $B_1$. Examples of the aryl group (substitutional or nonsubstitutional) of $R_{17}$ and $R_{18}$ include aryl group (substitutional or nonsubstitutional) defined by $B_1$ and, in addition, the groups defined by the following general formula (XXI).

General formula (XXI)

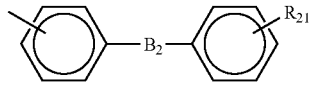

($B_2$ is selected from —O—, —S—, —SO—, —$SO_2$—, —CO—, and the following divalent groups.)

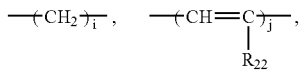

($R_{21}$ represents hydrogen atom, alkyl group (substitutional or nonsubstitutional) defined by $B_1$, alkoxy group, halogen atom, aryl group (substitutional or nonsubstitutional) defined by $B_1$, amino group, nitro group, and cyano group. $R_{22}$ represents hydrogen atom, alkyl group (substitutional or nonsubstitutional) defined by $B_1$, and aryl group (substitutional or nonsubstitutional) defined by $B_1$. "i" represents an integer of 1 to 12. "j" represents an integer of 1 to 3.)

Specific examples of the alkoxy group of $R_{21}$ include methoxy group, ethoxy group, n-propoxy group, i-propoxy group, n-butoxy group, i-butoxy group, s-butoxy group, t-butoxy group, 2-hydroxy ethoxy group, 2-cyano ethoxy group, benzil oxy group, 4-methyl benzil oxy group, trifluoro methoxy group, and the like. Examples of the halogen atoms of $R_{21}$ include fluorine atom, chlorine atom, bromine atom, iodine atom, and the like. The amino group of $R_{21}$ represents the amino group defined as the substituent of the aryl group (substitutional or nonsubstitutional) of $R_1$. In the above general formula (XX), examples of the allylene group of $Ar_4$ include a divalent group derived from the aryl group (substitutional or nonsubstitutional) defined by $B_1$.

In the above general formula (V), $Ar_2$ and $Ar_3$ represent the allylene group (substitutional or nonsubstitutional). Examples of the allylene group of $Ar_3$ include a divalent group which is defined by $B_1$ and is derived from the aryl group (substitutional or nonsubstitutional).

The above summarizes the constitutional unit of the general formula (V). The same signs are applicable likewise to the other general formulas.

Hereinafter described is about the diol which is a raw material monomer of the new aromatic polycarbonate resin under the present invention and is expressed by the general formula (XIV), the general formula (XV) and the general formula (XVI) described above. These compounds, for example, a diol expressed by the general formula (XIV) below can be manufactured, as is seen in the following synthesis steps, by obtaining a stilbene compound expressed by the following general formula (XXIV), from a phosphonic acid ester expressed by the following general formula (XXII) and a carbonyl compound expressed by the following general formula (XIII), followed by a cleavage of the ether group or the ester group.

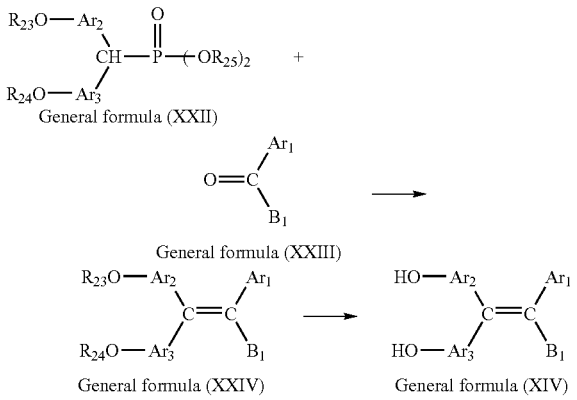

(where $R_{23}$ and $R_{24}$ represent the alkyl group (substitutional or nonsubstitutional) defined in substantially the same manner as that of $B_1$ above, and the acyl group defined in substantially the same manner as that of $R_{17}$ and $R_{18}$ above. $R_{25}$ represents a lower alkyl group. Specific examples include alkyl groups of straight chain having 1 to 5 carbon atoms or branched chain having 1 to 5 carbon atoms, such as methyl group, ethyl group, n-propyl group, i-propyl group, t-butyl group, s-butyl group, n-butyl group, i-butyl group, n-pentyl group, and the like. $R_1$, $Ar_1$, $Ar_2$ and $Ar_3$ are defined in substantially the same manner as those defined above.)

The diols expressed by the general formula (XV) and the general formula (XVI) can be manufactured in substantially the same manner as that of the diols expressed by the general formula (XIV) from the corresponding phosphonic acid ester and the corresponding carbonyl compound.

In the polycarbonate resin which is i) a copolymer of the constitutional unit expressed by the general formula (V) with the constitutional unit expressed by the general formula (I) or ii) a copolymer of the constitutional unit expressed by the general formula (V) with the constitutional unite expressed by the general formula (II), a content of the constitutional unit of the general formula (V) can be selected from an arbitrary range. Since corresponding to the charge transportability of the polycarbonate resin, the content of the constitutional unit of the general formula (V) relative to an entire constitutional units is preferably 5 mol % or more and more preferably 20 mol % or more.

The electrophotographic photoconductor under the present invention is a photoconductor that contains, as an effective component, the polycarbonate resin containing a constitutional unit expressed by the general formula (I).

The molecular weight of the polycarbonate resin (for use for electrophotographic photoconductor) expressed by the general formula (I) is preferably 7000 to 1000000 and more preferably 10000 to 500000 which is a polystyrene conversion number average molecular weight. Too small a molecular weight may not be practical due to cracks and the like, deteriorating film formation. Too large a molecular weight may also not be practical due to deteriorated solubility in an ordinary organic solvent, increasing viscosity of the solution thus making it difficult to coat.

The polycarbonate resin under the present invention can show a good solubility in various ordinary organic solvents such as dichloromethane, tetrahydro furan, chloroform, toluene, dichlorobenzene, xylene and the like. Thus, a proper solvent which can dissolve the polycarbonate resin under the present invention can make a proper-density solution which can be used for preparing various photoconductors by a known coating process.

Hereinafter described is about an embodiment for containing the polycarbonate resin in the photoconductive layer. FIG. 1 to FIG. 6 show cross sections of the photoconductors under the present invention.

The photoconductor under the present invention is made of one polycarbonate resin or two or more polycarbonate resins contained the photoconductive layer (2) ((2'), (2''), (2'''), (2''''), and (2''''')). Depending on the applications, the photoconductors under the present invention can be used as shown in FIG. 1, FIG. 2, FIG. 3, FIG. 4, FIG. 5 and FIG. 6.

As is seen in FIG. 1, there is provided a photoconductive layer (2) on a conductive substrate (1). The photoconductive layer (2) is made of a sensitizing dye and a charge transportability polycarbonate resin, and as the case may be made of a bonding agent (binder resin). The polycarbonate resin having the charge transportability hereinabove can act as a photoconductive material, thereby generation and movement of the charge carrier necessary for light attenuation may be carried out through the charge transportability polycarbonate resin. The charge transportability polycarbonate resin, however, scarcely absorbs light in the visible range. For forming the image with visible light, therefore, it is necessary for the charge transportability polycarbonate resin to be added by the sensitizing dye for absorbing the light in the visible range.

Figure 2:
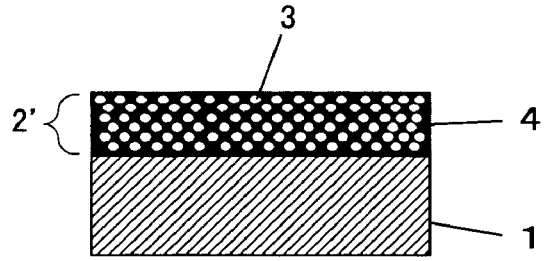
FIG. 2 is a cross sectional view of another example of a layer constitution of an electrophotographic photoconductor under the present invention.

The photoconductor in FIG. 2 has the following constitution. A photoconductive layer (2') is disposed on a conductive substrate (1). In the photoconductive layer (2'), a charge generating material (3) is dispersed in a charge transporting medium (4) which uses the charge transportability polycarbonate resin alone or in combination with a bonding agent. Hereinabove, the charge transportability polycarbonate resin forms the charge transporting medium (4) alone or in combination with the bonding agent, on the other hand, the charge generating material (3) (inorganic pigment or organic pigment) may generate the charge carrier. In this case, mainly, the charge transporting medium (4) may receive the charge carrier generated by the charge generating material (3) and transport the charge carrier. In this photoconductor, for the following cause, the charge generating material (3) and the charge transportability polycarbonate resin have a fundamental condition that the two have no absorption wavelength ranges which are overlapped with each other mainly in the visible range: Cause: Light transmittance up to a surface of the charge generating material (3) is necessary for effectively generating the charge carrier to the charge generating material (3). The charge transportability polycarbonate resin under the present invention is almost free from absorption in the wavelength range of 600 nm or more, and absorbs the light beam ordinarily from visible range to near infrared range. Especially, in combination with the charge generating material (3) generating the charge carrier, the charge transportability polycarbonate resin under the present invention may effectively act as a charge transporting material. The charge transporting medium (4) may contain a low molecular charge transporting material.

Figure 3:
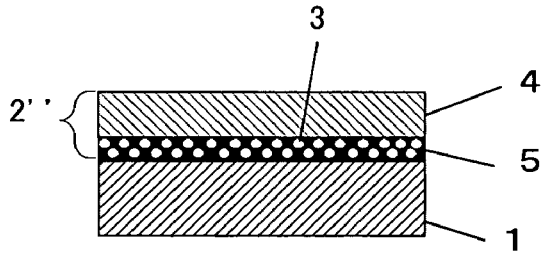
FIG. 3 is a cross sectional view of another example of a layer constitution of an electrophotographic photoconductor under the present invention.

FIG. 3 shows a photoconductor in which a charge generating layer (5) and a charge transporting layer (4) are laminated on a conductive substrate (1), to thereby form a photoconductive layer (2"). Hereinabove, the charge generating layer (5) has a main component of a charge generating material (3), while the charge transporting layer (4) contains a charge transportability polycarbonate resin with charge transportability. In the above photoconductor, a light through the charge transporting layer (4) reaches the charge generating layer (5), thus causing a charge carrier in the range, on the other hand, the charge transporting layer (4) may receive an injection of the charge carrier and transport the charge carrier. Generation of the charge carrier necessary for the light attenuation is carried out in the charge generating material (3), while the transportation of the charge carrier is carried out by the charge transporting layer (4). The above constitution of the photoconductor in FIG. 3 is substantially the same as that of the photoconductor in FIG. 2.

The charge transporting layer (4) may be formed with the charge transportability polycarbonate resin under the present invention alone or in combination with the bonding agent. For increasing charge generation efficiently, the charge generating layer (5) may contain the charge transportability polycarbonate resin under the present invention. For the like purpose, the photoconductive layer (2") may contain a low molecular transportation material. This may likewise apply to the photoconductive layer (2''') to the photoconductive layer (2'''') to be described afterward.

Figure 4:
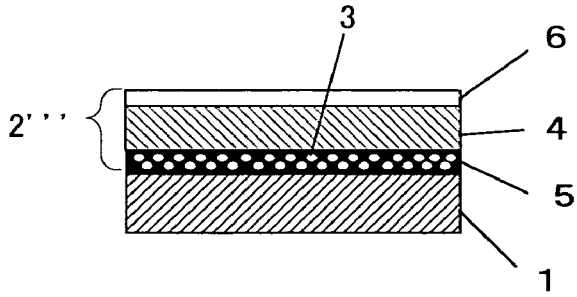
FIG. 4 is a cross sectional view of another example of a layer constitution of an electrophotographic photoconductor under the present invention.

In a photoconductor in FIG. 4, a protective layer (6) is disposed on the charge transporting layer (4). In this constitution, the charge transportability polycarbonate resin alone or in combination with the bonding agent may form the protective layer (6) on the charge transporting layer (4). As a matter of course, forming the protective layer (6) on a conventional widely-used low molecular dispersion type charge transporting layer is effective. A protective layer may be formed likewise on the photoconductive layer (2') in FIG. 2.

Figure 5:
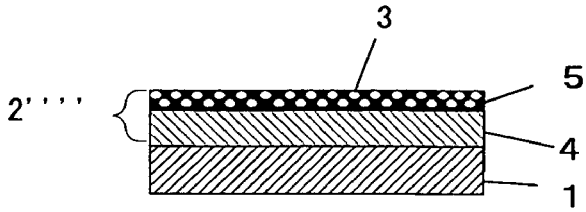
FIG. 5 is a cross sectional view of another example of a layer constitution of an electrophotographic photoconductor under the present invention.
Figure 6:
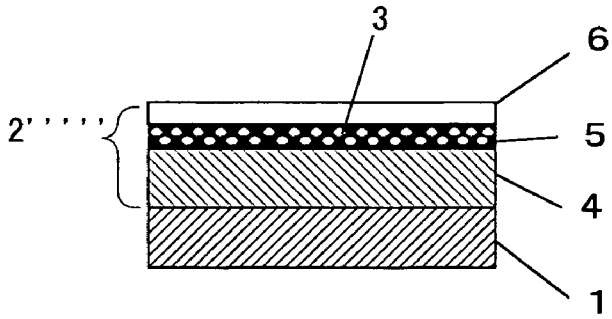
FIG. 6 is a cross sectional view of another example of a layer constitution of an electrophotographic photoconductor under the present invention.

In a photoconductor in FIG. 5, compared with FIG. 3, the order of laminating the charge generating layer (5) and the charge transporting layer (4) which contains the charge transportability carbonate resin is reversed. The constitution of generating and transporting the charge carrier can be the same as that described above. In this case, in view of mechanical strength, a protective layer (6) can be disposed on a charge generating layer (5), as is seen in FIG. 6.

For preparing the photoconductor under the present invention, in the case of the photoconductor in FIG. 1, the charge transportability polycarbonate resin alone or in combination with the bonding agent is to be dissolved, and the thus dissolved is to be added by a sensitizing dye, and then the thus obtained solution is applied on the conductive substrate (1) and dried to thereby form the photoconductive layer (2).

The photoconductive layer (2) has a thickness of 3 μm to 50 μm and preferably 5 μm to 40 μm. The amount of the charge transportability polycarbonate resin relative to the photoconductive layer (2) is 30 weight % to 100 weight %. The amount of the sensitizing dye relative to the photoconductive layer (2) is 0.1 weight % to 5 weight % and more preferably 0.5 weight % to 3 weight %. Examples of the sensitizing dyes include triaryl methane dyes such as brilliant green, Victoria blue B, methyl violet, crystal violet, acid red violet 6B; xanthene dyes such as rhodamine B, rhodamine 6G, rhodamine G extra, eosin S (bromeosin S), Erythrosine, Rose Bengale, fluorescein; thiazine dyes such as methylene blue; and cyanine dyes such as cyanine; and the like.

For preparing the photoconductor in FIG. 2, the charge transportability polycarbonate resin alone or in combination with the bonding agent is to be dissolved, and a fine particle of the charge generating material (3) is to be dispersed in the thus obtained solution, and then the thus obtained is applied on the conductive substrate (1) and dried to thereby form the photoconductive layer (2').

The photoconductive layer (2') has a thickness of 3 μm to 50 μm and preferably 5 μm to 40 μm. The amount of the charge transportability polycarbonate resin relative to the photoconductive layer (2') is 40 weight % to 100 weight %. The amount of the charge generating material (3) relative to the photoconductive layer (2') is 0.1 weight % to 50 weight % and preferably 1 weight % to 20 weight %. Examples of the charge generating material (3) include inorganic materials such as selenium, selenium-tellurium, cadmium sulfide, cadmium sulfide-selenium, α-silicon, and the like; organic materials such as C. I. pigment blue 25 (color index C. I. 21180), C. I. pigment red 41 (C. I. 21200), C. I. acid red 52 (C. I. 45100), C. I. basic red 3 (C. I. 45210), azo pigments such as azo pigment having carbazole skeleton (described in JP-A No. 53-95033), azo pigment having distyryl benzene skeleton (described in JP-A No. 53-133445), azo pigment having triphenyl amine skeleton (described in JP-A No. 53-132347), azo pigment having dibenzothiophene skeleton (described in JP-A No. 54-21728), azo pigment having oxadiazole skeleton (described in JP-A No. 54-12742), azo pigment having fluorenone skeleton (described in JP-A No. 54-22834), azo pigment having bisstilbene skeleton (described in JP-A No. 54-17733), azo pigment having distyryl oxadiazole skeleton (described in JP-A No. 54-2129), azo pigment having distyryl carbazole skeleton (described in JP-A No. 54-14967); phthalocyanine pigment such as C. I. pigment blue 16 (C. I. 74100); indigo pigment such as C. I. vat brown 5 (C. I. 73410), C. I. vat dye (C. I. 73030) and the like; perylene pigments such as Algo scarlet B (made by Bayer), indanthrene scarlet R (made by Bayer); and the like. The above charge generating materials can be used alone or in combination of two or more.

The charge generating materials, especially, in combination with the phthalocyanine pigment can bring about a photoconductor having high sensitivity and high durability. As the phthalocyanine pigment, a compound having a phthalocyanine skeleton expressed by the following general formula (N) is named, including an element M (center metal) which is metal and nonmetal (hydrogen).

General formula (N)

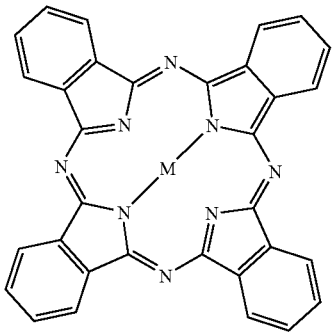

The Ms named herein is made of a simplex such as H, Li, Be, Na, Mg, Al, Si, K, Ca, Sc, Ti, V, Cr, Mn, Fe, CO, Ni, Cu, Zn, Ga, Ge, Y, Zr, Nb, Mo, Tc, Ru, Rh, Pd, Ag, Cd, In, Sn, Sb, Ba, Hf, Ta, W, Re, Os, Ir, Pt, Au, Hg, Tl, La, Ce, Pr, Nd, Pm, Sm, Eu, Gd, Tb, Dy, Ho, Er, Tm, Yb, Lu, Th, Pa, U, Np, Am; or two or more elements such as oxide, chloride, fluoride, hydride, bromide and the like. The center metal is not limited to the above elements. The charge generating material having the phthalocyanine skeleton under the present invention may have at least a findamental skeleton of the general formula (N). A polymer such as dimer and trimer, or still higher molecular structure is allowed. Moreover, the charge generating material having the phthalocyanine skeleton under the present invention may have various substituents for the fundamental skeleton.

Of the above various phthalocyanines, oxo titanium phthalocyanine having TiO as the center metal, and a nonmetal phthalocyanine having H are especially preferable in view of photoconductor property.

Moreover, the above phthalocyanines are known to have various crystal systems. For example, the oxo titanium phthalocyanine has α type, β type, γ type, m type, y type and the like, and a copper phthalocyanine has crystal multi-systems such as α, β, γ and the like. In the case of the phthalocyanines having the same center metal, varying the crystal system may vary the properties. Among them, the photoconductor property may vary in accordance with the varied crystal system, which is reported in volume 29, No. 4 (1990) of a magazine by the Society of Electrophotography of Japan. With this, in each phthalocyanine, the most proper crystal system in contained in terms of photoconductor property. Especially, the y type crystal system is preferable for the oxo titanium phthalocyanine.

The above charge generating materials may be a combination of two or more charge generating materials having the phthalocyanine skeleton, or may be a combination with other charge generating materials. In this case, examples of charge transporting materials to be combined therewith include an inorganic material and an organic material.

For preparing the photoconductor as is seen in FIG. 3, the following operations are to be taken: To the conductive substrate (1), a vacuum evaporation (deposition) of the charge generating material (3) is to be carried out. Otherwise, a dispersion liquid is to be applied which is obtained by dispersing the fine particles of the charge generating material (3) in a proper solvent in which the bonding agent is dissolved in case of necessity, then the dispersion liquid is to be dried.

Moreover, when necessary, a buffing and the like is to be carried out for surface finish or film thickness adjustment, to thereby form the charge generating layer (5). Then, the solution of the charge transportability polycarbonate resin alone or in combination with the bonding agent is to be applied and dried, to thereby form the charge transporting layer (4).

Hereinabove, the charge generating material (3) used for forming the charge generating layer (5) is the same as that described in the description of the photoconductive layer (2').

The charge generating layer (5) has a thickness of 5 μm or less and preferably 2 μm or less. The charge transporting layer (4) has a thickness of 3 μm to 50 μm and preferably 5 μm to 40 μm. When the charge generating layer (5) has the fine particles of the charge generating material (3) dispersed in the bonding agent, the ratio of the fine particles of the charge generating material (3) relative to the charge generating layer (5) is 10 weight % to 100 weight %, preferably 50 weight % to 100 weight %. The amount of the charge transportability polycarbonate resin relative to the charge transporting layer (4) is 40 weight % to 100 weight %.

As described above, the photoconductive layer (2") in FIG. 3 may contain the low molecular charge transporting material. Shown below are examples of the charge transporting materials used herein:

Oxazole derivative and oxadiazole derivative (JP-A No. 52-139065 and JP-A No. 52-139066), imidazole derivative, triphenyl amine derivative (JP-A No. 3-285960), benzidine derivative (Japanese Patent Application Publication (JP-B) No. 58-32372), α-phenyl stilbene derivative (JP-A No. 57-73075), hydrazone derivative (JP-A No. 55-154955, JP-A No. 55-156954, JP-A No. 55-52063, JP-A No. 56-81850, and the like), triphenyl methane derivative (JP-B No. 51-10983), anthracene derivative (JP-A No. 51-94829), styryl derivative (JP-A No. 56-29245 and JP-A No. 58-198043), carbazole derivative (JP-A No. 58-58552), pyrene derivative (JP-A No. 2-94812), and the like.

For preparing the photoconductor in FIG. 4, the solution is to be applied on the photoconductor in FIG. 3, which solution is made by dissolving the polycarbonate resin under the present invention alone or when necessary in combination with the bonding agent or with the charge transporting material. Then, the solution is dried to thereby form the protective layer (6). The protective layer (6) has a preferable thickness of 0.15 μm to 10 μm. In the protective layer (6), the polymer under the present invention occupies 40 weight % to 100 weight %.

For preparing the photoconductor in FIG. 5, the solution is to be applied on the conductive substrate (1), which solution is made by dissolving the polycarbonate resin under the present invention alone or when necessary in combination with the bonding agent or with the charge transporting material. Then, the solution is dried to thereby form the charge transporting layer (4). Thereafter, a dispersion liquid (obtained by dispersing the fine particles of the charge generating material (3) in the solvent in which the bonding agent is dissolved in case of necessity) is to be applied on the charge transporting layer (4) by spray and the like, then followed by drying, to thereby form the charge generating layer (5). The content of the charge generating layer (5) and the content of the charge transporting layer (4) is as described in the description of FIG. 3.

Forming the protective layer (6) on the thus obtained charge generating layer (5) of the photoconductor can form the photoconductor in FIG. 6.

In any of the manufactures of the photoconductors described above, used for the conductive substrate (1) include metal plate of metal foil such as aluminum, a plastic film on which metal such as aluminum is evaporated, paper subjected to a conduction treatment, and the like.

Examples of the bonding agent include condensation resins such as polyamide, polyurethane, polyester, epoxy resin, polyketone, polycarbonate; vinyl polymers such as polyvinyl ketone, polystyrene, poly-N-vinyl carbazole, polyacrylic amide; and the like. The above examples of the bonding agent may also include all resins that are insulative and adhesive. When necessary, a plasticizer may be added to the bonding agent. Included in examples of the plasticizers are halogenated paraffin, dimethyl naphthalene, dimethyl phthalate and the like. When necessary, additives such as oxidation inhibitor, light stabilizer, heat stabilizer, lubricant and the like can be added.

The photoconductor thus obtained may be, when necessary, provided with an adhesion layer or a barrier layer between the conductive substrate (1) and the photoconductive layer (2). Examples of the materials for the adhesion layer and the barrier layer include polyamide, nitrocellulose, aluminum oxide, titanium oxide, and the like. The above materials have preferable thickness of 1 μm or less.

Copying by using the photoconductor under the present invention may take the following steps: carrying out charging on the photoconductor surface, exposing the photoconductor surface, developing, and when necessary transferring on to paper and the like.

The photoconductor under the present invention is high in sensitivity and excellent in durability.

Hereinafter described is about the dihydroxy diphenyl ether compound under the present invention. The dihydroxy diphenyl ether compound under the present invention can use, as the raw material, the general formula (I) which is the main constitutional unit of the polycarbonate resin under the present invention. As described above, the dihydroxy diphenyl ether compound under the present invention is expressed by the general formula (XI) or the general formula (XII). With this, the dihydroxy diphenyl ether compound under the present invention has a substituent at least in an ortho position of the hydroxyl group in the molecule. The dihydroxy diphenyl ether compound expressed by the general formula (XI) and the general formula (XII) is a new material, and is to be used as a raw material monomer of an organic high polymer material.

The reason therefor is supposed to be attributable to the substituent ($—CH_2—R_1$) which is probably present in the molecule, and the specific substitutional position (ortho position) thereof. More specifically, the hydroxyl group may become a reactive portion when the high polymer is synthesized, while the substituent ($—CH_2—R_1$) is supposed to operate as a protective group of the high polymer main chain forming portion. Moreover, $R_1$ in the substituent ($—CH_2—R_1$) may help improve solubility and compatibility, thus bringing about the dihydroxy diphenyl ether compound that is the raw material monomer made of an organic high polymer material having higher performance.

Hereinafter described is about the substituent expressed by the general formula (XI). Examples of the alkyl group (substitutional or nonsubstitutional), as a substituent used for $R_1$, include the following. A straight chain alkyl group, a branched alkyl group, and a cyclic alkyl group each having 1 to 18 carbon atoms. The above alkyl groups may further contain fluorine atom, cyano group, alkoxy group having 1 to 18 carbon atoms, phenyl group having 1 to 18 carbon atoms, halogen atom having 1 to 18 carbon atoms, and phenyl group substituted with alkyl group (straight chain alkyl group, branched alkyl group, and cyclic alkyl group each having 1 to 6 carbon atoms). Specific examples include methyl group, ethyl group, n-propyl group, i-propyl group, n-butyl group, i-butyl group, s-butyl group, t-butyl group, n-hexyl group, n-octyl group, n-decyl group, n-dodecyl group, n-octadecyl group, trifluoro methyl group, 2-cyanoethyl group, methoxy methyl group, methoxy ethyl group, benzil group, 4-chlorobenzil group, cyclopentyl group, cyclohexyl group, and the like. Examples of the aryl groups (substitutional or nonsubstitutional) include phenyl group, naphthyl group, and the like. The above aryl groups may be further substituted with alkyl group (straight chain alkyl group, branched alkyl group, and cyclic alkyl group each having 1 to 18 carbon atoms), fluorine atom, cyano group, alkoxy group having 1 to 18 carbon atoms. Specific examples include phenyl group, naphthyl group, 4-methylphenyl group, 3-methylphenyl group, 4-butylphenyl group, 4-hexylphenyl group, 4-octylphenyl group, 4-fluorophenyl group, 4-cyanophenyl group, 4-trifluoro methylphenyl group, and the like.

Substituents used for $R_2$ to $R_7$ include halogen atoms such as fluorine atom, chlorine atom, bromine atom, iodine atom, and the like. Examples of the alkyl groups (substitutional or nonsubstitutional) having 1 to 6 carbon atoms include the following: alkyl group such as straight chain alkyl group, branched alkyl group, and cyclic alkyl group each having 1 to 6 carbon atoms. The above alkyl group may further contain fluorine atom, cyano group, alkoxy group having 1 to 6 carbon atoms, phenyl group having 1 to 6 carbon atoms, halogen atom having 1 to 6 carbon atoms, and phenyl group substituted with alkyl group (straight chain alkyl group, branched alkyl group, and cyclic alkyl group each having 1 to 6 carbon atoms). Specific examples include methyl group, ethyl group, n-propyl group, i-propyl group, n-butyl group, i-butyl group, s-butyl group, t-butyl group, trifluoro methyl group, 2-cyanoethyl group, methoxy methyl group, methoxy ethyl group, benzil group, 4-chlorobenzil group, cyclopentyl group, cyclohexyl group, and the like.

Hereinafter described is a manufacturing process under the present invention. A manufacturing steps are shown below.

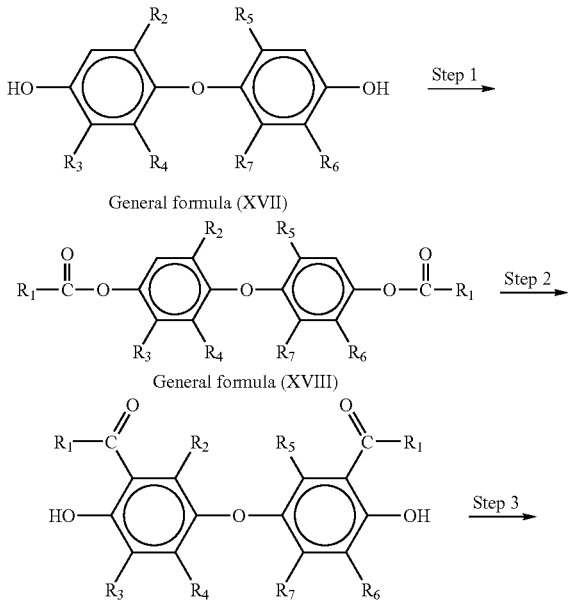

-continued

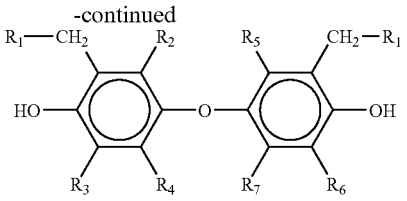

General formula (XI)

A first step can prepare diacyloxy diphenyl ether compound (XVIII) by an acylation of dihydroxy diphenyl ether compound (XVII), using acid anhydride or acid chloride. A known process (for example, the New Experimentation Chemical Course 14 (II) 1012) may be used for the first step for an easy manufacture. The above acylation can be achieved by using the acid anhydride or the acid chloride which is two times or more the dihydroxy diphenyl ether compound (XVII) in terms of molar weight. In the case of the acid anhydride, used as reactive catalyst include acids such as sulfuric acid, p-toluene sulfonic acid, zinc chloride, and the like; bases such as pyridine, 4-dimethyl amino pyridine, and the like; and the like. In the case of the acid chloride, used as reactive catalyst include bases such as pyridine, 4-dimethyl amino pyridine, and the like.

A second step can prepare dihydroxy diacyl compound (XIX) by making a Fries transfer of diacyloxy diphenyl ether compound (XVIII) under an acid catalyst. A known process (for example, the New Experimentation Chemical Course 14 (II) 776, or Org. React., 1, 343 (1942)) may be used for the second step for an easy manufacture. More specifically, an acid catalyst is to be added at once such as aluminum chloride, zinc chloride or the like which is two times or more the diacyloxy diphenyl ether compound (XVIII) in terms of molar weight. Then, the thus obtained is to be reacted ordinarily at a heating temperature of 70° C. or more. For the reaction, no solvent is used, otherwise, any of 1,2-dichloro ethane, chloro benzene, 1,1,2,2,-tetrachloro ethane, nitrobenzene, and the like are used. The above Fries transfer can be selectively transferred to the ortho position of an OH group, since a para position is substituted.

A third step can prepare dihydroxy diphenyl ether compound (XI) by reducing carbonyl group of the dihydroxy diacyl compound (XIX). The following conventional processes can be used for reducing the carbonyl group.

i) Reduction by Hydrazine <Wolff-Kishner Reduction> (For Example, the New Experimentation Chemical Course 15 (II) 224).

Using, as solvent, glycols having high boiling point, a heating reaction is to be carried out in the presence of the dihydroxy diacyl compound (XIX) and caustic alkali (such as hydrated hydrazine, sodium hydroxide, potassium hydroxide, and the like), to thereby obtain the dihydroxy diphenyl ether compound (XI). An ordinary reaction temperature is 150° C. to 200° C.

ii) Reduction by Metal Hydride Complex Compound (For Example, the New Experimentation Chemical Course 15 (II) 179).

Various metal hydride complex compounds are used for reducing the carbonyl group. Among them, sodium borohydride is especially excellent. Causing a rotary flow of the dihydroxy diacyl compound (XIX) in a sodium borohydride solution can bring about the dihydroxy diphenyl ether compound (XI).

iii) Reduction by Zinc Amalgam <Clemmensen Reduction> (For Example, the New Experimentation Chemical Course 15 (II) 64)

Using zinc amalgam and hydrochloric acid, a dihydroxy acyl compound (XIX) is to be heat-reacted, to thereby obtain a dihydroxy diphenyl ether compound (XI). For the reaction, no solvent is used, otherwise, any of ethanol, dioxane, acetic acid, toluene, and the like are used. An ordinary reaction temperature is 70° C. to 130° C.

iv) Reduction by Hydrosilane (For Example, the New Experimentation Chemical Course 15 (II) 118)

Treating the dihydroxy diacyl compound (XIX) in a trifluoro acetic acid using trialkyl silane can bring about the dihydroxy diphenyl ether compound (XI). Examples of the trialkyl silane used include trimethyl silane, triethyl silane, polymethyl hydrosiloxane, and the like. The reaction is carried out at a room temperature to cause a high yield.

Among the above, iv) Reduction by hydrosilane can be preferably used from the view point of obtaining the dihydroxy diphenyl ether compound (XI) under acid and mild conditions.

The dihydroxy diphenyl ether compound can be synthesized as described above. This compound is also useful for manufacturing various materials derived from hydroxyl group, namely, manufacturing intermediate bodies such as polycarbonate resin, polyester resin, polyurethane resin, epoxy resin, and the like. Described below are details about a situation using the dihydroxy diphenyl ether compound as the monomer of the organic high polymer material.

Synthesis of the organic high polymer material from the dihydroxy diphenyl ether compound can be carried out by using a conventionally-known condensation high polymer, namely, mainly by polycondensation or polyaddition. The above process is described in "the New High Polymer Experimentation 3, Synthesis and Reaction of High Polymer (2), Synthesis of Condensation High Polymer, edited by The Society of Polymer Science, Japan, published by KYORITSU SHUPPAN CO., LTD." and the like.

Specific examples of the polymers are those having a repeating unit expressed by the following general formula (XXVI) and a repeating unit expressed by the following general formula (XXVII), where the content of the repeating unit expressed by the following general formula (XXVI) is 1 mol % to 100 mol %.

General formula (XXVI)

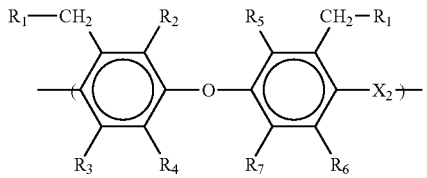

General formula (XXVII)

($R_1$ to $R_7$ represent a corresponding raw material monomer used for polymer synthesis, namely, are defined in substantially the same manner as that of $R_1$ to $R_7$ of the dihydroxy diphenyl ether compounds in the above general expressions (XI), (XII), (XVII), (XVIII) and (XIX). $X_1$ represents an aliphatic divalent group (substitutional or nonsubstitutional), an alicyclic divalent group (substitutional or nonsubstitutional), an aromatic divalent group (substitutional or nonsubstitutional), a divalent group bonding the above, and the following:

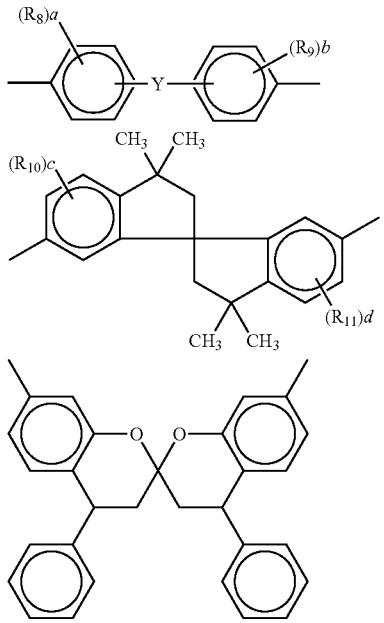

(Each of $R_8$, $R_9$, $R_{10}$ and $R_{11}$ is an independent alkyl group (substitutional or nonsubstitutional), aryl group (substitutional or nonsubstitutional), or halogen atom. Each of "a" and "b" is an integer of 0 to 4. Each of "c" and "d" is an integer of 0 to 3. When each of $R_8$, $R_9$, $R_{10}$ and $R_{11}$ are plural in number, "a" and "b" are allowed to be the same or different from each other, and "c" and "d" are allowed to be the same or different from each other.

Y is selected from a single bond, a straight chain alkylene group having 2 to 12 carbon atoms, a branched alkylene group having 3 to 12 carbon atoms (substitutional or nonsubstitutional), and a divalent group constituted of at least one alkylene group having 1 to 10 carbon atoms, and at least one oxygen atom or sulfur atom. Moreover, Y is selected from —O—, —S—, —SO—, —$SO_2$—, —CO—, and —COO—.

Furthermore, Y is selected from the following formulas:

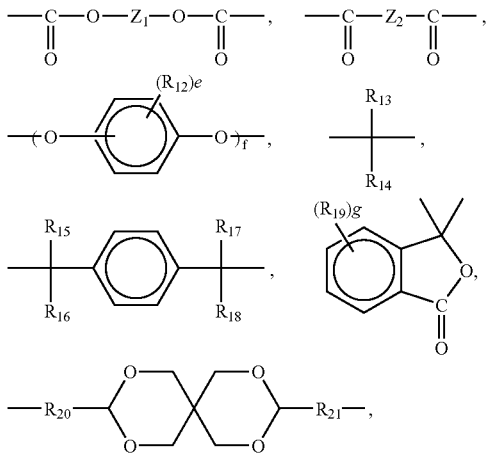

-continued

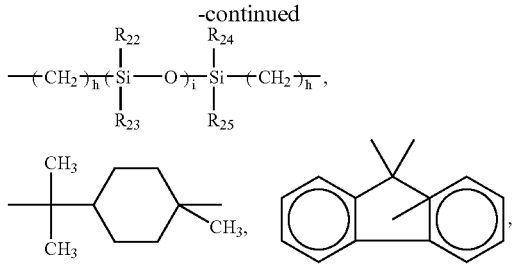

In the above formulas, $Z_1$ and $Z_2$ represent one of an aliphatic divalent group (substitutional or nonsubstitutional) and an allylene group (substitutional or nonsubstitutional). $R_{12}$, $R_{13}$ and $R_{19}$ represent halogen atom, alkyl group (substitutional or nonsubstitutional), alkoxy group (substitutional or nonsubstitutional), and aryl group (substitutional or nonsubstitutional). Each of $R_{14}$, $R_{15}$, $R_{16}$, $R_{17}$, and $R_{18}$ is independent, and represents hydrogen atom, halogen atom, alkyl group (substitutional or nonsubstitutional), alkoxy group (substitutional or nonsubstitutional), and aryl group (substitutional or nonsubstitutional). $R_{13}$ and $R_{14}$ bonded with each other may form a carbon ring having 5 to 12 carbon atoms. $R_{20}$ and $R_{21}$ represent a single bond, or an alkylene group having 1 to 4 carbon atoms. Each of $R_{22}$ and $R_{23}$ is independent and represents alkyl group (substitutional or nonsubstitutional) and aryl group (substitutional or nonsubstitutional). "e" and "g" represent an integer of 0 to 4. "f" represents 1 or 2. "h" represents an integer of 0 to 20. "i" represents an integer of 0 to 2000. $X_2$ in the general formula XXVI represents oxy group, imino group, thio group, oxycarbonyl group, oxycarbonyloxy group, iminocarbonyl group, ureylene group, carbonyloxycarbonyl group, sulfonyl group, iminosulfonyl group, iminocarbonyloxy group.

Among the above, when $X_2$ in the general formula XXVI and the general formula XXVII is an oxycarbonyloxy group, the conventional polycarbonate synthesizing process can be applied. Namely, in this case, the polycarbonate can be manufactured by i) a transesterification between diol (containing bisphenol) and bisaryl carbonate, ii) a solution polymerization or an interfacial polymerization with carbonyl compound halide such as phosgene, iii) a process of using chloroformate such as bischloroformate and the like derived from diol, and the like. The above known manufacturing processes are described for example in the Polycarbonate Resin Handbook (edited by Seiichi Honma, published by THE NIKKAN KOGYO SHIMBUN, LTD) and the like.

For example, when $X_2$ is an oxycarbonyl group in the general formula (XXVI) and the general formula (XXVII), the conventional polyester synthesizing process can be used, achieving a synthesis by i) nucleophilic acyl substitutional polymerization of a diol (containing bisphenol) and a dicarboxylic acid derivative, ii) aliphatic nucleophilic substitutional polymerization of salt of dicarboxylic acid and an aliphatic dihalide, iii) and the like. Details of the above are described on page 49 to page 54 and page 77 to page 95 in "the New High Polymer Experimentation 3, Synthesis and Reaction of High Polymer (2), Synthesis of Condensation High Polymer, edited by The Society of Polymer Science, Japan, published by KYORITSU SHUPPAN CO., LTD." Especially, the synthesizing process of the polyarylate described on page 87 to page 95 is preferably used.

Moreover, when $X_2$ is iminocarbonyloxy group in the general formula (XXVI) and the general formula (XXVII), the known polyurethane synthesizing process can be used, achieving a synthesis by i) polyaddition of diol and diisocyanate, ii) polycondensation of diamine and bischloroformate, iii) and the like. Details of the above are described on page 117 to page 119 and page 229 to page 233 in "the New High Polymer Experimentation 3, Synthesis and Reaction of High Polymer (2), Synthesis of Condensation High Polymer, edited by The Society of Polymer Science, Japan, published by KYORITSU SHUPPAN CO., LTD."

Described below are details about the repeating unit expressed by the general formula (XXVII). The halogen atom, and the alkyl group (substitutional or nonsubstitutional) used for explaining the general formula (XXVII) are, respectively, substantially the same as those (namely, the halogen atom, and the alkyl group (substitutional or nonsubstitutional) which has 1 to 6 carbon atoms) defined by the general formula (XI).

The alkoxy group (substitutional or nonsubstitutional) represents an alkoxy group having an alkyl group (substitutional or nonsubstitutional) described above. Specific examples thereof include methoxy group, ethoxy group, n-propoxy group, i-propoxy group, n-butoxy group, i-butoxy group, s-butoxy group, t-butoxy group, 2-hydroxy ethoxy group, 2-cyano ethoxy group, benziloxy group, 4-methyl benzil oxy group, trifluoro methoxy group, and the like.

The "aryl" represents a group containing heterocyclic ring group. Examples of the aryl group (substitutional or nonsubstitutional) include phenyl group, naphthyl biphenyl group, terphenylyl group, pyrenyl group, fluorenyl group, 9,9-dimethyl-2-fluorenyl group, azulenyl group, anthryl group, triphenylenyl group, chrysenyl group, fluore nylidene phenyl group, 5H-dibenzo[a,d]cycloheptenylidene phenyl group, thienyl group, benzo thienyl group, furyl group, benzo furanyl group, carbazolyl group, pyridinyl group, pyrroridyl group, oxazolyl group, and the like. The above may have, as a substituent, the alkyl group (substitutional or nonsubstitutional), the alkoxy group having the alkyl group (substitutional or nonsubstitutional), and the halogen atom.

Typical and specific examples when $X_1$ is an aliphatic divalent group (substitutional or nonsubstitutional) and an alicyclic divalent group (substitutional or nonsubstitutional) include divalent groups which are diols deducted by 2 hydroxyl groups, the diols represented by: ethylene glycol, diethylene glycol, triethylene glycol, polyethylene glycol, polytetramethylene ether glycol, 1,3-propane diol, 1,4-butane diol, 1,5-pentane diol, 3-methyl-1,5-pentane diol, 1,6-hexane diol, 1,5-hexane diol, 1,7-heptane diol, 1,8-octane diol, 1,9-nonane diol, 1,10-decane diol, 1,11-undecane diol, 1,12-dodecane diol, neopentyl glycol, 2-ethyl-1,6-hexane diol, 2-methyl-1,3-propane diol, 2-ethyl-1,3-propane diol, 2,2-dimethyl-1,3-propane diol, 1,3-cyclohexane diol, 1,4-cyclohexane diol, cyclohexane-1,4-dimethanol, 2,2-bis(4-hydroxy cyclohexyl)propane, xylylene diol, 1,4-bis(2-hydroxy ethyl)benzene, 1,4-bis(3-hydroxy propyl)benzene, 1,4-bis(4-hydroxy butyl)benzene, 1,4-bis(5-hydroxy pentyl) benzene, 1,4-bis(6-hydroxy hexyl)benzene, isophorone diol, and the like.

When $X_1$ is an aromatic divalent group (substitutional or nonsubstitutional), the divalent group derived from the aryl group (substitutional or nonsubstitutional) under the present invention can be named.

In Y, specific examples of the divalent groups constituted of at least one alkylene group having 1 to 10 carbon atoms, and at least one oxygen atom or sulfur atom include:

$OCH_2CH_2O$, $OCH_2CH_2OCH_2CH_2O$, $OCH_2CH_2OCH_2CH_2OCH_2CH_2O$, $OCH_2CH_2CH_2O$, $OCH_2CH_2CH_2CH_2O$, $OCH_2CH_2CH_2CH_2CH_2CH_2O$, $OCH_2CH_2CH_2CH_2CH_2CH_2CH_2CH_2O$, $CH_2O$, $CH_2CH_2O$, $CHEtOCHEtO$, $CHCH_3O$, $SCH_2OCH_2S$, $CH_2OCH_2$, $OCH_2OCH_2O$, $SCH_2CH_2OCH_2OCH_2OCH_2CH_2S$, $OCH_2CHCH_3OCH_2CHCH_3O$, $SCH_2S$, $SCH_2CH_2S$, $SCH_2CH_2CH_2S$, $SCH_2CH_2CH_2CH_2S$, $SCH_2CH_2CH_2CH_2CH_2CH_2S$, $SCH_2CH_2SCH_2CH_2S$, $SCH_2CH_2OCH_2CH_2OCH_2CH_2S$, and the like.

As the alkylene group (substitutional or nonsubstitutional) under the present invention, the divalent group derived from the alkyl group (substitutional or nonsubstitutional) defined hereinabove can be named. As the substituent modifying the branch alkylene group having 3 to 10 carbon atoms, the aryl group (substitutional or nonsubstitutional) or the halogen atom can be named.

In the case that $Z_1$ and $Z_2$ are aliphatic divalent group (substitutional or nonsubstitutional), a diol (when $X_1$ is aliphatic divalent group and alicyclic divalent group) deducted by hydroxyl group can be named. Moreover, in the case that $Z_1$ and $Z_2$ are allylene group (substitutional or nonsubstitutional), a divalent group derived from the aryl group (substitutional or nonsubstitutional) defined under the present invention can be named.

When $X_1$ is an aromatic divalent group, preferable examples thereof include diols deducted by two hydroxyl groups, the diols such as:

bis(4-hydroxy phenyl)methane, bis(2-methyl-4-hydroxy phenyl)methane, bis(3-methyl-4-hydroxy phenyl)methane, 1,1-bis(4-hydroxy phenyl)ethane, 1,2-bis(4-hydroxy phenyl) ethane, bis(4-hydroxy phenyl)phenyl methane, bis(4-hydroxy phenyl)diphenyl methane, 1,1-bis(4-hydroxy phenyl)-1-phenyl ethane, 1,3-bis(4-hydroxy phenyl)-1,1-dimethyl propane, 2,2-bis(4-hydroxy phenyl)propane, 2-(4-hydroxy phenyl)-2-(3-hydroxy phenyl)propane, 1,1-bis(4-hydroxy phenyl)-2-methyl propane, 2,2-bis(4-hydroxy phenyl)butane, 1,1-bis(4-hydroxy phenyl)-3-methyl butane, 2,2-bis(4-hydroxy phenyl)pentane, 2,2-bis(4-hydroxy phenyl)-4-methyl pentane, 2,2-bis(4-hydroxy phenyl)hexane, 4,4-bis(4-hydroxy phenyl)heptane, 2,2-bis(4-hydroxy phenyl)nonane, bis(3,5-dimethyl-4-hydroxy phenyl)methane, 2,2-bis(3-methyl-4-hydroxy phenyl)propane, 2,2-bis(3-isopropyl-4-hydroxy phenyl)propane, 2,2-bis(3-sec-butyl-4-hydroxy phenyl)propane, 2,2-bis(3-tert-butyl-4-hydroxy phenyl)propane, 2,2-bis(3-cyclohexyl-4-hydroxy phenyl) propane, 2,2-bis(3-allyl-4-hydroxy phenyl)propane, 2,2-bis (3-phenyl-4-hydroxy phenyl)propane, 2,2-bis(3,5-dimethyl-4-hydroxy phenyl)propane, 2,2-bis(3-chloro-4-hydroxy phenyl)propane, 2,2-bis(3,5-dichloro-4-hydroxy phenyl) propane, 2,2-bis(3-bromo-4-hydroxy phenyl)propane, 2,2-bis(3,5-dibromo-4-hydroxy phenyl)propane, 2,2-bis(4-hydroxy phenyl)hexafluoro propane, 1,1-bis(4-hydroxy phenyl)cyclopentane, 1,1-bis(4-hydroxy phenyl)cyclohexane, 1,1-bis(3-methyl-4-hydroxy phenyl)cyclohexane, 1,1-bis(3,5-dimethyl-4-hydroxy phenyl)cyclohexane, 1,1-bis(3,5-dichloro-4-hydroxy phenyl)cyclohexane, 1,1-bis(4-hydroxy phenyl)-3,3,5-trimethyl cyclohexane, 1,1-bis(4-hydroxy phenyl)cycloheptane, 2,2-bis(4-hydroxy phenyl) norbornane, 2,2-bis(4-hydroxy phenyl)adamantane, 4,4'-dihydroxy diphenyl ether, 4,4'-dihydroxy-3,3'-dimethyl diphenyl ether, ethylene glycol bis(4-hydroxy phenyl)ether, 1,3-bis(4-hydroxy phenoxy)benzene, 1,4-bis(3-hydroxy phenoxy)benzene, 4,4'-dihydroxy diphenyl sulfide, 3,3'-dimethyl-4,4'-dihydroxy diphenyl sulfide, 3,3'5,5'-tetramethyl-4,4'-dihydroxy diphenyl sulfide, 4,4'-dihydroxy diphenyl sulfoxide, 3,3'-dimethyl-4,4'-dihydroxy diphenyl sulfoxide, 4,4'-dihydroxy diphenyl sulfone, 3,3'-dimethyl-4,4'-dihydroxy diphenyl sulfone, 3,3'-diphenyl-4,4'-dihydroxy diphenyl sulfone, 3,3'-dichloro-4,4'-dihydroxy diphenyl sulfone, 3,3'-dichloro-4,4'-dihydroxy diphenyl sulfone, bis(4-hydroxy phenyl)ketone, bis(3-methyl-4-hydroxy phenyl)ketone, 3,3,3',3'-tetramethyl-6,6'-dihydroxy spiro(bis)indane, 3,3',4,4'-tetrahydro-4,4,4',4'-tetramethyl-2,2'-spirobi(2H-1-benzopyran)-7,7'-diol, trans-2,3-bis(4-hydroxy phenyl)-2-butane, 9,9-bis(4-hydroxy phenyl)fluorene, 9,9-bis(4-hydroxy phenyl)xanthene, 1,6-bis(4-hydroxy phenyl)-1,6-hexanedione, α,α,α',α'-tetramethyl-α,α'-bis(4-hydroxy phenyl)-p-xylene, α,α,α',α'-tetramethyl-α,α'-bis(4-hydroxy phenyl)-m-xylene, 2,6-dihydroxy dibenzo-p-dioxine, 2,6-dihydroxy thianthrene, 2,7-dihydroxy phenoxathiin, 9,10-dimethyl-2,7-dihydroxy phenazine, 3,6-dihydroxy dibenzofuran, 3,6-dihydroxy dibenzothiophene, 4,4'-dihydroxy biphenyl, 1,4-dihydroxy naphthalene, 2,7-dihydroxy pyrene, hydroquinone, resorcin, 4-hydroxy phenyl-4-hydroxy benzoate, ethylene glycol-bis(4-hydroxy benzoate), diethylene glycol-bis(4-hydroxy benzoate), triethylene glycol-bis(4-hydroxy benzoate), p-phenylene-bis(4-hydroxy benzoate), 1,6-bis(4-hydroxy benzoyloxy)-1H, 1H, 6H, 6H-perfluoro hexane, 1,4-bis(4-hydroxy benzoyloxy-1H, 1H, 4H, 4H-perfluoro butane, 1,3-bis(4-hydroxy phenyl)tetramethyl disiloxane, and the like.

For regulating the molecular weight in all the polymerizing operations, it is preferable to use a terminal stopper as a molecular weight regulator. A substituent based on the terminal stopper may be bonded with a terminal portion of the polymer. Examples of the terminal stopper to be used include a monovalent aromatic hydroxy compound, a haloformate derivative of monovalent aromatic hydroxy compound, a monovalent carboxylic acid, a halide derivative of monovalent carboxylic acid, and the like which are conventionally known. The above terminal stoppers can be used alone or in combination of two or more. Examples of preferable terminal stoppers include the monovalent aromatic hydroxy compounds such as phenol, p-tert-butyl phenol, p-cumyl phenol, and the like. Moreover, the above preferable examples include phenyl chloroformate. The polymer preferably has a molecular weight of 1000 to 1000000 which is a polystyrene conversion number average molecular weight, and more preferably 2000 to 500000. For improving the mechanical properties and the like, a small amount of branching agent can be added in the polymerizing operation. Examples of the branching agent include aromatic hydroxyl group, haloformate group, carboxylic acid group, carboxylic acid halide group, and three or more reaction groups selected from active halogen atoms (homogeneous or heterogeneous). The above branching agents may be used alone or in combination of two or more.

In terms of the copolymer of the repeating unit of the general formula (XXVI) and the repeating unit of the general formula (XXVII), the ratio of the repeating unit of the general formula (XXVI) can be arbitrarily selected from 1 mol % to 100 mol %. Namely, the repeating unit of the above general formula (XXVII) may be so contained as to improve properties (mechanical, thermal and the like). Depending on the use of the polymer resin, for meeting the properties, the content of the repeating unit of the general formula (XXVI) is 1 mol % or more, preferably 5 mol % or more, and more preferably 20 mol % or more.

The thus manufactured dihydroxy diphenyl ether compound and the polymer using it under the present invention may be used for various applications. Examples include, in terms of monomer, oxidation inhibitor or heat-sensitive recording paper developer; and in terms of polymer, an optical dick substrate, and a binder resin which is used for organic photoconductor for the electrophotography.

Described below are examples under the present invention.

SYNTHESIS EXAMPLE I-1

Manufacture of 4,4'-diacetoxy diphenyl ether (a Compound Expressed by $A_1=CH_3$, $A_2=A_3=A_4=A_5=A_6=A_7=H$ in the General Formula (XVIII))

At a room temperature and in a stirring state, one droplet of 95% of sulfuric acid is added into 80.88 g (0.4 mol) of 4,4'-diphenyl ether and 102.09 g (1 mol) of acetic anhydride, to be stirred at the room temperature for 2 hours. The thus obtained reactant is added on an ice/water. A crystal deposit is filtered, washed with water, dried, and then refined using ethanol for recrystallization, to thereby obtain 109.24 g (95.4%) of an object.

Melting point: 112.5° C. to 113.5° C.

Element analysis value (%): Measured value/calculated value C, 66.98/67.13; H, 4.98/4.93.

SYNTHESIS EXAMPLE I-2

Manufacture of 4,4'-dihydroxy-3,3'-diethylene diphenyl ether (a Compound Expressed by $A_1=CH_3$, $A_2=A_3=A_4=A_5=A_6=A_7=H$ in the General Formula (XIX))

48 g (0.36 mol) of aluminum chloride (anhydrous) is added at once into a 150 ml solution of 1,1,2,2-tetrachloroethane of 28.63 g (0.1 mol) of the 4,4'-diacetoxy diphenyl ether obtained by the synthesis example I-1. Then, the reactant mixture is heated and stirred at 120° C. for 1 hour. Then, the reactant mixture is left at rest for cooling, and added on an ice/water. A hydrochloric acid is added to the reactant mixture. Extraction was carried out with dichloromethane. The dichloromethane phase was washed with water, and was dried with anhydrous magnesium sulfate. Then, the solvent was distilled. Then, the residue was refined using n-butanol for recrystallization, to thereby obtain 22.45 g (78.4%) of an object.

Melting point: 185.0° C. to 185.5° C.

Element analysis value (%): Measured value/calculated value C, 67.02/67.13; H, 4.91/4.93.

SYNTHESIS EXAMPLE I-3

Manufacture of 4,4'-dihydroxy-3,3'-diethyl diphenyl ether (a Compound Expressed by $A_1=CH_3$, $A_2=A_3=A_4=A_5=A_6=A_7=H$ in the General Formula (XI))

At a room temperature and in a stirring state, 29.07 g (0.25 mol) of triethyl silane is dropped for 1 hour into a 171 g solution of trifluoro acetic acid of 14.31 g (0.05 mol) of the 4,4'-dihydroxy -3,3'-diethylene diphenyl ether obtained by the synthesis example I-2. Then, the mixture is reacted for 4 hours under the same condition. Then, the reactant mixture is left at rest for cooling, and added on an ice/water. Extraction was carried out with dichloromethane. The dichloromethane phase was washed with water, and was dried with anhydrous magnesium sulfate. Then, the solvent was distilled. Then, the residue was subjected to a silica gel column chromatography using a mixture solvent of toluene/ethyl acetate (9/1), and then was refined using toluene for recrystallization, to thereby obtain 10.95 g (84.8%) of 4,4'-dihydroxy-3,3'-diethyl diphenyl ether.

Melting point: 85.5° C. to 86.5° C.

Element analysis value (%): Measured value/calculated value C, 74.42/74.40; H, 7.03/7.02.

EXAMPLE I-1

A solution obtained by dissolving 2.82 g of sodium hydroxide and 66 mg of sodium hydrosulfite into 28 ml of water in a nitrogen atmosphere was added to 3.64 g of the 4,4'-dihydroxy-3,3'-diethyl diphenyl ether (manufactured in the synthesis example I-3) and 64 mg of 4-tert-butylphenol. After stirring the above for 1 hour, a solution obtained by dissolving 1.68 g of bis(trichloromethyl)carbonate into 22 ml of methylene chloride was added thereto, followed by a strong stirring at 18° C. for 15 minutes. Thereafter, a triethyl amine (amount of catalyst) was added thereto for stirring at the room temperature for 1 hour. The content was diluted with methylene chloride. An organic layer was separated. Then, cleaning was carried out twice with ion exchange water. Then, cleaning was carried out with 2% of hydrochloric acid solution. Moreover, the ion exchange water was used for cleaning until conductivity of a cleaning solvent was substantially equal to that of the ion exchange water. The thus obtained organic layer was dropped into a large amount of methanol. Then, the thus obtained polymer was depressurized and dried at 80° C., to thereby obtain 2.64 g of an aromatic polycarbonate resin (No. 1) expressed by the following formula.

(Polycarbonate resin No. 1)

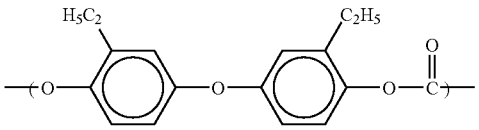

Element analysis value (%): Measured value/calculated value C, 77.77/71.82; H, 5.64/5.67.

Polystyrene conversion molecular weight by gel permeation chromatography

Number average molecular weight=42,000, weight average molecular weight=145,300

Figure 7:
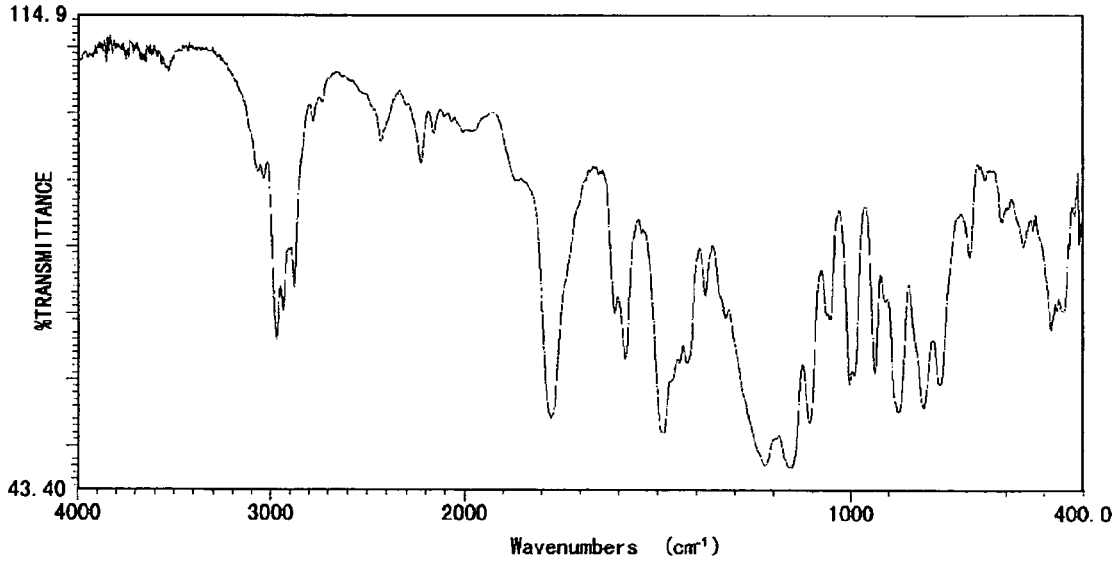
FIG. 7 shows an infrared absorption spectrum used for an example I-1 under the present invention.

FIG. 7 shows an infrared absorption spectrum.

CO telescopic vibration (carbonate bonding) $cm^{-1}$

EXAMPLE I-2

A solution obtained by dissolving 2.78 g of sodium hydroxide and 66 mg of sodium hydrosulfite into 27 ml of water in a nitrogen atmosphere was added to 2.30 g of the 4,4'-dihydroxy-3,3'-diethyl diphenyl ether (manufactured in the synthesis example I-3), 1.34 g of 1,1-bis(4-hydroxy phenyl)cyclohexane and 63 mg of 4-tert-butylphenol. After stirring the above for 1 hour, a solution obtained by dissolving 1.65 g of bis(trichloromethyl)carbonate into 22 ml of methylene chloride was added thereto, followed by a strong stirring at 18° C. for 15 minutes. Thereafter, a triethyl amine (amount of catalyst) was added thereto for stirring at the room temperature for 1 hour. The content was diluted with methylene chloride. An organic layer was separated. Then, cleaning was carried out twice with ion exchange water. Then, cleaning was carried out with 2% of hydrochloric acid solution. Moreover, the ion exchange water was used for cleaning until conductivity of a cleaning solvent was substantially equal to that of the ion exchange water. The thus obtained organic layer was dropped into a large amount of methanol. Then, the thus obtained polymer was depressurized and dried at 80° C., to thereby obtain 3.44 of an aromatic polycarbonate resin (No. 2) expressed by the following formula.

(Polycarbonate resin No. 2)

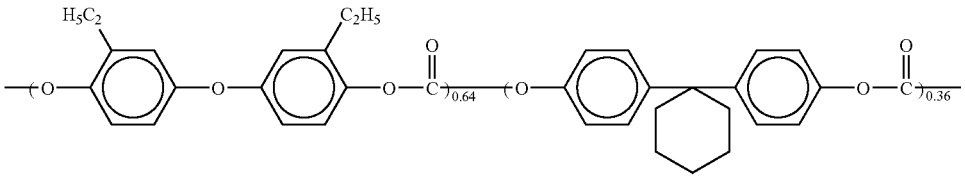

Element analysis value (%): Measured value/calculated value C, 73.85/73.91; H, 5.83/5.85.

Polystyrene conversion molecular weight by gel permeation chromatography

Number average molecular weight=33,600, weight average molecular weight=98,000

Figure 8:
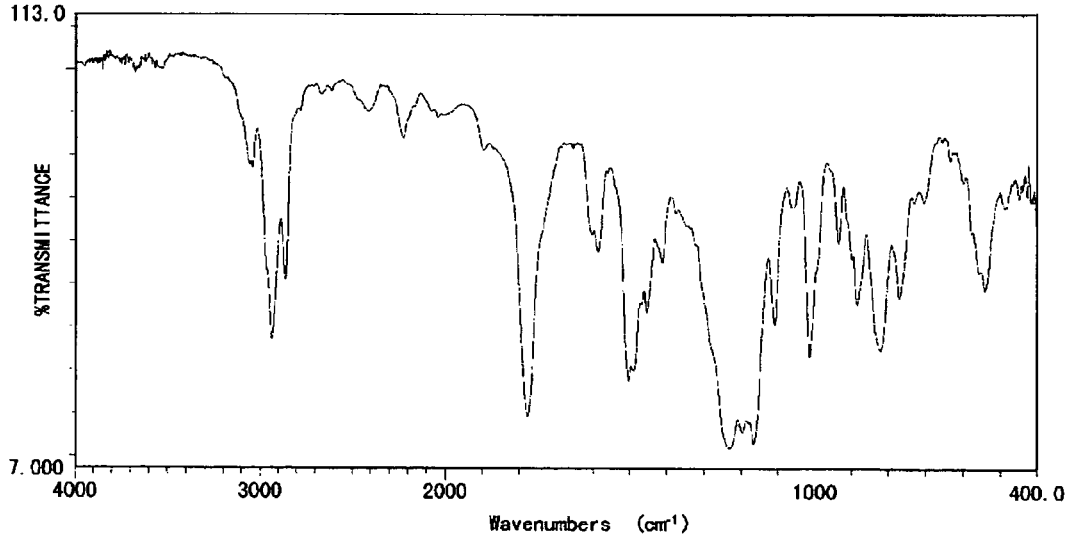
FIG. 8 shows an infrared absorption spectrum used for an example I-2 under the present invention.

FIG. 8 shows an infrared absorption spectrum.

CO telescopic vibration (carbonate bonding) $cm^{-1}$

EXAMPLE I-3

A solution obtained by dissolving 2.82 g of sodium hydroxide and 66 mg of sodium hydrosulfite into 27 ml of water in a nitrogen atmosphere was added to 2.30 g of the 4,4'-dihydroxy-3,3'-diethyl diphenyl ether (manufactured in the synthesis example I-3), 1.33 g of 2,2-bis(4-hydroxy-3-methylphenyl)propane and 64 mg of 4-tert-butylphenol. After stirring the above for 1 hour, a solution obtained by dissolving 1.67 g of bis(trichloromethyl)carbonate into 22 ml of methylene chloride was added thereto, followed by a strong stirring at 18° C. for 15 minutes. Thereafter, a triethyl amine (amount of catalyst) was added thereto for stirring at the room temperature for 1 hour. The content was diluted with methylene chloride. An organic layer was separated. Then, cleaning was carried out twice with ion exchange water. Then, cleaning was carried out with 2% of hydrochloric acid solution. Moreover, the ion exchange water was used for cleaning until conductivity of a cleaning solvent was substantially equal to that of the ion exchange water. The thus obtained organic layer was dropped into a large amount of methanol. Then, the thus obtained polymer was depressurized and dried at 80° C., to thereby obtain 3.44 g of an aromatic polycarbonate resin (No. 3) expressed by the following formula.

(Polycarbonate resin No. 3)

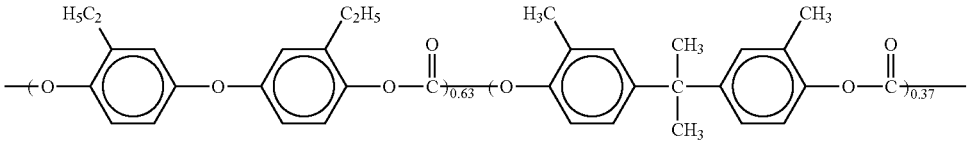

Element analysis value (%): Measured value/calculated value C, 73.59/73.56; H, 5.90/5.95.

Polystyrene conversion molecular weight by gel permeation chromatography

Number average molecular weight=31,600, weight average molecular weight=93,900

Figure 9:
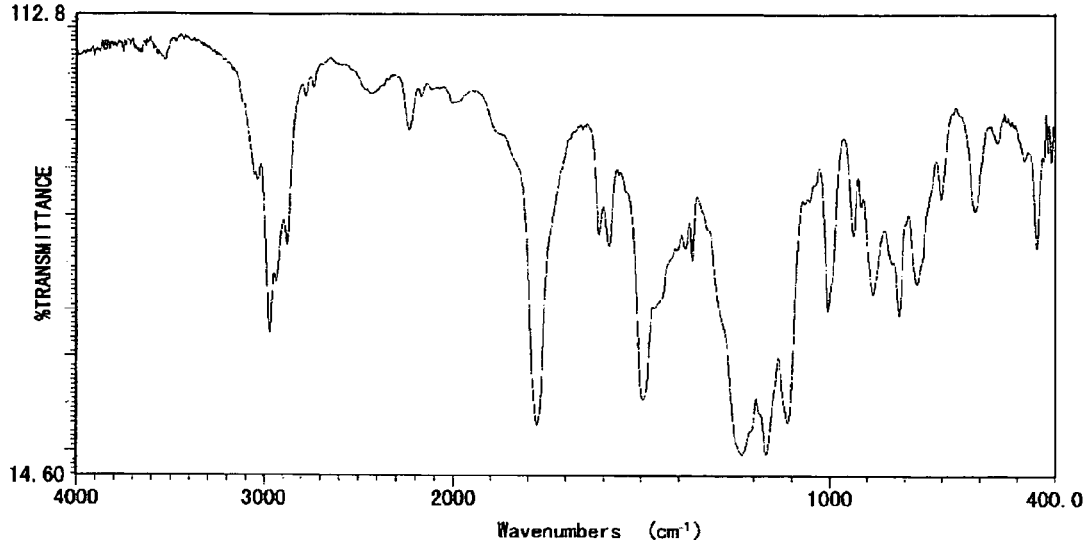
FIG. 9 shows an infrared absorption spectrum used for an example I-3 under the present invention.

FIG. 9 shows an infrared absorption spectrum.

CO telescopic vibration (carbonate bonding) $cm^{-1}$

EXAMPLE I-4

A solution obtained by dissolving 2.11 g of sodium hydroxide and 66 mg of sodium hydrosulfite into 27 ml of water in a nitrogen atmosphere was added to 1.57 g of the 4,4'-dihydroxy-3,3'-diethyl diphenyl ether (manufactured in the synthesis example I-3), 2.15 g of N-{4-[2,2-bis(4-hydroxy phenyl)vinyl]phenyl}-N,N-bis(4-tolyl)amine as a diol having charge transportability, and 79 mg of 4-tert-butylphenol. After stirring the above for 1 hour, a solution obtained by dissolving 1.25 g of bis(trichloromethyl)carbonate into 22 ml of methylene chloride was added thereto, followed by a strong stirring at 18° C. for 15 minutes. Thereafter, a triethyl amine (amount of catalyst) was added thereto for stirring at the room temperature for 1 hour. The content was diluted with methylene chloride. An organic layer was separated. Then, cleaning was carried out twice with ion exchange water. Then, cleaning was carried out with 2% of hydrochloric acid solution. Moreover, the ion exchange water was used for cleaning until conductivity of a cleaning solvent was substantially equal to that of the ion exchange water. The thus obtained organic layer was dropped into a large amount of methanol. Then, the thus obtained polymer was depressurized and dried at 80° C., to thereby obtain 3.51 g of an aromatic polycarbonate resin (No. 4) expressed by the following formula.

(Polycarbonate resin No. 4)

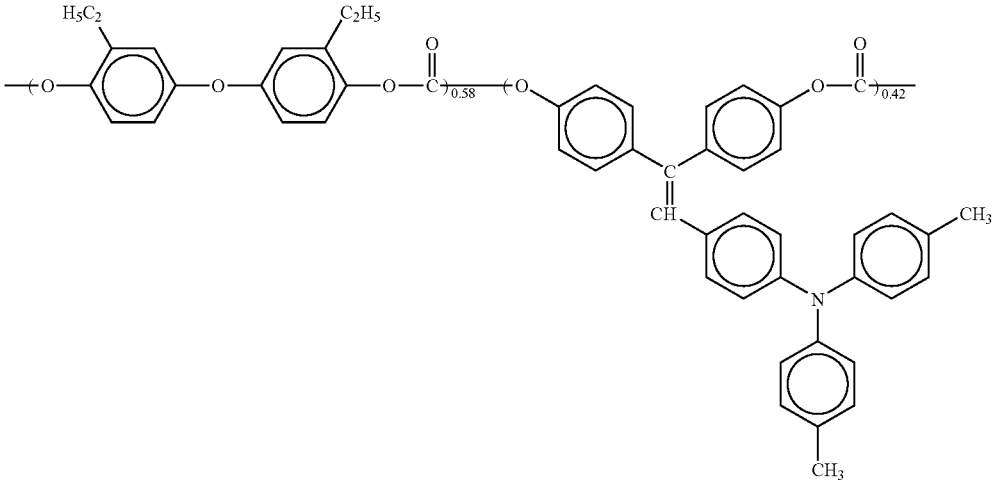

Element analysis value (%): Measured value/calculated value C, 77.97/77.87; H, 5.40/5.48; N, 1.59/1.56.

Polystyrene conversion molecular weight by gel permeation chromatography

Number average molecular weight=21,900, weight average molecular weight=98,600

Figure 10:
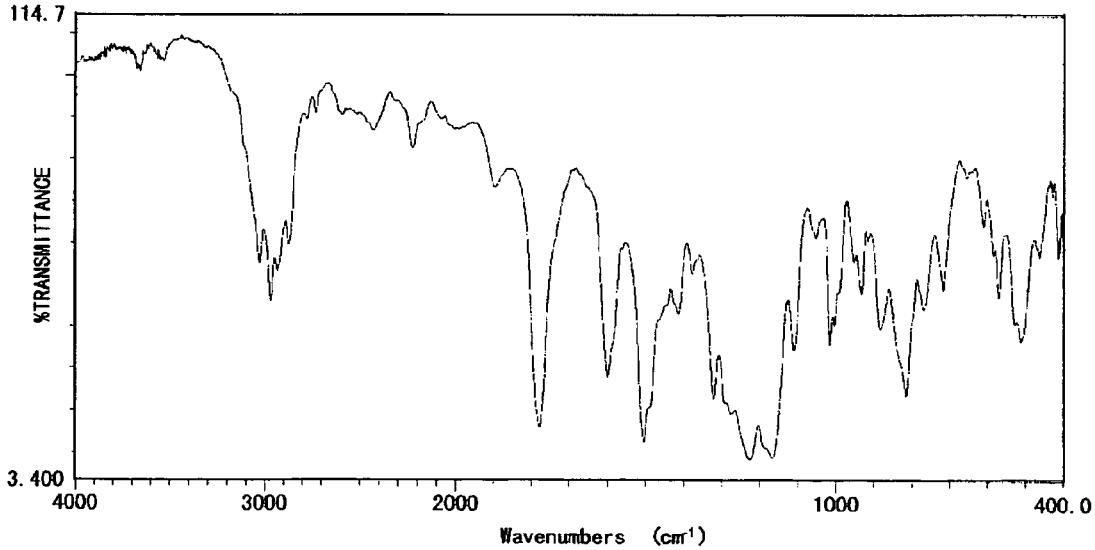
FIG. 10 shows an infrared absorption spectrum used for an example I-4 under the present invention.

FIG. 10 shows an infrared absorption spectrum.

CO telescopic vibration (carbonate bonding) $cm^{-1}$

MODIFIED EXAMPLE 1

Using a doctor blade, a polyamide resin (CM-8000 made by TORAY) solution was applied to an aluminum plate, followed by a natural drying to thereby obtain an intermediate layer having 0.3 μm in thickness. Herein, the polyamide resin (CM-8000 made by TORAY) solution had been dissolved in a methanol/butanol mixture solvent. On the intermediate layer, a dispersion liquid was coated using the doctor blade. Herein, the dispersion liquid had been obtained by pulverizing a bisazo compound, using a ball mill in a mixture solvent of cyclohexane and 2-butanone. The bisazo compound is expressed as a charge generating material by the following formula (P-1). After the coating, the dispersion liquid was naturally dried, to thereby form a charge generating layer having 0.5 μm in thickness.

Formula (P-1)

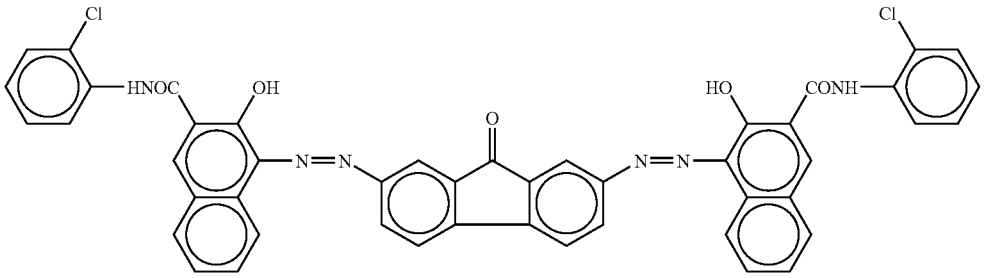

Next, one part of the charge transporting material expressed by the following structural formula (D-1) and one part of the polycarbonate resin (No. 3) which was obtained by the example I-3 were dissolved in 8 part of tetrahydrofuran. The thus obtained solution was applied to the charge generating layer using the doctor blade, followed by a natural drying, a drying at 80° C. for 5 minutes, and a drying at 120° C. for 20 minutes to form a charge transporting layer having 20 μm in thickness, to thereby obtain a photoconductor No. 1.

Structural formula (D-1)

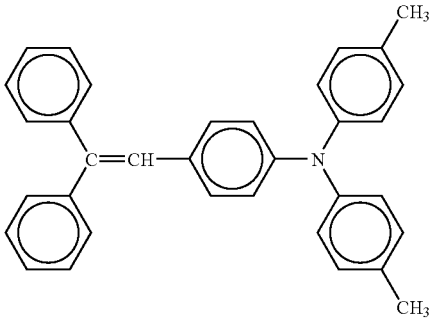

The thus obtained photoconductor No. 1 was charged using a commercially-available electrostatic copy paper tester (EPA-8200 made by Kawaguchi Electric Works Co., Ltd.) by applying thereto −6 KV of corona discharge for 20 seconds in a dark ambience, followed by another 20 seconds at rest in the dark ambience. Then, a surface potential $V_0$ (V) was measured. Then, a light from a tungsten lamp was irradiated such that the illumination on a surface of the photoconductor was 4.5 lux. The time (second) for ½ $V_0$ was measured and a luminous exposure $E_{1/2}$ (lux.sec) was calculated, resulting in $V_0$=−1020 V and $E_{1/2}$=0.99 lux-sec.

MODIFIED EXAMPLE 2

An intermediate layer and a charge generating layer like those obtained by the modified example 1 were formed. Next, one part of the polycarbonate resin (No. 4) which was obtained by the example I-4 was dissolved in 4 part of tetrahydrofuran. The thus obtained solution was applied to the charge generating layer using the doctor blade, followed by a natural drying, a drying at 80° C. for 5 minutes, and a drying at 120° C. for 20 minutes to form a charge transporting layer having 20 μm in thickness, to thereby obtain a photoconductor No. 2. The thus obtained photoconductor No. 2 was charged using a commercially-available electrostatic copy paper tester (EPA-8200 made by Kawaguchi Electric Works Co., Ltd.) by applying thereto −6 KV of corona discharge for 20 seconds in a dark ambience, followed by another 20 seconds at rest in the dark ambience. Then, a surface potential $V_0$ (V) was measured. Then, a light from a tungsten lamp was irradiated such that the illumination on a surface of the photoconductor was 4.5 lux. The time (second) for ½ $V_0$ was measured and a luminous exposure $E_{1/2}$ (lux·sec) was calculated, resulting in $V_0$=−996 V and $E_{1/2}$=0.96 lux·sec.

Described further below are examples II under the present invention.

Described at first is a manufacture example of the polymer under the present invention.

SYNTHESIS EXAMPLE II-1

Manufacture of 4,4'-diacetoxy diphenyl ether (a Compound Expressed by $A_1$=$CH_3$, $A_2$=$A_3$=$A_4$=$A_5$=$A_6$=$A_7$=H in the General Formula (XVIII))

At a room temperature and in a stirring state, one droplet of 95% of sulfuric acid is added into 80.88 g (0.4 mol) of 4,4'-diphenyl ether and 102.09 g (1 mol) of acetic anhydride, to be stirred at the room temperature for 2 hours. The thus obtained reactant is added on an ice/water. A crystal deposit is filtered, washed with water, dried, and then refined using ethanol for recrystallization, to thereby obtain 109.24 g (95.4%) of an object.

Melting point: 112.5° C. to 113.5° C.

Element analysis value (%): Measured value/calculated value C, 66.98/67.13; H, 4.98/4.93.

SYNTHESIS EXAMPLE II-2

Manufacture of 4,4'-dihydroxy-3,3'-diethylene diphenyl ether (a Compound Expressed by $A_1$=$CH_3$, $A_2$=$A_3$=$A_4$=$A_5$=$A_6$=$A_7$=H in the General Formula (XIX))

48 g (0.36 mol) of aluminum chloride (anhydrous) is added at once into a 150 ml solution of 1,1,2,2-tetrachloroethane of 28.63 g (0.1 mol) of the 4,4'-diacetoxy diphenyl ether obtained by the synthesis example II-1. Then, the reactant mixture is heated and stirred at 120° C. for 1 hour. Then, the reactant mixture is left at rest for cooling, and added on an ice/water. A hydrochloric acid is added to the reactant mixture. Extraction was carried out with dichloromethane. The dichloromethane phase was washed with water, and was dried with anhydrous magnesium sulfate. Then, the solvent was distilled. Then, the residue was refined using n-butanol for recrystallization, to thereby obtain 22.45 g (78.4%) of an object.

Melting point: 185.0° C. to 185.5° C.

Element analysis value (%): Measured value/calculated value C, 67.02/67.13; H, 4.91/4.93.

SYNTHESIS EXAMPLE II-3

Manufacture of 4,4'-dihydroxy-3,3'-diethyl diphenyl ether (a Compound Expressed by $A_1=CH_3$, $A_2=A_3=A_4=A_5=A_6=A_7=H$ in the General Formula (XI))

At a room temperature and in a stirring state, 29.07 g (0.25 mol) of triethyl silane is dropped for 1 hour into a 171 g solution of trifluoro acetic acid of 14.31 g (0.05 mol) of the 4,4'-dihydroxy -3,3'-diethylene diphenyl ether obtained by the synthesis example II-2. Then, the mixture is reacted for 4 hours under the same condition.

Then, the reactant mixture is left at rest for cooling, and added on an ice/water. Extraction was carried out with dichloromethane. The dichloromethane phase was washed with water, and was dried with anhydrous magnesium sulfate. Then, the solvent was distilled. Then, the residue was subjected to a silica gel column chromatography using a mixture solvent of toluene/ethyl acetate (9/1), and then was refined using toluene for recrystallization, to thereby obtain 10.95 g (84.8%) of 4,4'-dihydroxy-3,3'-diethyl diphenyl ether.

Melting point: 85.5° C. to 86.5° C.

Element analysis value (%): Measured value/calculated value C, 74.42/74.40; H, 7.03/7.02.

SYNTHESIS EXAMPLE II-4

A solution obtained by dissolving 2.82 g of sodium hydroxide and 66 mg of sodium hydrosulfite into 28 ml of water in a nitrogen atmosphere was added to 3.64 g of the 4,4'-dihydroxy-3,3'-diethyl diphenyl ether (manufactured in the synthesis example II-3) and 64 mg of 4-tert-butylphenol. After stirring the above for 1 hour, a solution obtained by dissolving 1.68 g of bis(trichloromethyl)carbonate into 22 ml of methylene chloride was added thereto, followed by a strong stirring at 18° C. for 15 minutes. Thereafter, a triethyl amine (amount of catalyst) was added thereto for stirring at the room temperature for 1 hour. The content was diluted with methylene chloride. An organic layer was separated. Then, cleaning was carried out twice with ion exchange water. Then, cleaning was carried out with 2% of hydrochloric acid solution. Moreover, the ion exchange water was used for cleaning until conductivity of a cleaning solvent was substantially equal to that of the ion exchange water. The thus obtained organic layer was dropped into a large amount of methanol. Then, the thus obtained polymer was depressurized and dried at 80° C., to thereby obtain 2.64 g of an aromatic polycarbonate resin (No. 1) expressed by the following formula.

(Polycarbonate resin No. 1)

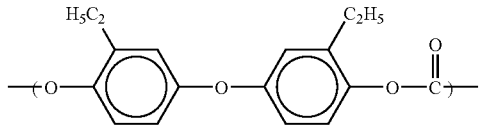

Element analysis value (%): Measured value/calculated value C, 77.77/71.82; H, 5.64/5.67.

Polystyrene conversion molecular weight by gel permeation chromatography

Number average molecular weight=42,000, weight average molecular weight=145,300

SYNTHESIS EXAMPLE II-5

A solution obtained by dissolving 2.78 g of sodium hydroxide and 66 mg of sodium hydrosulfite into 27 ml of water in a nitrogen atmosphere was added to 2.30 g of the 4,4'-dihydroxy-3,3'-diethyl diphenyl ether (manufactured in the synthesis example II-3), 1.34 g of 1,1-bis(4-hydroxy phenyl)cyclohexane and 63 mg of 4-tert-butylphenol. After stirring the above for 1 hour, a solution obtained by dissolving 1.65 g of bis(trichloromethyl)carbonate into 22 ml of methylene chloride was added thereto, followed by a strong stirring at 18° C. for 15 minutes. Thereafter, a triethyl amine (amount of catalyst) was added thereto for stirring at the room temperature for 1 hour. The content was diluted with methylene chloride. An organic layer was separated. Then, cleaning was carried out twice with ion exchange water. Then, cleaning was carried out with 2% of hydrochloric acid solution. Moreover, the ion exchange water was used for cleaning until conductivity of a cleaning solvent was substantially equal to that of the ion exchange water. The thus obtained organic layer was dropped into a large amount of methanol. Then, the thus obtained polymer was depressurized and dried at 80° C., to thereby obtain 3.44 g of an aromatic polycarbonate resin (No. 2) expressed by the following formula.

(Polycarbonate resin No. 2)

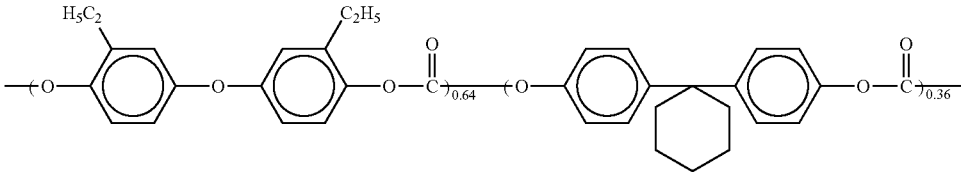

Element analysis value (%): Measured value/calculated value C, 73.85/73.91; H, 5.83/5.85.

Polystyrene conversion molecular weight by gel permeation chromatography

Number average molecular weight=33,600, weight average molecular weight=98,000

Figure 11:
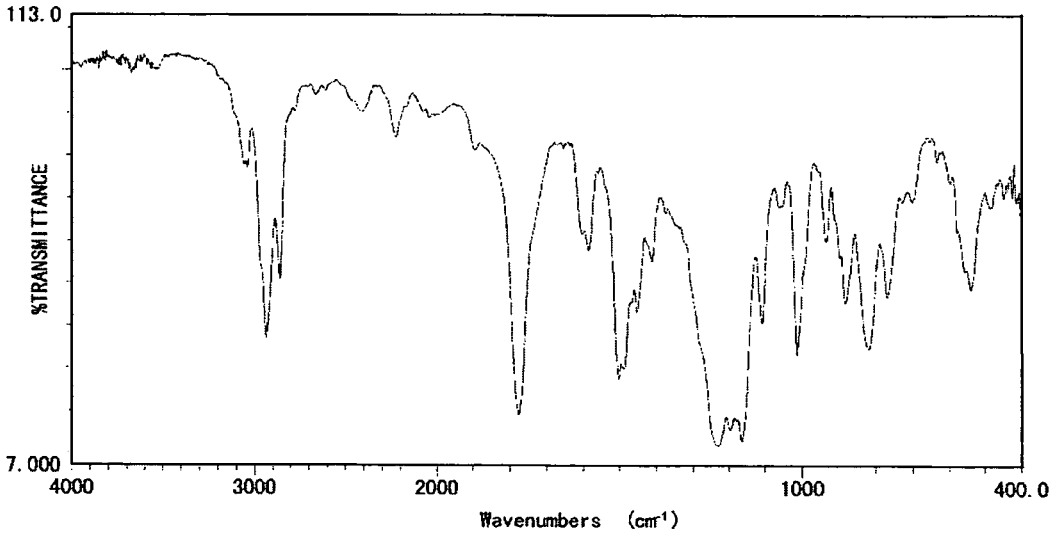
FIG. 11 shows an infrared absorption spectrum used for a synthesis example II-5 under the present invention.

FIG. 11 shows an infrared absorption spectrum.

CO telescopic vibration (carbonate bonding) $cm^{-1}$

SYNTHESIS EXAMPLE II-6

A solution obtained by dissolving 2.82 g of sodium hydroxide and 66 mg of sodium hydrosulfite into 27 ml of water in a nitrogen atmosphere was added to 2.30 g of the 4,4'-dihydroxy-3,3'-diethyl diphenyl ether (manufactured in the synthesis example II-3), 1.33 g of 2,2-bis(4-hydroxy-3-methylphenyl)propane and 64 mg of 4-tert-butylphenol. After stirring the above for 1 hour, a solution obtained by dissolving 1.67 g of bis(trichloromethyl)carbonate into 22 ml of methylene chloride was added thereto, followed by a strong stirring at 18° C. for 15 minutes. Thereafter, a triethyl amine (amount of catalyst) was added thereto for stirring at the room temperature for 1 hour. The content was diluted with methylene chloride. An organic layer was separated. Then, cleaning was carried out twice with ion exchange water. Then, cleaning was carried out with 2% of hydrochloric acid solution. Moreover, the ion exchange water was used for cleaning until conductivity of a cleaning solvent was substantially equal to that of the ion exchange water. The thus obtained organic layer was dropped into a large amount of methanol. Then, the thus obtained polymer was depressurized and dried at 80° C., to thereby obtain 3.44 g of an aromatic polycarbonate resin (No. 3) expressed by the following formula.

(Polycarbonate resin No. 3)

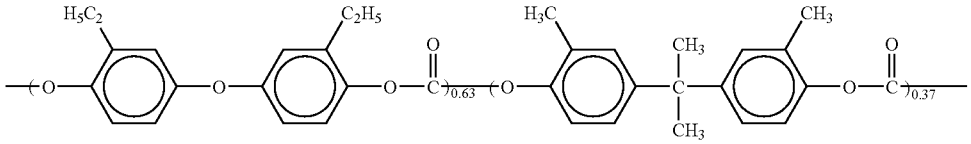

Element analysis value (%): Measured value/calculated value C, 73.59/73.56; H, 5.90/5.95.

Polystyrene conversion molecular weight by gel permeation chromatography

Number average molecular weight=31,600, weight average molecular weight=93,900

SYNTHESIS EXAMPLE II-7

A solution obtained by dissolving 2.11 g of sodium hydroxide and 66 mg of sodium hydrosulfite into 27 ml of water in a nitrogen atmosphere was added to 2.15 g of N-{4-[2,2-bis(4-hydroxy phenyl)vinyl]phenyl}-N,N-bis(4-tolyl)amine as a diol having charge transportability, 1.57 g of the 4,4'-dihydroxy-3,3'-diethyl diphenyl ether, and 79 mg of 4-tert-butylphenol. After stirring the above for 1 hour, a solution obtained by dissolving 1.25 g of bis(trichloromethyl)carbonate into 22 ml of methylene chloride was added thereto, followed by a strong stirring at 18° C. for 15 minutes. Thereafter, a triethyl amine (amount of catalyst) was added thereto for stirring at the room temperature for 1 hour. The content was diluted with methylene chloride. An organic layer was separated. Then, cleaning was carried out twice with ion exchange water. Then, cleaning was carried out with 2% of hydrochloric acid solution. Moreover, the ion exchange water was used for cleaning until conductivity of a cleaning solvent was substantially equal to that of the ion exchange water. The thus obtained organic layer was dropped into a large amount of methanol. Then, the thus obtained polymer was depressurized and dried at 80° C., to thereby obtain 3.51 g of an aromatic polycarbonate resin (No. 4) expressed by the following formula.

(Polycarbonate resin No. 4)

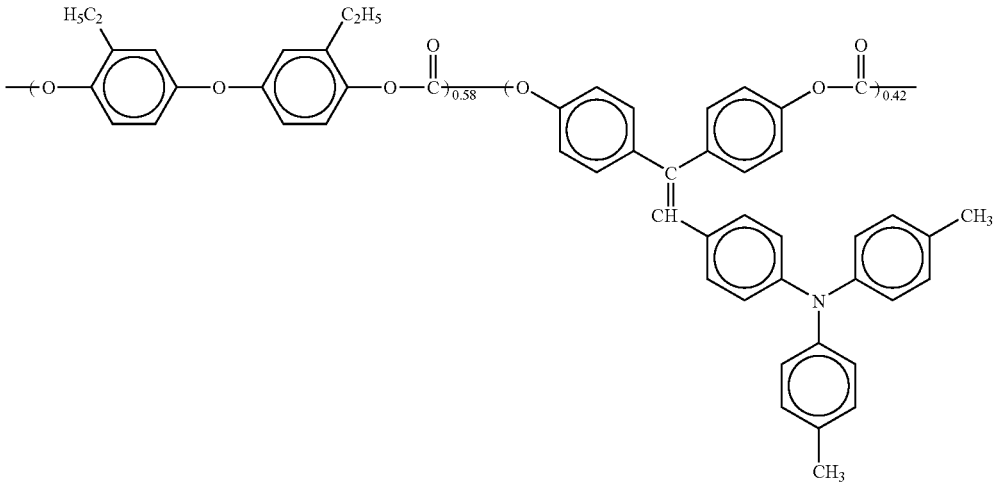

Element analysis value (%): Measured value/calculated value C, 77.97/77.87; H, 5.40/5.48; N, 1.59/1.56.

Polystyrene conversion molecular weight by gel permeation chromatography

Number average molecular weight=21,900, weight average molecular weight=98,600

EXAMPLE II-1

Using a doctor blade, a polyamide resin (CM-8000 made by TORAY) solution was applied to an aluminum plate, followed by a drying at 100° C. for 5 minutes to thereby obtain an intermediate layer having 0.5 μm in thickness. Herein, the polyamide resin (CM-8000 made by TORAY) solution had been dissolved in a methanol/butanol mixture solvent. On the intermediate layer, a dispersion liquid was coated using the doctor blade. Herein, the dispersion liquid had been obtained by pulverizing a bisazo compound, using a ball mill in a mixture solvent of cyclohexane and 2-butanone. The bisazo compound is expressed as a charge generating material by the following formula (P-1). After the coating, the dispersion liquid was naturally dried, to thereby form a charge generating layer having 0.5 μm in thickness.

Formula (P-1)

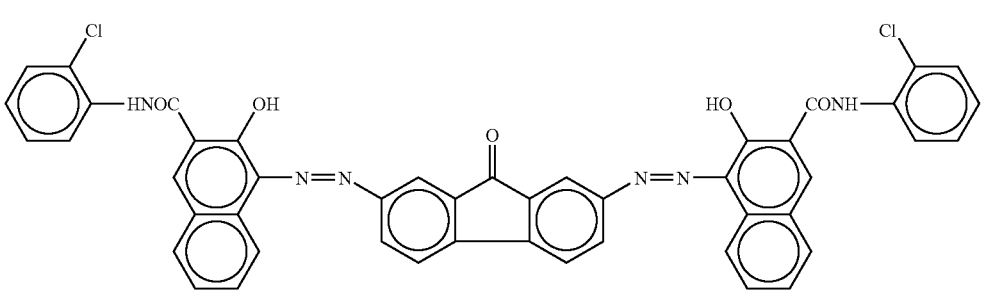

Next, one part of the charge transporting material expressed by the following structural formula (D-1) and one part of the polycarbonate resin (No. 1) which was obtained by the synthesis example II-4 were dissolved in 8 part of tetrahydrofuran. The thus obtained solution was applied to the charge generating layer using the doctor blade, followed by a natural drying, a drying at 80° C. for 5 minutes, and a drying at 120° C. for 20 minutes to form a charge transporting layer having 20 μm in thickness, to thereby obtain a photoconductor No. 1.

Structural formula (D-1)

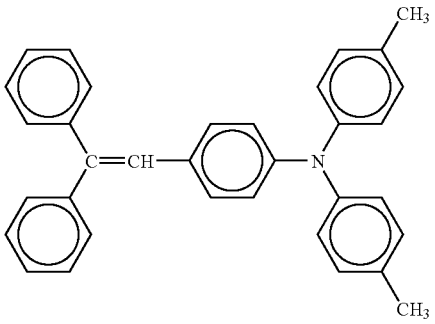

EXAMPLE II-2

The example II-1 was basically repeated, except that the polycarbonate resin (No. 1) obtained by the synthesis example II-4 was replaced with the polycarbonate resin (No. 2) obtained by the synthesis example 11-5, to thereby form a photoconductor No. 2.

EXAMPLE II-3

The example II-1 was basically repeated, except that the polycarbonate resin (No. 1) obtained by the synthesis example II-4 was replaced with the polycarbonate resin (No. 3) obtained by the synthesis example II-6, to thereby form a photoconductor No. 3.

EXAMPLE II-4

After forming an intermediate layer and a charge generating layer like those of the example II-1, one part of the polycarbonate resin (No. 4) having the charge transportability and obtained by the synthesis example II-7 was dissolved in four parts of tetrahydrofuran. The thus obtained solution was applied to a surface of the charge generating layer using the doctor blade, followed by a natural drying, a drying at 80° C. for 5 minutes, a drying at 120° C. for 20 minutes to form a charge transporting layer having 20 μm in thickness, to thereby form a photoconductor No. 4.

COMPARATIVE EXAMPLE II-1

The example II-1 was basically repeated, except that the polycarbonate resin (No. 1) obtained by the synthesis example II-4 was replaced with a polycarbonate Z (PC-Z made by Teijin Chemicals Ltd.), to thereby form a photoconductor No. 5.

EXAMPLE II-5

The example II-1 was basically repeated, except that the following steps were taken in terms of a charge generating layer:

As a charge generating material, 3 parts of X-type nonmetal phthalocyanine and 2 parts of polyvinyl butyral resin (BM-S made by Sekisui Chemical Co., Ltd.) were pulverized in 328 parts of tetrahydrofuran solvent using a ball mill. The thus obtained dispersion liquid was applied using the doctor blade, followed by a natural drying, to thereby form the charge generating layer having 0.5 μm in thickness. With the above, a photoconductor No. 6 was formed.

EXAMPLE II-6

The example II-2 was basically repeated, except that the following steps were taken in terms of a charge generating layer:

As a charge generating material, 3 parts of X-type nonmetal phthalocyanine and 2 parts of polyvinyl butyral resin (BM-S made by Sekisui Chemical Co., Ltd.) were pulverized in 328 parts of tetrahydrofuran solvent using a ball mill. The thus obtained dispersion liquid was applied using the doctor blade, followed by a natural drying, to thereby form the charge generating layer having 0.5 μm in thickness. With the above, a photoconductor No. 7 was formed.

EXAMPLE II-7

The example II-3 was basically repeated, except that the following steps were taken in terms of a charge generating layer:

As a charge generating material, 3 parts of X-type nonmetal phthalocyanine and 2 parts of polyvinyl butyral resin (BM-S made by Sekisui Chemical Co., Ltd.) were pulverized in 328 parts of tetrahydrofuran solvent using a ball mill. The thus obtained dispersion liquid was applied using the doctor blade, followed by a natural drying, to thereby form the charge generating layer having 0.5 μm in thickness. With the above, a photoconductor No. 8 was formed.

EXAMPLE II-8

The example II-4 was basically repeated, except that the following steps were taken in terms of a charge generating layer:

As a charge generating material, 3 parts of X-type nonmetal phthalocyanine and 2 parts of polyvinyl butyral resin (BM-S made by Sekisui Chemical Co., Ltd.) were pulverized in 328 parts of tetrahydrofuran solvent using a ball mill. The thus obtained dispersion liquid was applied using the doctor blade, followed by a natural drying, to thereby form the charge generating layer having 0.5 μm in thickness. With the above, a photoconductor No. 9 was formed.

COMPARATIVE EXAMPLE II-2

The example II-2 was basically repeated, except that the polycarbonate resin (No. 2) obtained by the synthesis example II-5 was replaced with a polycarbonate Z (PC-Z made by Teijin Chemicals Ltd.), to thereby form a photoconductor No. 10.

The laminated electrophotographic photoconductors prepared in the examples II-and the comparative examples II-were subjected to measurements of their electrostatic properties. More specifically, the photoconductor No. 1 to the photoconductor No. 10 were charged using a commercially-available electrostatic copy paper tester (EPA-8200 made by Kawaguchi Electric Works Co., Ltd.) by applying thereto −6 KV of corona discharge for 20 seconds in a dark ambience, followed by another 20 seconds at rest in the dark ambience. Then, a surface potential $V_0$ (V) was measured. Then, a light from a tungsten lamp was irradiated such that the illumination on a surface of the photoconductor was 4.5 lux. The time (second) for ½ $V_0$ was measured and a luminous exposure $E_{1/2}$ (lux sec) was calculated. The results are shown in table 1.

TABLE 1

| | Photoconductor No. | $V_0$ (V) | $E_{1/2}$ (lux · sec) |
|---|---|---|---|
| Example 1 | No. 1 | 1226 | 1.05 |
| Example 2 | No. 2 | 1116 | 1.02 |
| Example 3 | No. 3 | 1020 | 0.99 |
| Example 4 | No. 4 | 966 | 0.96 |
| Comparative example 1 | No. 5 | 943 | 1.08 |
| Example 5 | No. 6 | 987 | 1.04 |
| Example 6 | No. 7 | 908 | 0.99 |
| Example 7 | No. 8 | 892 | 0.99 |
| Example 8 | No. 9 | 759 | 0.96 |
| Comparative example 2 | No. 10 | 727 | 1.10 |

EXAMPLE II-9

Using a doctor blade, a polyamide resin (CM-8000 made by TORAY) solution was applied to an aluminum plate, followed by a drying at 100° C. for 5 minutes to thereby obtain an intermediate layer having 0.5 μm in thickness. Herein, the polyamide resin (CM-8000 made by TORAY) solution had been dissolved in a methanol/butanol mixture solvent. Next, using a ball mill, one part of the X-type nonmetal phthalocyanine was dispersed with a solution which is constituted of one part of the polycarbonate resin (No. 1) obtained by the synthesis example II-4 and 38 parts of tetrahydrofuran. Then, a low molecular charge transporting material, an acceptor compound, tetrahydrofuran, and a silicone oil were added such that the following could be obtained: i) 2 weight % of pigment composition, ii) 50 weight % of PC-Z composition, iii) 30 weight % of low molecular charge transporting material expressed by the above structural formula (D-1), iv) 18 weight % of acceptor compound expressed by the following structural formula (E-1), and v) 0.001 weight % of silicone oil (KF50 made by Shin-Etsu Chemical Co., Ltd.). With this, a photoconductor coating solution having its solid content of 20 weight % was prepared. The thus prepared photoconductor coating solution was applied to the intermediate layer using the doctor blade, followed by a drying at 80° C. for 5 minutes and a drying at 120° C. for 20 minutes, to thereby form a photoconductor No. 11 (monolayer electrophotographic photoconductor) having 20 μm in thickness.

Structural formula (E-1)

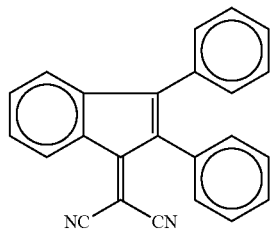

EXAMPLE II-10

The example II-9 was basically repeated, except that the polycarbonate resin (No. 1) obtained by the synthesis example II-4 was replaced with the polycarbonate resin (No. 2) obtained by the synthesis example II-5, to thereby form a photoconductor No. 12 in substantially the same manner as that of the embodiment II-9.

EXAMPLE II-11

The example II-9 was basically repeated, except that the polycarbonate resin (No. 1) obtained by the synthesis example II-4 was replaced with the polycarbonate resin (No. 3) obtained by the synthesis example II-6, to thereby form a photoconductor No. 13 in substantially the same manner as that of the embodiment II-9.

EXAMPLE II-12

On an intermediate layer substantially the same as that in the example II-9, the following steps were taken. Using a ball mill, one part of the X-type nonmetal phthalocyanine was dispersed with a solution which is constituted of one part of the polycarbonate resin (No. 4) having the charge transportability and obtained by the synthesis example II-7 and 38 parts of tetrahydrofuran. Then, the polycarbonate resin (No. 4) having charge transportability, an acceptor compound, tetrahydrofuran, and a silicone oil were added such that the following could be obtained: i) 2 weight % of pigment composition, ii) 60 weight % of polycarbonate resin (No. 4) having charge transportability, iii) 18 weight % of acceptor compound expressed by the above structural formula (E-1), and v) 0.001 weight % of silicone oil (KF50 made by Shin-Etsu Chemical Co., Ltd.). With this, a photoconductor coating solution having its solid content of 20 weight % was prepared. The thus prepared photoconductor coating solution was applied to the intermediate layer using the doctor blade, followed by a drying at 80° C. for 5 minutes and a drying at 120° C. for 20 minutes, to thereby form a photoconductor No. 14 (monolayer electrophotographic photoconductor) having 20 μm in thickness.

COMPARATIVE EXAMPLE II-3

The example II-11 was basically repeated, except that the polycarbonate resin (No. 3) obtained by the synthesis example II-6 was replaced with the polycarbonate Z (PC-Z made by Teijin Chemicals Ltd.), to thereby form a photoconductor No. 15 in substantially the same manner as that of the embodiment II-1.

<Evaluation 1>

The monolayer electrophotographic photoconductors prepared in the examples II- and the comparative examples II- were subjected to measurements of their electrostatic properties. More specifically, the photoconductor No. 11 to the photoconductor No. 15 were charged using a commercially-available electrostatic copy paper tester (EPA-8200 made by Kawaguchi Electric Works Co., Ltd.) by applying thereto +6 KV for 20 seconds, followed by another 20 seconds at rest in the dark ambience. Then, a surface potential $V_0$ (V) was measured. Then, a monochrome light having wavelength of 780 nm was irradiated such that the illumination on a surface of the photoconductor was 2.5 μW/cm$^2$. A half luminous exposure $Em_{1/2}$ (μJ/cm$^2$) for changing the surface potential of the photoconductor from 800 V to 400 V was measured as a sensitivity of an LD light source region (near infrared). Table 2 shows the results.

TABLE 2

| | Photoconductor No. | $V_0$ (V) | $Em_{1/2}$ (μJ/cm$^2$) |
|---|---|---|---|
| Example 9 | No. 11 | 915 | 0.33 |
| Example 10 | No. 12 | 986 | 0.33 |
| Example 11 | No. 13 | 947 | 0.32 |
| Example 12 | No. 14 | 851 | 0.30 |

TABLE 2-continued

| | Photoconductor No. | $V_0$ (V) | $Em_{1/2}$ (μJ/cm$^2$) |
|---|---|---|---|
| Comparative example 3 | No. 15 | 866 | 0.35 |

<Evaluation 2>

The monolayer electrophotographic photoconductors prepared in the example II-11 (photoconductor No. 13), the example II-12 (photoconductor No. 14) and the comparative example II-3 (photoconductor No. 15) were mounted to a drum having a linear speed of 260 mm/s. Plus chargings, exposures, and light quenchings were repeated 5000 times, to thereby measure charge potential Vd (V) and post-exposure potential V1 (V) in an initial step and after the 5000 repetitions.

The results are shown in table 3.

TABLE 3

| | Charge potential Vd (V) | | Post-exposure potential Vl (V) | |
|---|---|---|---|---|
| | Initial | After 5000 repetitions | Initial | After 5000 repetitions |
| Example 11 | 964 | 883 | 41 | 69 |
| Example 12 | 856 | 791 | 35 | 57 |
| Comparative example 3 | 941 | 825 | 36 | 80 |

Hereinafter described are an example III-1 to an example III-3 under the present invention. The present invention is, however, not limited thereto.

EXAMPLE III-1

Manufacture of 4,4'-diacetoxy diphenyl ether (a Compound Expressed by $R_1$=$CH_3$, $R_2$=$R_3$=$R_4$=$R_5$=$R_6$=$R_7$=H in the General Formula XVIII)

Figure 12:
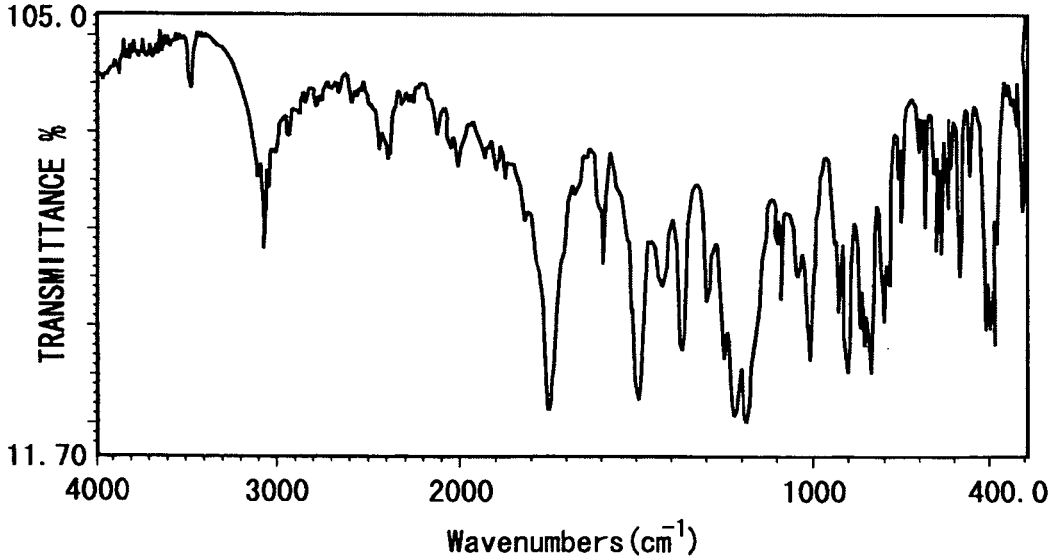
FIG. 12 shows an infrared absorption spectrum of 4,4'-diacetoxy diphenyl ether.

At a room temperature and in a stirring state, one droplet of 95% of sulfuric acid is added into 80.88 g (0.4 mol) of 4,4'-diphenyl ether and 102.09 g (1 mol) of acetic anhydride, to be stirred at the room temperature for 2 hours. The thus obtained reactant is added on an ice/water. A crystal deposit is filtered, washed with water, dried, and then refined using ethanol for recrystallization, to thereby obtain 109.24 g (95.4%) of an object. Melting point was 112.5° C. to 113.5° C. FIG. 12 shows an infrared absorption spectrum of the compound. Results of the element analyses are shown below, which substantially coincide with those calculated from the structural formula.

| | | |
|---|---|---|
| Measured value | C = 66.98% | H = 4.98% |
| Calculated value | C = 67.13% | H = 4.93% |

EXAMPLE III-2

Manufacture of 4,4'-dihydroxy-3,3'-diethylene diphenyl ether (a Compound Expressed by $R_1=CH_3$, $R_2=R_3=R_4=R_5=R_6=R_7=H$ in the General Formula XIX)

Figure 13:
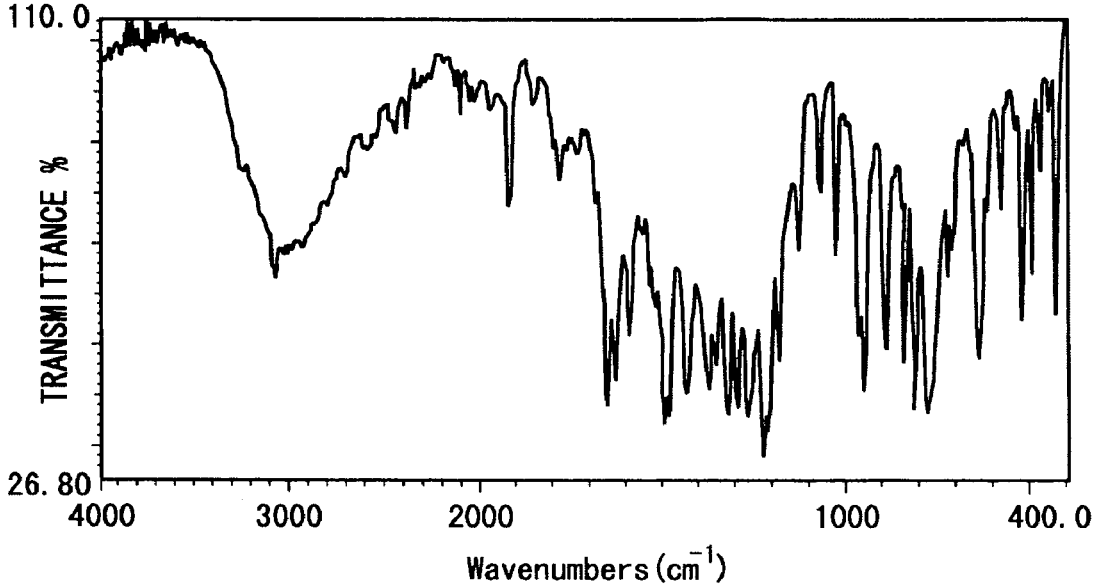
FIG. 13 shows an infrared absorption spectrum of 4,4'-dihydroxy-3,3'-diethylene diphenyl ether.

48 g (0.36 mol) of aluminum chloride (anhydrous) is added at once into a 150 ml solution of 1,1,2,2-tetrachloroethane of 28.63 g (0.1 mol) of the 4,4'-diacetoxy diphenyl ether obtained by the example III-1. Then, the reactant mixture is heated and stirred at 120° C. for 1 hour. Then, the reactant mixture is left at rest for cooling, and added on an ice/water. A hydrochloric acid is added to the reactant mixture. Extraction was carried out with dichloromethane. The dichloromethane phase was washed with water, and was dried with anhydrous magnesium sulfate. Then, the solvent was distilled. Then, the residue was refined using n-butanol for recrystallization, to thereby obtain 22.45 g (78.4%) of an object. Melting point was 185.0° C. to 185.5° C. FIG. 13 shows an infrared absorption spectrum of the compound. Results of the element analyses are shown below, which substantially coincide with those calculated from the structural formula.

| | | |
|---|---|---|
| Measured value | C = 67.02% | H = 4.91% |
| Calculated value | C = 67.13% | H = 4.93% |

EXAMPLE III-3

Manufacture of 4,4'-dihydroxy-3,3'-diethyl diphenyl ether (a Compound Expressed by $R_1=CH_3$, $R_2=R_3=R_4=R_5=R_6=R_7=H$ in the General Formula XI)

Figure 14:
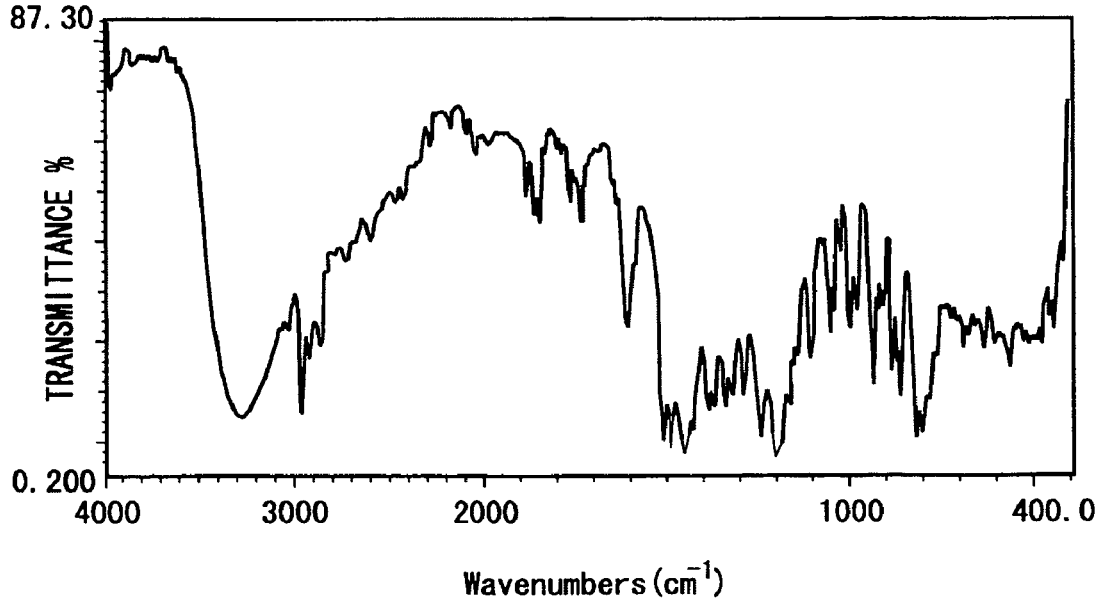
FIG. 14 shows an infrared absorption spectrum of 4,4'-dihydroxy-3,3'-diethyl diphenyl ether.

At a room temperature and in a stirring state, 29.07 g (0.25 mol) of triethyl silane is dropped for 1 hour into a 171 g solution of trifluoro acetic acid of 14.31 g (0.05 mol) of the 4,4'-dihydroxy-3,3'-diethylene diphenyl ether obtained by the example III-2. Then, the mixture is reacted for 4 hours under the same condition. Then, the reactant mixture is left at rest for cooling, and added on an ice/water. Extraction was carried out with dichloromethane. The dichloromethane phase was washed with water, and was dried with anhydrous magnesium sulfate. Then, the solvent was distilled. Then, the residue was subjected to a silica gel column chromatography using a mixture solvent of toluene/ethyl acetate (9/1), and then was refined using toluene for recrystallization, to thereby obtain 10.95 g (84.8%) of 4,4'-dihydroxy-3,3'-diethyl diphenyl ether. Melting point was 85.5° C. to 86.5° C. FIG. 14 shows an infrared absorption spectrum of the compound. Results of the element analyses are shown below, which substantially coincide with those calculated from the structural formula.

| | | |
|---|---|---|
| Measured value | C = 74.42% | H = 7.03% |
| Calculated value | C = 74.40% | H = 7.02% |

What is claimed is:

1. An electrophotographic photoconductor, comprising:

a conductive substrate; and a photoconductive layer which is formed on the conductive substrate and comprises a polycarbonate resin, wherein the polycarbonate resin comprises a constitutional unit expressed by the following general formula (II):

General formula (II)

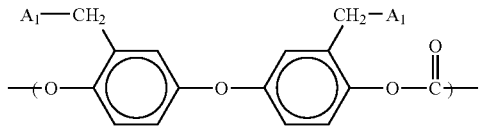

wherein $A_1$ represents a methyl group.

2. The electrophotographic photoconductor according to claim 1, wherein the polycarbonate resin having the constitutional unit expressed by the general formula (II) further comprises a constitutional unit expressed by the following general formula (III):

General formula (III)

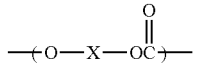

wherein a composition ratio k of the constitutional unit expressed by the general formula (II) and a composition ratio j of the constitutional unit expressed by the general formula (III) satisfy the following expression:

$0<k/(k+j)\leqq 1$, wherein X represents one of an aliphatic divalent group, an alicyclic divalent group, an aromatic divalent group, and a divalent group which is made by bonding the divalent groups selected from the aliphatic divalent group, the alicyclic divalent group and the aromatic divalent group, wherein X otherwise represents at least one of the following:

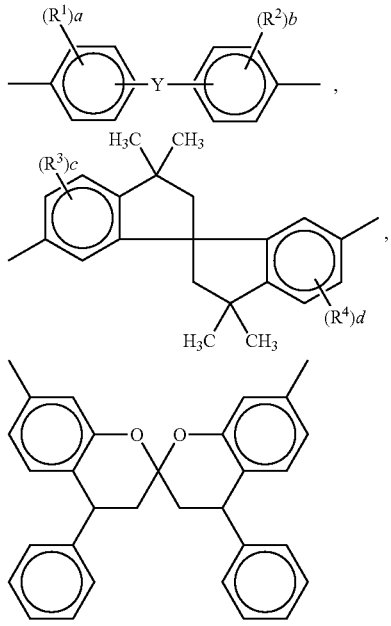

wherein $R^1$, $R^2$, $R^3$ and $R^4$ each represent one of an alkyl group which is substitutional or nonsubstitutional, an aryl group which is substitutional or nonsubstitutional, and a halogen atom, wherein a and b each represent an integer of 0 to 4, wherein c and d each represent an integer of 0 to 3, wherein Y is selected from:

a single bond, a straight chain alkylene group having 2 to 12 carbon atoms, a branched alkylene group having 3 to 12 carbon atoms, a polyoxy alkylene group having 3 to 12 carbon atoms,

—O—, —S—, —SO—, —SO2—, —CO—,

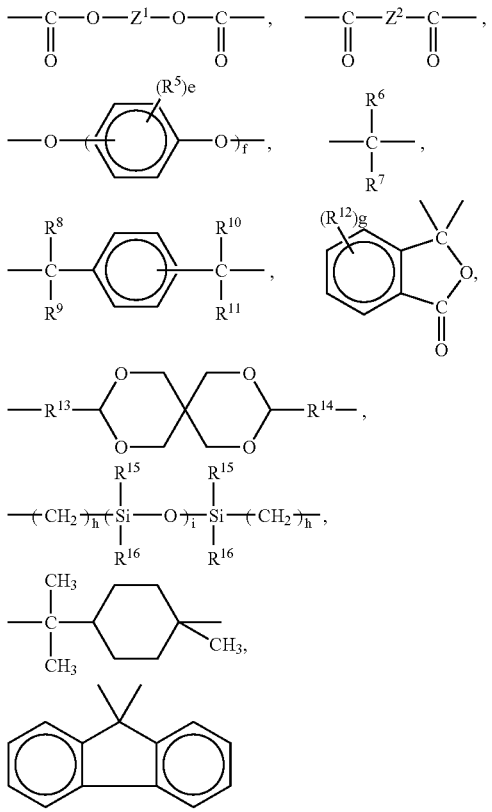

wherein $Z^1$ and $Z^2$ represent one of an aliphatic divalent group which is substitutional or nonsubstitutional, and an allylene group which is substitutional or nonsubstitutional, wherein $R^6$, $R^7$, $R^8$, $R^9$, $R^{10}$, $R^{11}$ and $R^{12}$ each represent one of a hydrogen atom, a halogen atom, an alkyl group which has 1 to 5 carbon atoms and is substitutional or nonsubstitutional, an alkoxy group which has 1 to 5 carbon atoms and is substitutional or nonsubstitutional, and a phenyl group which is substitutional or nonsubstitutional, wherein $R^6$ and $R^7$ may be bonded with each other to form one of a carbon ring having 5 to 12 carbon atoms, and a heterocyclic ring having 5 to 12 carbon atoms, wherein $R^6$ and $R^7$ may form one of a carbon ring and a heterocyclic ring in cooperation with $R_2$ and $R_3$, wherein $R^{13}$ and $R^{14}$ represent one of a single bond, an alkylene group having 1 to 4 carbon atoms, and a polyoxy alkylene group having 1 to 4 carbon atoms, wherein each of $R^{15}$ and $R^{16}$ is one of an alkyl group which has 1 to 5 carbon atoms and is substitutional or nonsubstitutional, and an aryl group which is substitutional or nonsubstitutional, wherein e represents an integer of 0 to 4, wherein f represents an integer of 0 to 20, and wherein g represents an integer of 0 to 4.

3. The electrophotographic photoconductor according to claim 2, wherein the polycarbonate resin having the constitutional unit expressed by the general formula (II) further comprises a repeating unit expressed by the following general formula (IV):

General formula (IV)

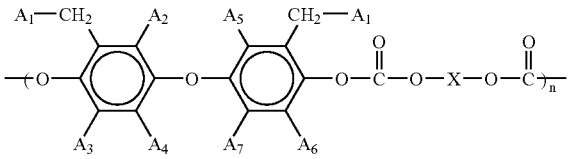

wherein $A_1$ represents an alkyl group which is substitutional or nonsubstitutional, or an aryl group which is substitutional or nonsubstitutional, and $A_2$, $A_3$, $A_4$, $A_5$, $A_6$ and $A_7$ each represent one of a hydrogen atom, a halogen atom, an alkyl group which as 1 to 6 carbon atoms and is substitutional or nonsubstitutional, and wherein n represents a repeating number which is an integer of 2 to 5000.

4. The electrophotographic photoconductor according to claim 1, wherein the polycarbonate resin having the constitutional unit expressed by the general formula (II) further comprises a constitutional unit expressed by the following general formula (V):

General formula (V)

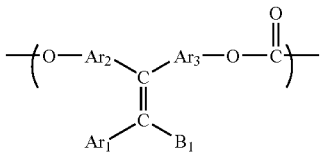

wherein a composition ratio k of the constitutional unit expressed by the general formula (II) and a composition ratio j of the constitutional unit expressed by the general formula (V) satisfy the following expression:

$$0<k/(k+j)\leqq 1,$$

wherein $B_1$ represents one of a hydrogen atom, an alkyl group which is substitutional or nonsubstitutional, and an aryl group which is substitutional or nonsubstitutional, wherein $Ar_1$ represents an aryl group which is substitutional or nonsubstitutional, and wherein $Ar_2$ and $Ar_3$ represent an allylene group which is substitutional or nonsubstitutional.

5. The electrophotographic photoconductor according to claim 4, wherein the polycarbonate resin having the constitutional unit expressed by the general formula (II) further comprises a repeating unit expressed by the following general formula (VI):

General formula (VI)

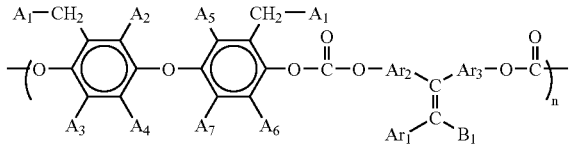

wherein $A_1$ represents an alkyl group which is substitutional or nonsubstitutional, or an aryl group which is substitutional or nonsubstitutional, and $A_2$, $A_3$, $A_4$, $A_5$, $A_6$ and $A_7$ each represent one of a hydrogen atom, a halogen atom, an alkyl group which as 1 to 6 carbon atoms and is substitutional or nonsubstitutional, and wherein n represents a repeating number which is an integer of 2 to 5000.

6. The electrophotographic photoconductor according to claim 1, wherein the polycarbonate resin having the constitutional unit expressed by the general formula (II) further comprises a constitutional unit expressed by the following general formula (VII):

General formula (VII)

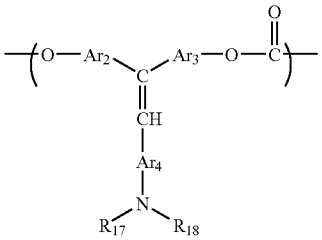

wherein a composition ratio k of the constitutional unit expressed by the general formula (II) and a composition ratio j of the constitutional unit expressed by the general formula (VII) satisfy the following expression:

$$0<k/(k+j)\leqq 1,$$

wherein $Ar_2$ and $Ar_3$ represent an allylene group which is substitutional or nonsubstitutional, wherein $Ar_4$ represents an allylene group which is substitutional or nonsubstitutional, wherein $R_{17}$ and $R_{18}$ represent independently one of:

an acyl group, an alkyl group which is substitutional or nonsubstitutional, and an aryl group which is substitutional or nonsubstitutional, $R_{17}$ and $R_{18}$ being identical with each other or different from each other.

7. The electrophotographic photoconductor according to claim 6, wherein the polycarbonate resin having the constitutional unit expressed by the general formula (II) comprises a repeating unit expressed by the following general formula (VIII):

General formula (VIII)

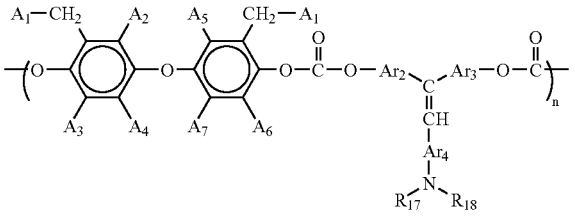

wherein $A_1$ represents an alkyl group which is substitutional or nonsubstitutional, or an aryl group which is substitutional or nonsubstitutional, and $A_2$, $A_3$, $A_4$, $A_5$, $A_6$ and $A_7$ each represent one of a hydrogen atom, a halogen atom, an alkyl group which as 1 to 6 carbon atoms and is substitutional or nonsubstitutional, and wherein n represents a repeating number which is an integer of 2 to 5000.

8. The electrophotographic photoconductor according to claim 1, wherein the polycarbonate resin having the constitutional unit expressed by the general formula (II) further comprises a constitutional unit expressed by the following general formula (IX):

General formula (IX)

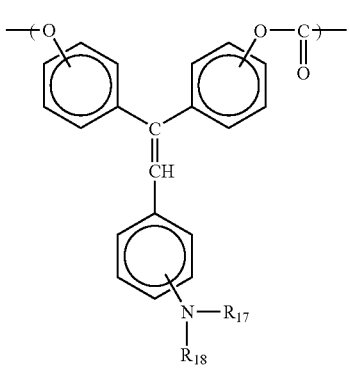

wherein a composition ratio k of the constitutional unit expressed by the general formula (II) and a composition ratio j of the constitutional unit expressed by the general formula (IX) satisfy the following expression:

$$0<k/(k+j)\leqq 1,$$

wherein $R_{17}$ and $R_{18}$ represent independently one of:

an acyl group, an alkyl group which is substitutional or nonsubstitutional, and an aryl group which is substitutional or nonsubstitutional, $R_{17}$ and $R_{18}$ being identical with each other or different from each other.

9. The electrophotographic photoconductor according to claim 8, wherein the polycarbonate resin having the constitutional unit expressed by the general formula (II) further comprises a repeating unit expressed by the following general formula (X):

General formula (X)

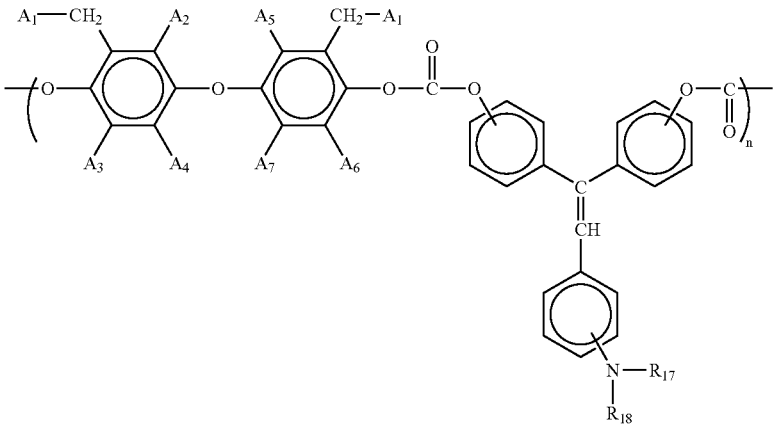

wherein $A_1$ represents an alkyl group which is substitutional or nonsubstitutional, or an aryl group which is substitutional or nonsubstitutional, and $A_2$, $A_3$, $A_4$, $A_5$, $A_6$ and $A_7$ each represent one of a hydrogen atom, a halogen atom, an alkyl group which as 1 to 6 carbon atoms and is substitutional or nonsubstitutional, and wherein n represents a repeating number which is an integer of 2 to 5000.

10. The electrophotographic photoconductor according to claim 1, wherein the electrophotographic photoconductive layer comprises:

at least a charge generating layer and a charge transporting layer, and wherein the charge transporting layer comprises, as an effective component, the polycarbonate resin having the constitutional unit expressed by the general formula (II).

11. The electrophotographic photoconductor according to claim 4, wherein the electrophotographic photoconductive layer comprises:

at least a charge generating material and a charge transporting material, and wherein the polycarbonate resin having the constitutional unit expressed by the general formula (II) is contained as the charge transporting material and as an effective component.

12. The electrophotographic photoconductor according to claim 6, wherein the electrophotographic photoconductive layer comprises:

at least a charge generating material and a charge transporting material, and wherein the polycarbonate resin having the constitutional unit expressed by the general formula (II) is contained as the charge transporting material and as an effective component.

13. The electrophotographic photoconductor according to claim 8, wherein the electrophotographic photoconductive layer comprises:

at least a charge generating material and a charge transporting material, and wherein the polycarbonate resin having the constitutional unit expressed by the general formula (II) is contained as the charge transporting material and as an effective component.

14. The electrophotographic photoconductor according to claim 1, wherein the electrophotographic photoconductive layer comprises:

at least a charge generating material and a charge transporting material, and wherein a top surface layer of the electrophotographic photoconductor comprises, as an effective component, the polycarbonate resin having the constitutional unit expressed by the general formula (II).

15. The electrophotographic photoconductor according to claim 1, wherein the photoconductive layer is a single photoconductive layer, and wherein the single photoconductive layer comprises therein, as an effective component, the polycarbonate resin having the constitutional unit expressed by the general formula (II).

16. The electrophotographic photoconductor according to claim 1, wherein the photoconductive layer is a single photoconductive layer having a top surface layer of the electrophotographic photoconductor, and wherein the top surface layer of the electrophotographic photoconductor comprises, as an effective component, the polycarbonate resin having the constitutional unit expressed by the general formula (II).

17. The electrophotographic photoconductor according to claim 1, wherein the polycarbonate resin having the constitutional unit expressed by the general formula (II) has a polystyrene conversion weight average molecular weight of 7000 to 1000000 through a gel permeation chromatography.

* * * * *